US005120635A

United States Patent [19]

Sasaki et al.

[11] Patent Number: 5,120,635

[45] Date of Patent: Jun. 9, 1992

[54] METHOD FOR PROCESSING SILVER HALIDE PHOTOGRAPHIC MATERIAL AND COMPOSITION HAVING FIXING ABILITY

[75] Inventors: Hirotomo Sasaki; Tetsuro Kojima; Shinji Ueda, all of Kanagawa, Japan

[73] Assignee: Fuji Photo Film Co., Ltd., Kanagawa, Japan

[21] Appl. No.: 613,044

[22] Filed: Nov. 15, 1990

[30] Foreign Application Priority Data

Nov. 16, 1989 [JP] Japan ..... 1-298186
Nov. 17, 1989 [JP] Japan ..... 1-298935

[51] Int. Cl.[5] ..... G03C 7/42

[52] U.S. Cl. ..... 430/393; 430/455; 430/460

[58] Field of Search ..... 430/393, 400, 455, 460, 430/430

[56] References Cited

U.S. PATENT DOCUMENTS

| | | | |
|---|---|---|---|
| 2,440,954 | 5/1948 | Jennings | 95/88 |
| 3,615,513 | 10/1971 | Haist et al. | 96/61 |
| 3,667,950 | 6/1972 | Amano et al. | 96/60 |
| 3,879,202 | 4/1975 | Yamaguchi | 96/22 |

FOREIGN PATENT DOCUMENTS 1379615 1/1975 United Kingdom .

OTHER PUBLICATIONS

European Search Report, Jan. 15, 1991.

*Primary Examiner*—Hoa Van Le

*Attorney, Agent, or Firm*—Sughrue, Mion, Zinn, Macpeak & Seas

[57] ABSTRACT

A method for processing a silver halide photographic material which comprises processing an imagewise exposed silver halide photographic material with a processing solution having a fixing ability containing (1) a thiosulfate As disclosed, wherein said processing solution having a fixing ability further contains at least one of (2) at least one compound selected from the group consisting of a bisulfite and a sulfite, and a compound represented by formula (A'):

(A')

wherein $R'_1$, $R'_2$, $R'_3$, $R'_4$ and $R'_5$ each represents a hydrogen atom or a substituent other than a hydroxyl group or a group containing a hydroxyl group, provided that at least one of $R'_1$ to $R'_5$ is at least one of a sulfo group and a group constaining a sulfo group and (3) at least one bisulfite addition product of a compound represented by formula (A'). In the method, a fixing solution having a pH of from 5.0 to 9.0 or a bleach-fixing solution with improved stability over time during continuous processing and exhibiting excellent desilvering performance is used. The method provides an image showing a reduced increase in stain with time and realizes improvements of the working environment.

9 Claims, No Drawings

METHOD FOR PROCESSING SILVER HALIDE PHOTOGRAPHIC MATERIAL AND COMPOSITION HAVING FIXING ABILITY

FILED OF THE INVENTION

This invention relates to a method for processing a silver halide photographic material which reduces the deterioration of processing solutions with the passage of time during continuous processing, exhibits excellent desilvering properties, provides an image showing a reduced increase in stain with the passage of time, and achieves improvements in the working environment.

BACKGROUND OF THE INVENTION

In the photographic processing of silver halide light-sensitive materials, an important object has been to provide a satisfactory photographic image in a stable manner. This object has become more difficult to accomplish particularly in view of the latest requirements for speeding up of processing and reducing the rate of replenishment so that the amount of waste liquid can be reduced. For obtaining a satisfactory photographic image in a stable manner, the most significant factor is for photographic processing solutions to be stable against deterioration with the passage of time, such as by air oxidation. In particular, in the current color photographic processing systems where reduction of washing water or stabilizing processing has become widespread, improvement in the stability of the bleach-fixing or fixing bath and the subsequent washing or stabilizing bath is of extreme importance.

Carbonyl-bisulfite addition compounds have hitherto been proposed as a preservative and as a means for improving the stability of a bleach-fixing or fixing bath. For example, methods of using these carbonyl-bisulfite addition compounds as a preservative for a bleach-fixing or fixing bath are described in JP-A-48-42733 (the term "JP-A" as used herein means an "unexamined published Japanese patent application"), JP-A-50-51326, JP-A-56-107244, and West German Patent 2,102,713. However, although carbonyl-bisulfite addition compounds exhibit excellent performance as a preservative for a bleach-fixing or fixing bath, they have not yet been practically used because various problems arise in their use. In particular, when a conventional photographic light-sensitive material is processed with a bleach-fixing bath containing a carbonyl-bisulfite addition compound as a preservative, the resulting image has deteriorated preservability. That is, when the processed light-sensitive material is stored, the minimum density on the undeveloped area ($D_{min}$) increases with the passage of time and stain is generated. Moreover, lower aliphatic aldehydes, of the available carbonyl compounds, have a low vapor pressure and therefore give rise to handling problems and environmental problems, such as odor. Hence, there has been a strong desire for a method of processing a silver halide color photographic material in which a bleach-fixing or fixing bath exhibits excellent stability without causing deterioration of the resulting image with the passage of time or any other problems occurring.

On the other hand, it is known to add a specific sulfinic acid to a processing solution as disclosed, for example, in JP-B-49-33787 (the term "JP-B" as used herein means an "examined Japanese patent publication"), British Patent 571,078, and U.S. Pat. No. 3,293,036. JP-B-49-33787 relates to black-and-white development, and British Patent 571,078 relates to silver dye bleaching, both differing from the present invention in object of using a sulfinic acid and containing no disclosure at all as to stain prevention of color light-sensitive materials. Further, the compounds disclosed in U.S. Pat. No. 3,293,036 have been found not to produce any effect on image stain generated with the passage of time. Although British Patent 1,379,615 states that the sulfinic acid can be used to improve the stability of a bleach-fixing bath per se, there is no suggestion as to stain prevention of color light-sensitive materials.

In addition, JP-A-1-230039 describes the use of a sulfinic acid for stabilizing a processing solution and for prevention of stain of color light-sensitive materials. However, the effects produced are insufficient, or the solubility of the sulfinic acid in a processing solution is insufficient.

It has been proposed to conduct bleaching or bleach-fixing by replacing conventionally employed (ethylenediaminetetraacetato)iron (III) complexes with a bleaching agent having a higher oxidizing power thereby to shorten the processing time or to reduce the amount of waste liquid. That is, use of a powerful oxidizing agent as a bleaching agent is expected to increase the rate of bleaching reaction to thereby achieve rapid bleaching or bleach-fixing. It is also expected that a bleaching bath or a bleach-fixing bath maintains a high bleaching ability even if it is fatigued due to consumption of the oxidizing agent (bleaching agent) and accumulation of silver ion and halogen ion as the processing progresses thereby to decrease the amount of replenisher needed.

It has turned out, however, that such a powerful oxidizing agent (bleaching agent), when employed in a bleaching bath, diminishes the stability of the succeeding fixing bath with the passage of time due to the carry-over, or, when used in a bleach-fixing bath, considerably reduces the stability of the bleach-fixing bath per se with the passage of time, thus retarding the bleach-desilvering reaction. As a result, the succeeding washing or stabilizing bath also has reduced stability with the passage of time. It has thus been demanded to develop a technique for improving stability of a bleach-fixing bath or a fixing bath with time.

It has been proposed in JP-A-1-267540 to improve the stability of processing solutions by addition of a carbonyl-bisulfite addition compound and a compound having an amino group as a functional group to a bleach-fixing bath. However, the inventors have proved that a processing solution containing a carbonyl-bisulfite addition compound and a compound having an amino group forms a precipitate or a color change to black brown occurs on aging.

SUMMARY OF THE INVENTION

An object of the present invention is to provide a method for processing a silver halide photographic material, in which a fixing bath or a bleach-fixing bath has excellent stability.

Another object of the present invention is to provide a fixing bath or a bleach-fixing bath having excellent stability.

Still another object of the present invention is to provide a method for processing a silver halide photographic material, which provides a photographic image having excellent preservability.

A further object of the present invention is to provide a method for processing a silver halide photographic material, which achieves rapid desilvering.

A still further object of the present invention is to provide a method for processing a silver halide photographic material, where environmental pollution does not occur.

Yet a further object of the present invention is to provide a method for processing a silver halide photographic material, in which a washing bath or a stabilizing bath has excellent stability with the passage of time.

As a result of extensive investigations, it has now been found that the above objects of the present invention are accomplished by using a processing solution having a fixing ability with a specific composition.

The present invention provides a method for processing a silver halide photographic material which comprises processing an imagewise exposed silver halide photographic material with a processing solution having a fixing ability containing (1) a thiosulfate, wherein said processing solution having a fixing ability further contains (2) at least one compound selected from the group consisting of bisulfite, and a sulfite, and a compound represented by formula (A'):

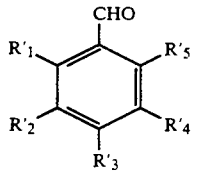

(A')

wherein $R'_1$, $R'_2$, $R'_3$, $R'_4$, and $R'_5$ each represents a hydrogen atom or a substituent other than a hydroxyl group or a group containing a hydroxyl group, provided that at least one of $R'_1$ to $R'_5$ is at least one of a sulfo group and a group containing a sulfo group, and (3) at least one bisulfite addition product of a compound represented by formula (A') above.

The present invention further provides a composition having a fixing ability which contains (1) a thiosulfate and at least one of (2) at lease one compound selected from the group consisting of a bisulfite and a sulfite, and a compound represented by formula (A') and (3) at least one bisulfite addition product of a compound represented by formula (A') above.

The present invention furthermore provides a method for processing a silver halide photographic material which comprises processing an imagewise exposed silver halide photographic material with a processing solution having a fixing ability, wherein the processing solution having a fixing ability contains (I) at least one of (i) at least one compound selected from the group consisting of a bisulfite, a sulfite, and a metabisulfite and (ii) at least one compound capable of an addition reaction with a bisulfite and (iii) an addition product between at least one compound capable of an addition reaction with a bisulfite and (II) at least one compound capable of reacting with sulfur.

DETAILED DESCRIPTION OF THE INVENTION

In formula (A'), $R'_1$, $R'_2$, $R'_3$, $R'_4$, and $R'_5$ each represents a halogen atom, a cyano group, a sulfino group, a sulfo group, a phosphono group, a hydrogen atom, a substituted or unsubstituted alkyl group, a substituted or unsubstituted alkenyl group, a substituted or unsubstituted alkynyl group, a substituted or unsubstituted cycloalkyl group, a substituted or unsubstituted aryl group, a substituted or unsubstituted aralkyl group, a substituted or unsubstituted heterocyclic group, a substituted or unsubstituted alkoxy group, a substituted or unsubstituted aryloxy group, a substituted or unsubstituted alkoxycarbonyl group, a substituted or unsubstituted acyloxy group, a substituted or unsubstituted thioether group, a substituted or unsubstituted sulfamoyl group, a substituted or unsubstituted amino group, a substituted or unsubstituted ammonio group, a substituted or unsubstituted acylamino group, a substituted or unsubstituted carbamoyl group, or a substituted or unsubstituted sulfamoyl group, provided that at least one of them is a sulfo group and/or a group containing a sulfo group and that each of $R'_1$, $R'_2$, $R'_3$, $R'_4$, and $R'_5$ does not contain a hydroxyl group or a group containing a hydroxyl group.

Examples of $R'_1$, $R'_2$, $R'_3$, $R'_4$, and $R'_5$ include alkyl groups (e.g., methyl, ethyl, propyl, butyl, octyl, sulfomethyl, methoxyethyl), alkenyl groups (e.g., allyl, vinyl), alkynyl groups (e.g., ethynyl, propargyl, octynyl), cycloalkyl groups (e.g., cyclopropyl, cyclopentyl, cyclohexyl), aryl groups (e.g., phenyl, naphthyl), aralkyl groups (e.g., benzyl, phenethyl), heterocyclic groups (e.g., pyridyl, piperidyl, furyl, furfuryl), alkoxy groups (e.g., methoxy, butoxy, 3-sulfopropyloxy), aryloxy groups (e.g., phenoxy), alkoxycarbonyl groups (e.g., methoxycarbonyl, ethoxycarbonyl), acyloxy groups (e.g., acetoxy, benzoyloxy), thioether groups (e.g., methylthio, propylthio), sulfamoyl groups (e.g., methylsulfamoyl, diethylsulfamoyl), amino groups (e.g., methylamino, dimethylamino, propylamino, sulfomethylamino), ammonio groups (e.g., trimethylammonio, triethylammonio), acylamino groups (e.g., N-methylacetamido, acetylamino), carbamoyl groups (e.g., carbamoyl, dimethylcarbamoyl, propylcarbamoyl), sulfamoyl groups (e.g., sulfamoyl, methylsulfamoyl), halogen atoms (e.g., chlorine, bromine), a hydrogen atom, a cyano group, a sulfino group, a sulfo group, and a phosphono group.

Examples of suitable substituent groups for $R'_1$, $R'_2$, $R'_3$, $R'_4$, or $R'_5$ include a halogen atom, an alkoxy group, an aryloxy group, an ester group, a mercapto group, a thioether group, a sulfo group, a sulfino group, a sulfinyl group, a sulfonyl group, a sulfamoyl group, an amino group, a cyano group, a phosphono group, an ammonio group, an acylamino group, a carbamoyl group, and a heterocyclic group.

Preferred compounds represented by formula (A') are those where $R'_1$, $R'_2$, $R'_3$, $R'_4$, and $R'_5$ each represents an alkyl group, an alkoxy group, an alkylamino group, an acylamino group, a carbamoyl group, an ammonio group, a hydrogen atom, a halogen atom, a sulfino group, a sulfo group, or a phosphono group, each of which may be substituted with an amino group, an ammonio group, a phosphono group, or a sulfo group, provided that at least one of $R'_1$, $R'_2$, $R'_3$, $R'_4$, and $R'_5$ is a sulfo group and/or a group containing a sulfo group and that each of $R'_1$, $R'_2$, $R'_3$, $R'_4$, and $R'_5$ does not contain a hydroxyl group or a group containing a hydroxyl group.

More preferred compounds are those where any one or two of $R'_1$, $R'_2$, $R'_3$, $R'_4$, and $R'_5$ each represents a sulfoalkyl group, a sulfoalkyloxy group, a sulfoalkylcarbamoyl group, a hydrogen atom, a halogen atom, a sulfino group, or a sulfo group; and at least three of $R'_1$, $R'_2$, $R'_3$, $R'_4$, and $R'_5$ represent a hydrogen atom.

Most preferred compounds are benzaldehyde substituted with only a sulfoalkyloxy group and benzaldehyde whose ortho-position is substituted with a sulfo group in which at least three of $R'_1$, $R'_2$, $R'_3$, $R'_4$, and $R'_5$ are hydrogen atoms and none of $R'_1$, $R'_2$, $R'_3$, $R'_4$, and $R'_5$ contains a hydroxyl group or a group containing a hydroxyl group.

When each of $R'_1$, $R'_2$, $R'_3$, $R'_4$, and $R'_5$ contains a carbon atom(s), the number of the carbon atoms is suitably from 1 to 30, preferably from 1 to 20, more preferably from 1 to 8, and most preferably from 1 to 4.

Specific but non-limiting examples of compounds represented by formula (A') are shown below.

A'-1

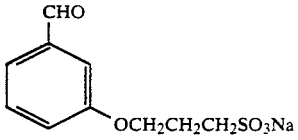

A'-2

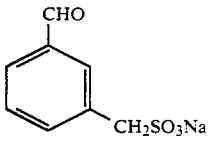

A'-3

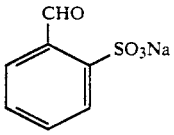

A'-4

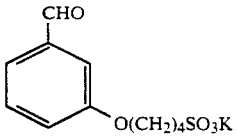

A'-5

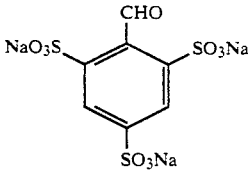

A'-6

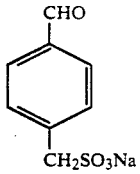

A'-7

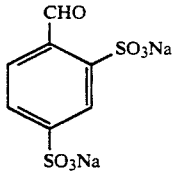

A'-8

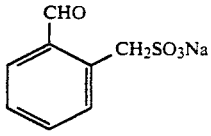

-continued

A'-9

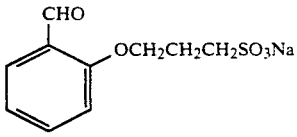

A'-10

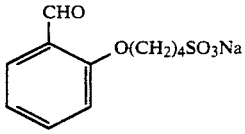

A'-11

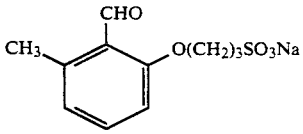

A'-12

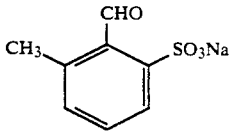

A'-13

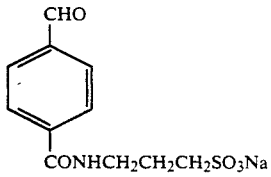

A'-14

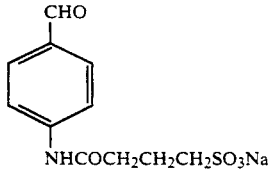

A'-15

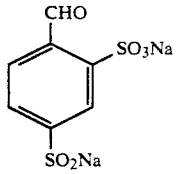

A'-16

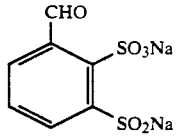

A'-17

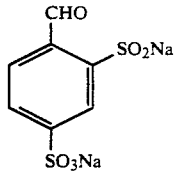

A'-18

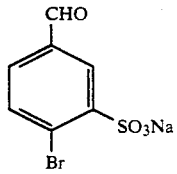

-continued
A'-19
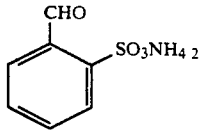
A'-20
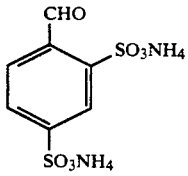
A'-21
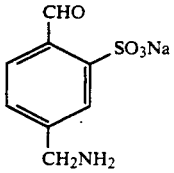
A'-22
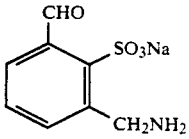
A'-23
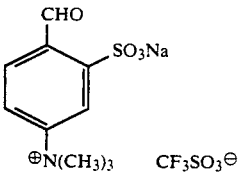
A'-24
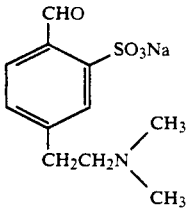
A'-25
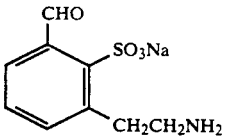
A'-26
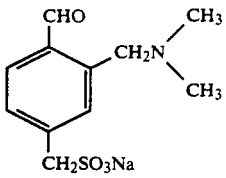
A'-27
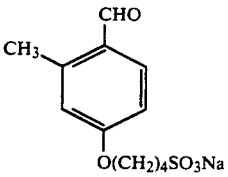
-continued
A'-28
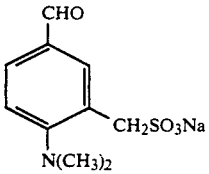
A'-29
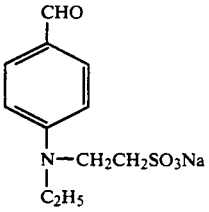
A'-30
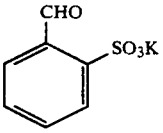
A'-31
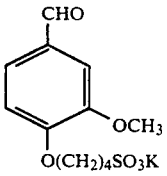
A'-32
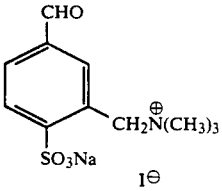
A'-33
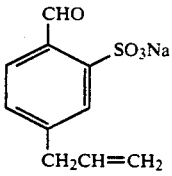
A'-34
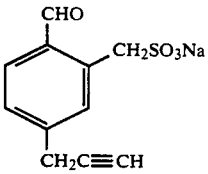
A'-35
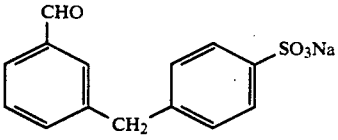
A'-36
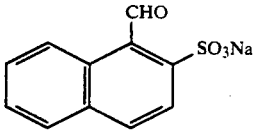

-continued

A'-37

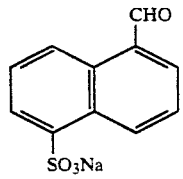

Many of the compounds represented by formulae (A') are commercially available. Other compounds of the formula (A') can be synthesized by utilizing known organic chemical reactions. For instance, Compound Nos. A'-4 and A'-31 can be synthesized using the process described in *Organic Syntheses,* Collective Volume I, p. 537 (1941) and ibid, Collective Volume III, p. 564 (1955).

The compound of formula (A') may be added to a processing solution having a fixing ability, including a bleach-fixing bath and a fixing bath, in the present invention, either separately from a bisulfite, a sulfite, or a metabisulfite or may be added in the form of a bisulfite addition compound thereof. When the compound of formula (A') is added in the form of bisulfite addition compound thereof, the amount of the compound of formula (A') added may be an amount described below.

Where the compound represented by formula (A') is added to a processing solution having a fixing ability, the molar ratio of the compound of formula (A') to bisulfite or sulfite suitably ranges from 30/1 to 1/30, preferably from 5/1 to 1/10, and more preferably from 1/1 to 1/5.

The amount of the compound represented by formula (A') to be added to a processing solution having a fixing ability suitably ranges from $1\times10^{-5}$ to 10 mol/l, preferably from $1\times10^{-3}$ to 5 mol/l, and more preferably from $1\times10^{-2}$ to 1 mol/l.

When added to a processing solution having a fixing ability, the compound of formula (A') appears to form a bisulfite addition compound to decrease a bisulfite ion concentration in the processing solution whereby the processing solution becomes less susceptible to oxidation and thus more stable.

Examples of compound capable of addition reacting with a bisulfite which can be used as component (I) preferably includes compounds represented by formula (A) to (D) shown below.

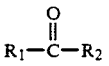

(A)

wherein $R_1$ represents a hydrogen atom, a substituted or unsubstituted alkyl group (e.g., methyl, ethyl, methoxyethyl, carboxymethyl, sulfomethyl, sulfoethyl), a substituted or unsubstituted alkenyl group (e.g., allyl), a substituted or unsubstituted aralkyl group (e.g., benzyl, phenethyl, 4-methoxybenzyl, 4-sulfobenzyl), a substituted or unsubstituted cycloalkyl group (cyclohexyl), a substituted or unsubstituted aryl group (e.g., phenyl, naphthyl, 3-sulfobutoxyphenyl, 4-N-methyl-N-sulfopropylaminophenyl, 3-sulfopropylphenyl, 3-carboxyphenyl), a substituted or unsubstituted heterocyclic group (e.g., pyridyl, thienyl, pyrrolyl, indolyl, furyl, furfuryl, morpholinyl, imidazolyl), a carboxyl group or a salt thereof, a substituted or unsubstituted ester group (e.g., methoxycarbonyl, ethoxycarbonyl), a substituted or unsubstituted acyl group (e.g., acetyl, methoxypropionyl), or a substituted or unsubstituted carbamoyl group (e.g., carbamoyl, dimethylcarbamoyl); $R_2$ represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, or a substituted or unsubstituted heterocyclic group; or $R_1$ and $R_2$ can combine to form a ring.

Examples of suitable alkyl, alkenyl, aralkyl, cycloalkyl, aryl or heterocyclic groups represented by $R_2$ are the same as those enumerated above for $R_1$. $R_1$ and $R_2$ may be combine and form a 5- to 7-membered saturated or unsaturated ring.

Examples of the substituents for the above groups (i.e., the group for $R_1$ and $R_2$) which may be substituted include a halogen atom, an alkoxy group, an aryloxy group, an ester group, a sulfo group, a carboxy group, a nitro group, a hydroxyl group, an amino group, an ammonio group, a phosphono group, a sulfamoyl group, a cyano group, an acylamino group, a sulfonyl group, a sulfino group, a carbamoyl group, a mercapto group and a heterocyclic group.

Preferred compounds represented by formula (A) are those wherein $R_1$ and $R_2$ each represents a hydrogen atom, a substituted or unsubstituted alkyl group (preferably having 1 to 10 carbon atoms and more preferably having 1 to 6 carbon atoms), a substituted or unsubstituted aryl group (preferably having 6 to 20 carbon atoms and more preferably having 6 to 10 carbon atoms), or a substituted or unsubstituted heterocyclic group (preferably having 1 to 10 carbon atoms and more preferably having 1 to 6 carbon atoms). With proviso that both of $R_1$ and $R_2$ are not a hydrogen atom at the same time.

More preferred compounds are those wherein $R_1$ represents a hydrogen atom; and $R_2$ represents a substituted or unsubstituted aryl group or a substituted or unsubstituted heterocyclic group. When the aryl group as $R_2$ has a substituent(s), the substituents preferably have a total Hammett's $\sigma$ value of from $-1.2$ to 1.0 and preferably contains at least one of a sulfo group, a carboxyl group, a sulfino group, a phosphono group, and an ammonium group. The terminology "Hammett's $\sigma$ value" as used herein means the value described in *Journal of Medicinal Chemistry,* Vol. 16, p. 1207 (1973) and ibid, Vol. 20, p. 304 (1977).

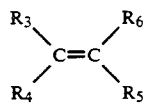

(B)

wherein $R_3$, $R_4$, and $R_5$ each represents a hydrogen atom, a substituted or unsubstituted alkyl group, a substituted or unsubstituted alkenyl group, a substituted or unsubstituted aralkyl group, a substituted or unsubstituted cycloalkyl group, a substituted or unsubstituted aryl group, a substituted or unsubstituted heterocyclic group, a carboxyl group or a salt thereof, a substituted or unsubstituted ester group, a substituted or unsubstituted acyl group, a halogen atom (e.g., chlorine), a substituted or unsubstituted ether group (e.g., methoxy, phenoxy), a sulfo group or a salt thereof, a substituted or unsubstituted sulfinyl group (e.g., methanesulfinyl), a substituted or unsubstituted sulfonyl group (e.g., methanesulfonyl, benzenesulfonyl, 4-methylbenzenesulfonyl), a cyano group, a nitro group, a substituted or unsubstituted carbamoyl group, or a substituted or unsubstituted sulfamoyl group (e.g., sulfamoyl, dimethylsulfamoyl); and $R_6$ represents an electron attracting group; or $R_3$ and $R_4$, $R_4$ and $R_5$, $R_5$ and $R_6$, or $R_6$ and $R_3$ can combine to form a ring. With a proviso that when at least one of $R_3$, $R_4$, $R_5$ and $R_6$ is an acyl group, $R_4$ and $R_5$ or $R_6$ and $R_3$ does not form a ring. The total numbers of carbon atoms in each $R_3$, $R_4$, $R_5$ and $R_6$ are preferably 20 or less and more preferably 10 or less.

In formula (B), examples of suitable alkyl, alkenyl, aralkyl, cycloalkyl, aryl, heterocyclic, ester, acyl, carboxyl group or salt thereof and carbamoyl groups represented by $R_3$, $R_4$, or $R_5$ are the same as those represented by $R_1$. The electron attracting group for $R_6$ preferably has a Hammett's $\sigma$ value of from 0 to 1.0 and examples include a nitro group, a cyano group, a sulfonyl group, an acyl group, and an ester group. The above group for $R_3$, $R_4$ and $R_5$ may be further substituted by the substituents for $R_1$ in formula (I).

$R_3$, $R_4$ and $R_5$ each preferably represents a hydrogen atom, a carboxyl group or a salt thereof, a cyano group, a substituted or unsubstituted alkyl group, a substituted or unsubstituted aryl group, a substituted or unsubstituted heterocyclic group, a substituted or unsubstituted ester group, or a substituted or unsubstituted acyl group. $R_6$ preferably represents a nitro group, a cyano group, a substituted or unsubstituted acyl group, or a substituted or unsubstituted ester group.

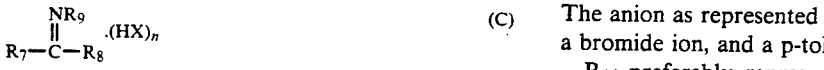

(C)

wherein $R_7$, $R_8$, and $R_9$ each represents a hydrogen atom, a substituted or unsubstituted alkyl group , a substituted or unsubstituted alkenyl group, a substituted or unsubstituted cycloalkyl group, a substituted or unsubstituted aralkyl group, a substituted or unsubstituted aryl group, a substituted or unsubstituted heterocyclic group, a substituted or unsubstituted amino group (e.g., amino, dimethylamino, carboxymethylamino), a carboxyl group or a salt thereof, a substituted or unsubstituted ester group, a substituted or unsubstituted acyl group, a substituted or unsubstituted ether group, a hydroxyl group, or a substituted or unsubstituted thioether group (e.g., methylthio, methylthiomethylthio); X represents an anion; and n represents 0 or 1; or $R_7$ and $R_8$, $R_8$ and $R_9$, or $R_9$ and $R_7$ can combine to form a ring.

In formula (C), examples of suitable alkyl, alkenyl, cycloalkyl, aralkyl, aryl, heterocyclic, ester, acyl and ether groups represented by $R_7$, $R_8$ or $R_9$ are the same as those for $R_1$. With proviso that all of $R_7$, $R_8$ or $R_9$ are not a hydrogen atom at the same time. The above group for $R_7$, $R_8$ or $R_9$ may be further substituted by the substituents for $R_1$ in formula (I). The total numbers of carbon atoms in each $R_7$, $R_8$ and $R_9$ are preferably 20 or less and more preferably 10 or less.

The anion as represented by X includes a chloride ion, a bromide ion, a p-toluenesulfonate ion, and a perchlorate ion.

$R_7$, $R_8$, and $R_9$ each preferably represents a hydrogen atom, a substituted or unsubstituted alkyl group, a substituted or unsubstituted aryl group, a substituted or unsubstituted heterocyclic group, or a substituted or unsubstituted amino group.

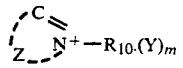

(D)

wherein $R_{10}$ represents a substituted or unsubstituted alkyl group (e.g., methyl, ethyl, sulfoethyl, sulfobutyl, sulfopropyl, carboxymethyl, dimethylaminoethyl, 2,2,2-trifluoroethyl), a substituted or unsubstituted alkenyl group (e.g., allyl), a substituted or unsubstituted aralkyl group (e.g., benzyl, phenethyl), a substituted or unsubstituted cycloalkyl group (e.g., cyclohexyl), a substituted or unsubstituted aryl group (e.g., phenyl, naphthyl, 4-methoxyphenyl, 3-sulfopropylphenyl), or a substituted or unsubstituted heterocyclic group (e.g., pyridyl, pyrazolyl, imidazolyl); Z represents a heterocyclic group comprising at least one of a carbon atom, a nitrogen atom, an oxygen atom, a sulfur atom and a selenium atom; Y represents an anion; and m represents 0 or 1; or $R_{10}$ can combine with an atom in the Z ring and form a ring.

In formula (D), the heterocyclic group represented by Z can be a substituted or unsubstituted 5 or 6-membered ring composed of at least one of a carbon atom and a nitrogen atom and an oxygen atom, a sulfur atom, and a selenium atom (e.g., pyridinium, imidazolium, quinolinium, oxazolium, thiazolium, benzimidazolium). The anion as represented by Y includes a chloride ion, a bromide ion, and a p-toluenesulfonate ion.

$R_{10}$ preferably represents a substituted or unsubstituted alkyl group, and Z preferably represents an imidazolium ring, a benzimidazolium ring, or a quinolinium ring. The total numbers of carbon atoms in $R_{10}$ are preferably 20 or less and more preferably 10 or less.

Of the compounds represented by formulae (A) to (D), preferred are those of formulae (A) and (D), and more preferred are those of formula (A).

Specific but non-limiting examples of compounds of the formulae (A) to (D) are shown below. Compound Nos. in the parentheses indicate the Compound Nos. used for the compounds represented by formula (A').

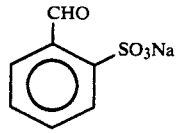

A-1 (A'-3)

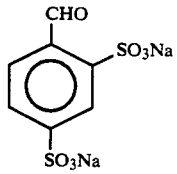

A-2 (A'-7)

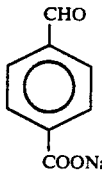

A-3

-continued
A-4
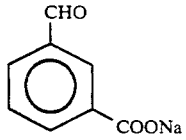
A-5
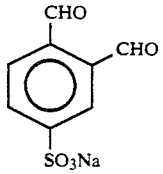
A-6
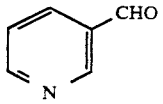
A-7
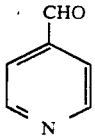
A-8
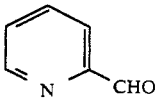
A-9
(A'-1)
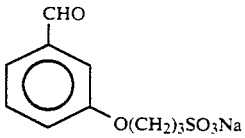
A-10
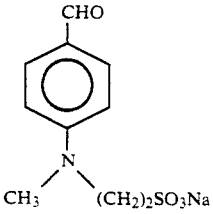
A-11
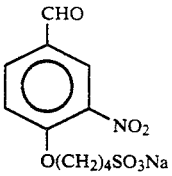
A-12
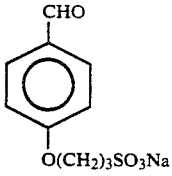
A-13
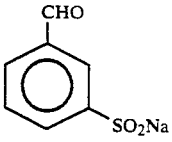
-continued
A-14
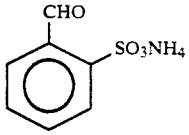
A-15
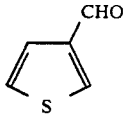
A-16
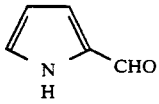
A-17
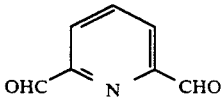
A-18
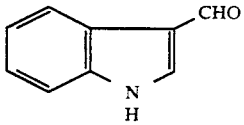
A-19
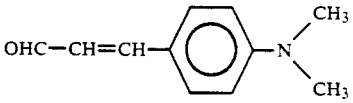
A-20
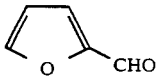
A-21
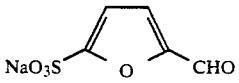
A-22
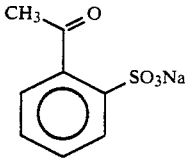
A-23
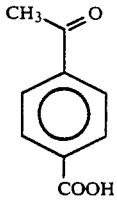
A-24
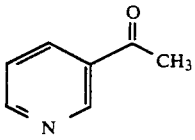
A-25
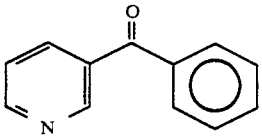

-continued
$NaO_3SCH_2CH_2CHO$ A-26
$CH_3\overset{O}{\overset{\|}{C}}H$ A-27
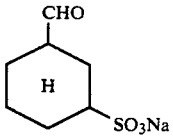
A-28
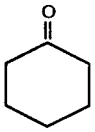
A-29
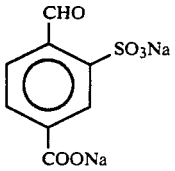
A-30
$CH_3\overset{O}{\overset{\|}{C}}CH_2CH_2SO_3Na$ A-31
$CH_3\overset{O}{\overset{\|}{C}}CH_2OH$ A-32
$CH_3OCH_2CHO$ A-33
$CH_3\overset{O}{\overset{\|}{C}}COOH$ A-34
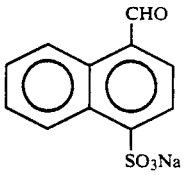
A-35
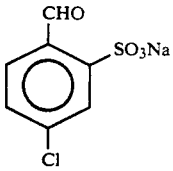
A-36
$OHC(CH_2)_4CHO$ A-37
$OHC(CH_2)_2CHO$ A-38
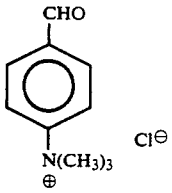
A-39
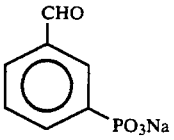
A-40
-continued
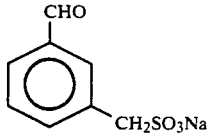
A-41 (A'-2)
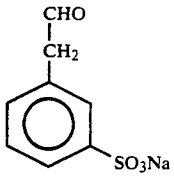
A-42
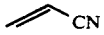
B-1
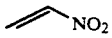
B-2
$NCCH{=}CHSO_3Na$ B-3
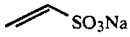
B-4
$O_2NCH{=}CHSO_3Na$ B-5
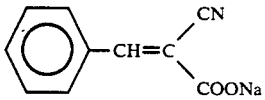
B-6
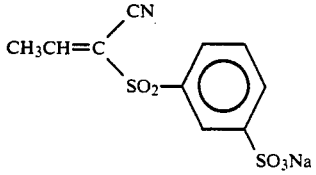
B-7
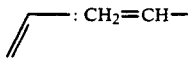
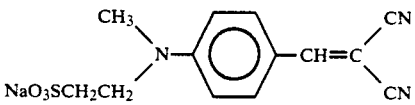
B-8
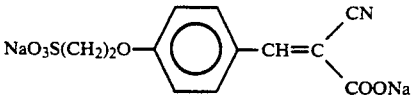
B-9
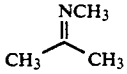
C-1
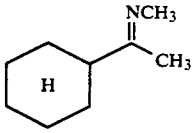
C-2
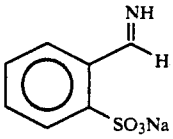
C-3

-continued
C-4
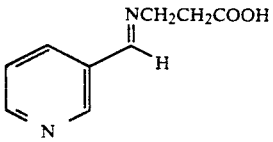
C-5
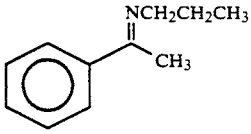
C-6
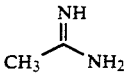
C-7
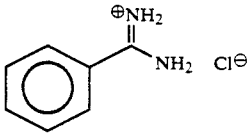
C-8
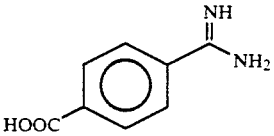
C-9
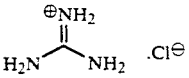
C-10
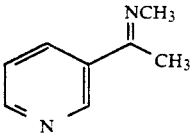
C-11
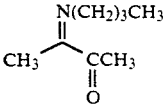
C-12
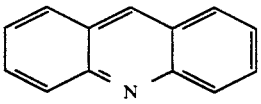
C-13
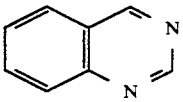
C-14
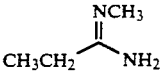
C-15
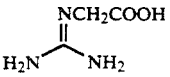
C-16
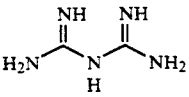
-continued
D-1
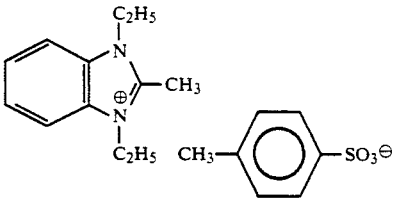
D-2
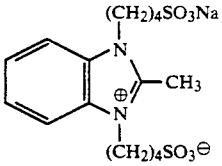
D-3
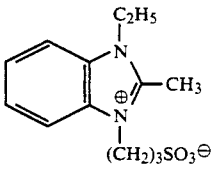
D-4
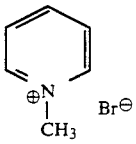
D-5
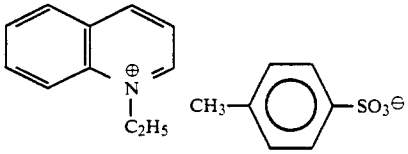
D-6
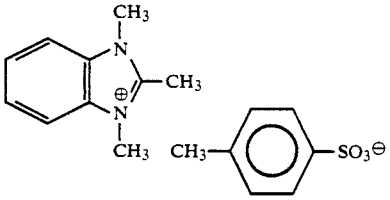
D-7
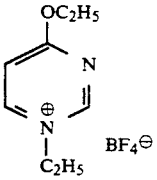
D-8
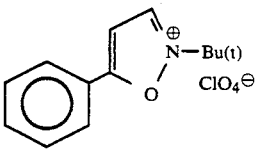

-continued

D-9

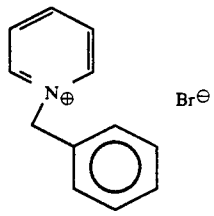

D-10

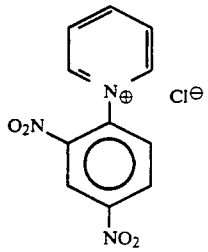

D-11

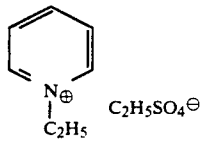

Many of the compounds represented by formulae (A) to (D) are commercially available. Other compounds of formulae (A) to (D) can be synthesized using known organic chemical reactions, for example, using the process described in *Organic Syntheses,* Collective Volume I, p. 537 (1941), ibid, Collective Volume III, p. 564 (1955), *Organic Reaction,* Vol. 16, p. 1 (1968), S. R. Sandler and W. Carro, *Organic Functional Group Preparations,* Vol. 2, p. 291 (1986), and ibid, Vol. 3, p. 205 (1972).

The amount of the compound of formulae (A) to (D) and/or a bisulfite addition compound thereof which can be added to a processing solution having fixing ability is the same as that of the compound of formula (A').

Component (II) is a compound capable of reacting with sulfur generated by oxidation of thiosulfate added to a processing solution. A compound capable of reacting with an intermediate arising between the conversion of a thiosulfate to sulfur (e.g., polythionic acid) is also useful as component (II). Examples of these compounds include various nucleophilic reagents (thiophiles) described, e.g., in Shigeru Daikyo, *Yuki Io Kagaku,* "Hanno Kiko", p. 172–. Component (II) does not need to be copresent with a thiosulfate and can be used at various processing steps.

Component (II) preferably includes compounds represented by formulae (E) to (H) below:

$$R_{11}—SO_2M \qquad (E)$$

wherein $R_{11}$ represents a substituted or unsubstituted alkyl group (e.g., methyl, ethyl, n-propyl, hydroxymethyl, 2-hydroxyethyl, sulfoethyl, carboxyethyl, methoxyethyl), a substituted or unsubstituted alkenyl group (e.g., allyl), a substituted or unsubstituted aralkyl group (e.g., benzyl, phenethyl, 4-carboxyphenylmethyl, 3-sulfophenylmethyl), a substituted or unsubstituted cycloalkyl group (e.g., cyclohexyl), a substituted or unsubstituted aryl group (e.g., phenyl, 4-methylphenyl, naphthyl, 3-carboxyphenyl, 4-methoxyphenyl, 3-sulfophenyl, 3-sulfopropyloxyphenyl), or a substituted or unsubstituted heterocyclic group (e.g., pyridyl, furyl, thienyl, pyrazoly, indolyl); and M represents a cation.

In formula (E), the cation as represented by M includes a hydrogen atom, an alkali metal (e.g., Na, K, Li), an alkaline earth metal (e.g., Ca, Ba), a nitrogen-containing organic base (e.g., amines capable of forming a salt with sulfinic acid), and an ammonium group. The above group for $R_{11}$ may be further substituted by the substituents for $R_1$ in formula (I).

$R_{11}$ preferably represents a substituted or unsubstituted aryl group or a substituted or unsubstituted heterocyclic group, and more preferably a substituted or unsubstituted aryl group. The total numbers of carbon atoms in $R_{11}$ are preferably 20 or less and more preferably 10 or less. The substituted aryl group has substituents whose total Hammett's $\sigma$ value is from $-1.0$ to 0.8.

Examples of the substituents for $R_{11}$ include a methyl group ($\sigma_m=0.07$, $\sigma_p=-0.17$), a phenyl group ($\sigma_m=0.06$, $\sigma_p=-0.01$), a carboxylic acid ($\sigma_m=0.37$, $\sigma_p=0.45$) or salt thereof, a methoxy group ($\sigma_m=0.12$, $\sigma_p=-0.27$), 3,5-dichloro group (the total $\sigma$ value$=0.74$), 3,5-dicarboxyl group and sulfonic acid or a salt thereof. These substituents may be selected with reference to the literature described above.

$$\begin{matrix} R_{12} \diagdown \\ R_{13}—P \\ R_{14} \diagup \end{matrix} \qquad (F)$$

wherein $R_{12}$, $R_{13}$, and $R_{14}$ each represents a substituted or unsubstituted alkyl group (e.g., methyl, ethyl, n-butyl, methoxyethyl, carboxyethyl, sulfoethyl), a substituted or unsubstituted alkenyl group (e.g., allyl), a substituted or unsubstituted aralkyl group (e.g., benzyl, phenethyl, 4-methylphenylmethyl, 3-sulfophenylmethyl), a substituted or unsubstituted cycloalkyl group (e.g., cyclohexyl), a substituted or unsubstituted aryl group (e.g., phenyl, naphthyl, 3-sulfophenyl, 4-carboxyphenyl, 4-sulfophenyl, 3-sulfopropyloxyphenyl), a substituted or unsubstituted heterocyclic group (e.g., pyridyl, thienyl, pyrazolyl, imidazolyl), or a substituted or unsubstituted alkoxy group (e.g., methoxy, ethoxy, sulfoethoxy, carboxyethoxy, trimethylammonioethoxy). The above group for $R_{12}$, $R_{13}$, and $R_{14}$ may be further substituted by the substituents for $R_1$ in formula (I).

In formula (F), $R_{12}$, $R_{13}$, and $R_{14}$ each preferably represents a substituted or unsubstituted aryl group or a substituted or unsubstituted heterocyclic group, and more preferably an aryl or heterocyclic group substituted with a hydrophilic group, e.g., a sulfo group, a carboxyl group, a phosphono group, an ammonio group, etc. The total numbers of carbon atoms in each $R_{11}$, $R_{13}$ and $R_{14}$ are preferably 20 or less and more preferably 10 or less.

$$R_{15}—SM \qquad (G)$$

wherein $R_{15}$ represents a substituted or unsubstituted alkyl group (e.g., methyl, ethyl, sulfoethyl, carboxyethyl, hydroxyethyl, dimethylaminoethyl, aminoethyl, trimethylammonioethyl, phosphonoethyl), a substituted or unsubstituted alkenyl group (e.g., allyl, 2-methylallyl), a substituted or unsubstituted aralkyl group (e.g., benzyl, phenethyl, 3-sulfophenylmethyl, 4-carboxyphenylmethyl), a substituted or unsubstituted cycloalkyl group (e.g., cyclohexyl), a substituted or unsubstituted aryl group (e.g., phenyl, naphthyl, sulfophenyl, carboxyphenyl), or a substituted or unsubstituted heterocyclic group (e.g., tetrazole, triazole, imidazole, thiadiazole, oxadiazole, benzothiazole, benzimidazole, benzoxazole, tetraazaindene); and M is the same as defined for formula (E). The above group for $R_{15}$ may be further substituted by the substituents for $R_1$ in formula (I).

In formula (G), $R_{15}$ preferably represents a substituted or unsubstituted alkyl group or a substituted or unsubstituted aryl group. Particularly, it is preferred that in the molecule, a hydrophilic group such as a sulfo group, a carboxyl group, phosphono group and an ammonio group is contained. The total numbers of carbon atoms in $R_{15}$ are preferably 20 or less and more preferably 10 or less.

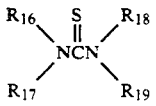

(H)

wherein $R_{16}$, $R_{17}$, $R_{18}$, and $R_{19}$ each represents a hydrogen atom, a substituted or unsubstituted alkyl group (e.g., methyl, ethyl, n-propyl, hydroxyethyl, carboxyethyl, carboxymethyl, sulfoethyl, aminoethyl, dimethylaminoethyl), a substituted or unsubstituted alkenyl group (e.g., allyl, 2-butenyl), a substituted or unsubstituted aralkyl group (e.g., benzyl, phenethyl, 3-sulfophenylmethyl, 4-carboxyphenylmethyl), a substituted or unsubstituted cycloalkyl group (e.g., cyclohexyl, 3-methylcyclohexyl), a substituted or unsubstituted aryl group (e.g., phenyl, 3-sulfophenyl, 4-sulfophenyl, 4-carboxyphenyl), or a substituted or unsubstituted heterocyclic group (e.g., pyridyl, thienyl, imidazolyl, furyl, morpholino); or $R_{16}$ and $R_{17}$, $R_{17}$ and $R_{18}$, $R_{18}$ and $R_{19}$, or $R_{19}$ and $R_{16}$ can combine and form a ring. The above group for $R_{16}$, $R_{17}$, $R_{18}$ and $R_{19}$ may be further substituted by the substituents for $R_1$ in formula (I).

In formula (H), $R_{16}$, $R_{17}$, $R_{18}$, and $R_{19}$ each preferably represents a hydrogen atom, a substituted or unsubstituted alkyl group, a substituted or unsubstituted alkenyl group, or a substituted or unsubstituted cycloalkyl group. Examples of substituents for an alkyl group, an alkenyl group and cycloalkyl group include a sulfonic acid or a salt thereof and a carboxylic acid or a salt thereof. The total numbers of carbon atoms in each $R_{16}$, $R_{17}$ and $R_{18}$ are preferably 20 or less and more preferably 10 or less.

Of the compounds represented by formulae (E) to (H), preferred compounds are those of formulae (E) and (F), and more preferably those of formula (E).

Specific but non-limiting examples of compounds represented by formulae (E) to (H) and Compound J-1, J-2 and J-3 which are included in component (II) are shown below.

E-1

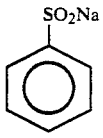

-continued

E-2

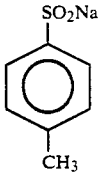

E-3

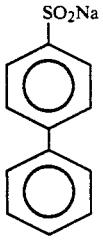

E-4

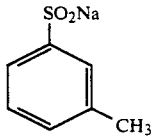

E-5

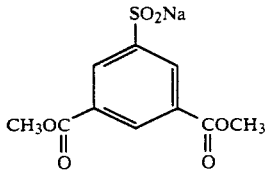

E-6

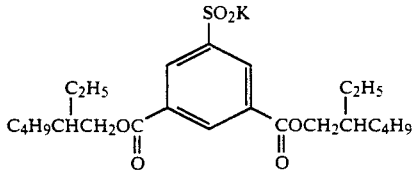

E-7

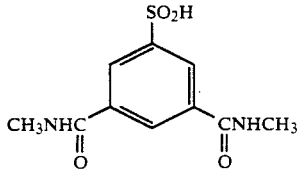

E-8

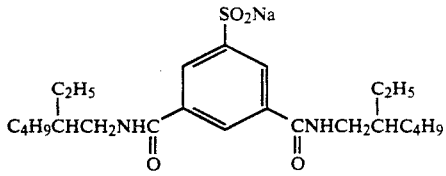

E-9

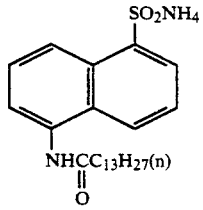

E-10

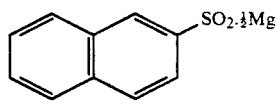

-continued
E-11
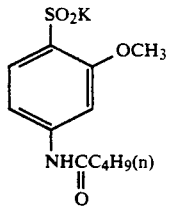
E-12
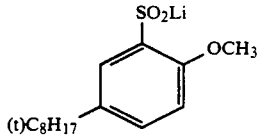
E-13
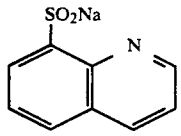
E-14
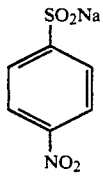
E-15
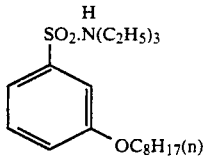
E-16
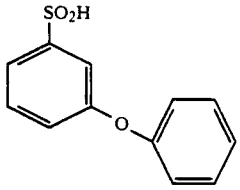
E-17
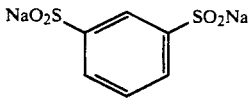
E-18
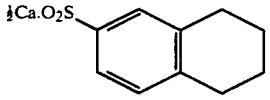
E-19
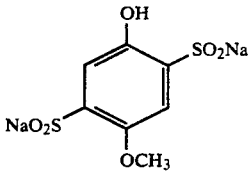
E-20
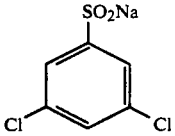
-continued
E-21
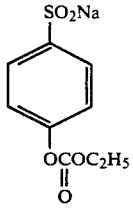
E-22
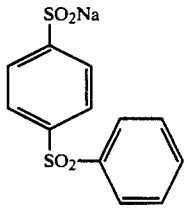
E-23
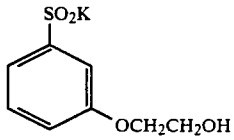
E-24
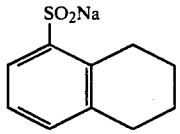
E-25
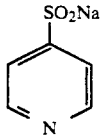
E-26
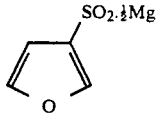
E-27
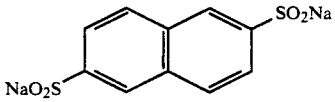
E-28
$(n)C_4H_9SO_2Na$
E-29
$C_4H_9CH(C_2H_5)SO_2K$
E-30
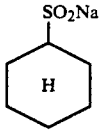
E-31
$CH_3OCH_2CH_2OCH_2CH_2SO_2NH_4$
E-32
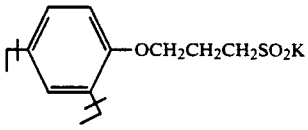

-continued
E-33
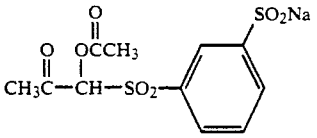
E-34
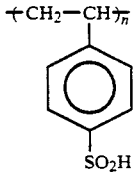
n: about 500
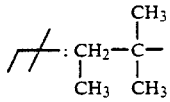
E-35
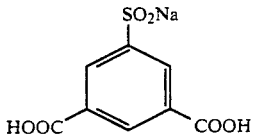
E-36
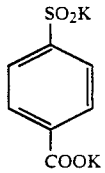
E-37
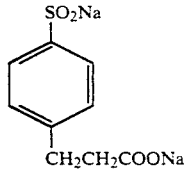
E-38
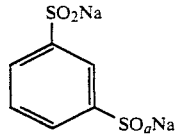
E-39
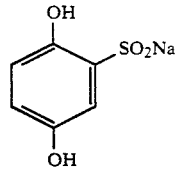
E-40
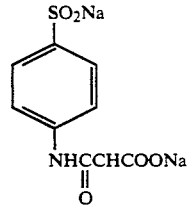
E-41
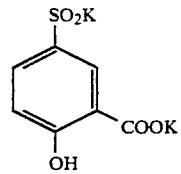
-continued
F-1
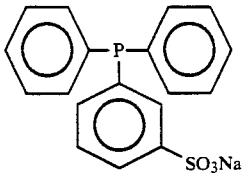
F-2
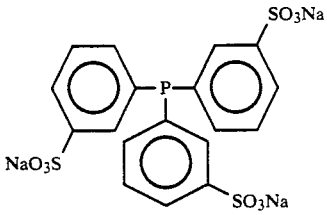
F-3
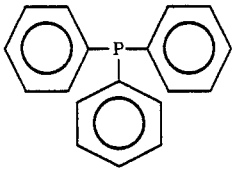
F-4
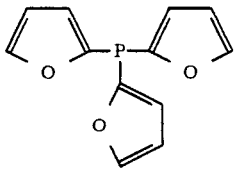
F-5
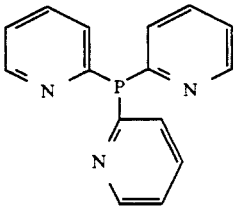
F-6 $(C_2H_5O)_3P$
F-7 $(C_2H_5)_3P$
F-8
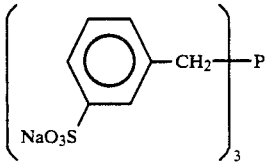
F-9
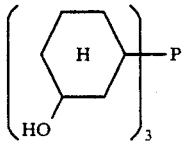
F-10 $(HOCH_2CH_2)_3P$
F-11 $(NaO_3SCH_2CH_2)_3P$ -continued
F-12
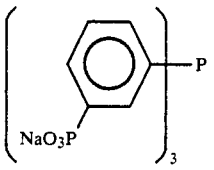
F-13
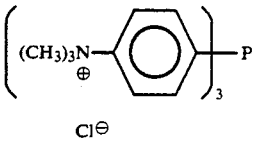
F-14
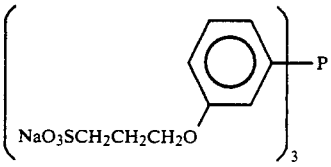
G-1 $HOCH_2CH_2SH$
G-2
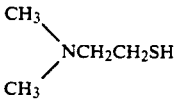
G-3 $H_2NCH_2CH_2SH$
G-4 $(n)C_{12}H_{25}SH$
G-5 $C_4H_9SH$
G-6 $NaO_3SCH_2CH_2SH$
G-7 $HOOCCH_2CH_2SH$
G-8 $HO_3PCH_2CH_2CH_2SH$
G-9
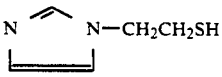
G-10
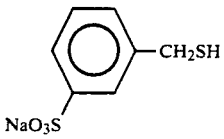
G-11
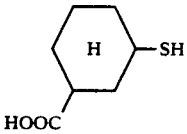
G-12
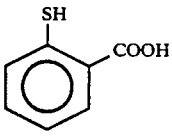
G-13
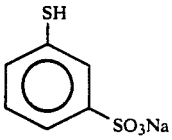
-continued
G-14
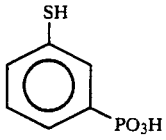
G-15
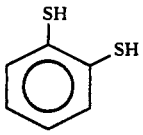
G-16
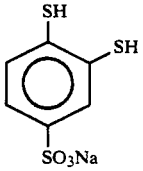
G-17
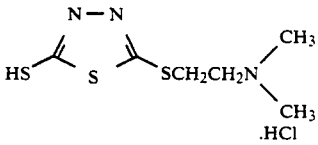
G-18
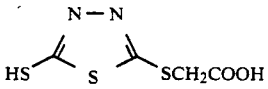
G-19
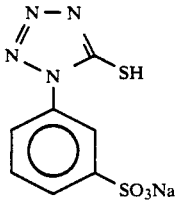
G-20
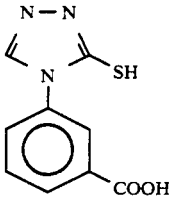
G-21
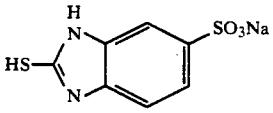
G-22
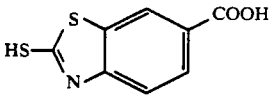
H-1
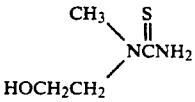
H-2
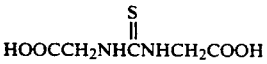

-continued

H-3 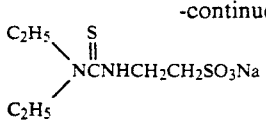

H-4 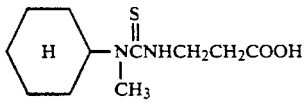

H-5 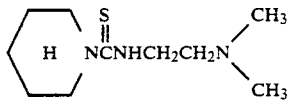

H-6 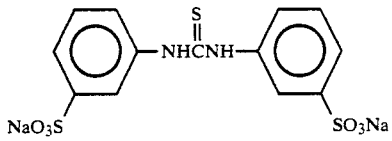

H-7 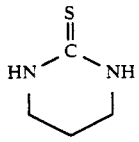

H-8 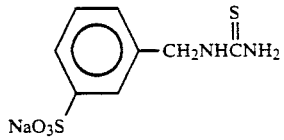

J-1 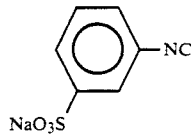

J-2 $C_2H_5NC$

J-3 $CH_3\overset{S}{\overset{\|}{C}}NHOH$

Many of the compounds represented by formulae (E) to (H) are commercially available. Other compounds of formulae (E) to (H) can be synthesized using known organic chemical reactions, for example, using the process described in S. R. Sandler and W. Carro, *Organic Functional Group Preparations,* Vol. 1, p. 586 & 619, ibid, Vol. 2, p. 152, ibid, Vol. 3, p. 179.

The amount of component (I) or (II) which can be added to a processing solution can vary but usually is from $1\times10^{-4}$ to 1 mol/l, and preferably from $1\times10^{-3}$ to 0.5 mol/l. Component (I) or (II) may be added directly to a running solution or may be added to a replenisher. It may also be supplied to a processing solution from a prebath. It is particularly preferable that it is be supplied to the start liquor and the replenisher.

Components (I) including compounds represented by formulae (A) to (D) and (II) including compounds represented by formulae (E) to (H) can be added to the processing solution having fixing ability. In this case, the compound capable of addition reaction with a bisulfite and/or the addition product thereof with a bisulfite as component (I) and the compound as component (II) may be added to the same processing solution or separate processing solutions. Each of these compounds may also be added to two or more processing solutions.

The processing solution having a fixing ability of the present invention includes a fixing bath for a black and white silver halide photographic material and a bleach-fixing bath or fixing bath for a silver halide color photographic material.

The present invention is effective for the bleach-fixing bath or fixing bath for the silver halide color photographic material, and is particularly effective for the bleach-fixing bath.

The processing solution having a fixing ability of the present invention is set forth below.

Examples of bleaching agents which can be used in a bleaching bath or a bleach-fixing bath (a processing solution having fixing ability) include a ferric complex salt of an aminopolycarboxylic acid and a peroxide (e.g., sodium persulfate). In the present invention, an iron (III) complex salt of aminopolycarboxylic acid is preferred as a bleaching agent which is used in the bleach-fixing bath of the present invention. Among these, a ferric complex salt of an aminopolycarboxylic acid represented by formula (III) shown below is particularly preferred.

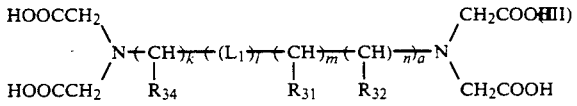

wherein $L_1$ represents an oxygen atom, a sulfur atom or an alkylene group; $R_{31}$, $R_{32}$, and $R_{34}$ each represents a hydrogen atom or an alkyl group; or $R_{31}$ and $R_{32}$ can combine together to form a cycloalkylene ring; k, l, m, and n each represents 0 or an integer of from 1 to 4; and a represents an integer of from 1 to 3, provided that the sum of k, l, m, and n is at least 2.

In formula (III), $L_1$ preferably represents an oxygen atom, a sulfur atom, or an alkylene group having 6 or less carbon atoms. The alkylene group preferably includes a methylene group, an ethylene group, a propylene group, and a butylene group. $R_{31}$, $R_{32}$, $R_{33}$, and $R_{34}$ each preferably represents a hydrogen atom or an alkyl group having 6 or less carbon atoms. The alkyl group preferably includes a methyl group, an ethyl group, an n-propyl group, and an isopropyl group.

Specific but non-limiting examples of the aminopolycarboxylic acids represented by formula (III) are shown below.

III-1: 1,3-Diaminopropanetetraacetic acid
III-2: Glycol ether diaminetetraacetic acid
III-3: Cyclohexanediaminetetraacetic acid
III-4: 1,4-diaminobutanetetraacetic acid
III-5: 1,2-propylenediaminetetraacetic acid
III-6: Thioglycol ether diaminetetraacetic acid
III-7: 1,3-Butylenediaminetetraacetic acid
III-8: Ethylenediaminetetraacetic acid The bleaching agent can be used in an amount of from 0.05 to 1 mol, and preferably from 0.1 to 0.5 mol, per liter of the bleaching bath or the bleach-fixing bath. The iron (III) complex salt of above-described aminopolycarboxylic acid (i.e., III-1 to III-8) may be used in combination with an (ethylenediaminetetraacetato)iron (III) complex salt. In this case, a mixing ratio of the aminopolycarboxylic acid iron (III) complex salt and the (ethylenediaminetetraacetato)iron (III) complex salt in the processing solution is preferably from 1/10 to 10/1, with the total amount being from 0.05 to 1 mol/l, and preferably from 0.1 to 0.5 mol/l.

The bleaching bath and/or bleach-fixing bath may further contain an aminopolycarboxylic acid or a salt thereof in addition to the above-described aminopolycarboxylic acid iron (III) complex in an amount preferably ranging from 0.0001 to 0.1 mol/l, and more preferably from 0.003 to 0.05 mol/l.

The aminopolycarboxylic acid and its ferric complex are usually added in the form of an alkali metal salt or ammonium salt thereof. An ammonium salt is particularly preferred in view of its excellent solubility and bleaching power.

The bleaching bath and/or bleach-fixing bath containing the ferric complex salt may further contain a metal ion complex other than the ferric ion complex salt such as a salt of cobalt, copper, etc.

Thiosulfates which can be used in the processing solution having a fixing ability include ammonium thiosulfate, sodium thiosulfate, potassium thiosulfate, calcium thiosulfate, and magnesium thiosulfate, with ammonium thiosulfate being preferred in view of its satisfactory solubility and the highest fixing rate attained. The thiosulfate is used in an amount of from 0.1 to 3 mol/l, and preferably from 0.3 to 2 mol/l.

In addition to the above-described thiosulfate, the bleach-fixing bath and/or fixing bath may contain a thiocyanate (ammonium thiocyanate), thioureas, thioethers, and ureas as a fixing agent or a fixing accelerator. The total amount of such an auxiliary fixing agent or fixing accelerator and the thiosulfate ranges generally from 1.11 to 3.0 mol/l, and preferably from 1.4 to 2.8 mol/l.

The bleaching bath and/or bleach-fixing bath may further contain a bleaching accelerator. Useful bleaching accelerators include compounds having a mercapto group or a disulfide group as described in U.S. Pat. No. 3,893,858, German Patent 1,290,812, British Patent 1,138,842, JP-A-53-95630, and *Research Disclosure,* No. 17129 (Jul., 1978); thiazolidine derivatives as described in JP-A-50-140129; thiourea derivatives as described in U.S. Pat. No. 3,706,561; iodides as described in JP-A-58-16235; polyethylene oxides as described in German Patent 2,748,430; and polyamine compounds as described in JP-B-45-8836. Of these compounds, mercapto compounds as described in British Patent 1,138,842 are particularly preferred.

The bleaching accelerator is employed in an amount of generally from 0.01 to 20 g/l, and preferably from 0.1 to 10 g/l.

The bleaching bath and/or bleach-fixing bath may also contain a re-halogenating agent, such as bromides (e.g., potassium bromide, sodium bromide, and ammonium bromide), and chlorides (e.g., potassium chloride, sodium chloride, and ammonium chloride). The re-halogenating agent can be employed in an amount of generally from 0.1 to 5.mol/l, and preferably from 0.5 to 3 mol/l in the bleaching bath and/or bleach-fixing bath.

If desired, the bleaching bath and/or bleach-fixing bath may contain other additives generally employed in a bleaching solution, such as one or more of inorganic or organic acids or salts thereof having a pH buffer action, e.g., nitrates (e.g., sodium nitrate, ammonium nitrate), boric acid, borax, sodium metaborate, acetic acid, sodium acetate, sodium carbonate, potassium carbonate, phosphorous acid, phosphoric acid, sodium phosphate, citric acid, sodium citrate, and tartaric acid.

The bleach-fixing bath and/or fixing bath may also contain a preservative, such as sulfites (e.g., sodium sulfite, potassium sulfite, ammonium sulfite), hydroxylamines, and hydrazines; a fluorescent brightening agent, a defoaming agent, a surface active agent, and an organic solvent (e.g., polyvinylpyrrolidone, methanol). Sulfinic acid compounds disclosed in JP-A-62-143048 are particularly preferred as preservatives.

Various aminopolycarboxylic acids or organic phosphonic acids are preferably used for the purpose of stabilizing the processing solutions. In particular, 1-hydroxyethylidene-1,1-diphosphonic acid is effective. These stabilizers can be employed in an amount of from 0.01 to 0.3 mol/l, and preferably from 0.05 to 0.2 mol/l. Use of the stabilizer is particularly effective in a fixing bath.

The bleaching bath and/or bleach-fixing bath usually has a pH of from 1 to 9, preferably from 1.5 to 7.5, and more preferably from 2.0 to 7.0. In particular, the bleaching bath preferably has a pH of from 2.0 to 5.0. Within the preferred pH range, bleaching fog is inhibited, and excellent desilvering performance can be achieved.

The fixing bath usually has a pH of from 5.0 to 9.0, and preferably from 5.5 to 7.5.

The bleaching bath and/or bleach-fixing bath is replenished at a rate of from 50 to 3,000 ml, and preferably from 100 to 1,000 ml, per $m^2$ of the light-sensitive material.

The fixing bath is preferably replenished at a rate of from 300 to 3,000 ml, and more preferably from 300 to 1,000 ml, per $m^2$ of the light-sensitive material.

The above-described rate of replenishment may be decreased by subjecting the processing solution to a regeneration treatment, such as oxidative regeneration and silver recovery, if desired.

The color developing solution which can be used in the present invention contains a known aromatic primary color developing agent. The color developing agent preferably is a p-phenylenediamine derivative. Typical but non-limiting examples of suitable p-phenylenediamine developing agents are shown below.

CDA-1: N,N-Diethyl-p-phenylenediamine
CDA-2: 2-Amino-5-diethylaminotoluene
CDA-3: 2-Amino-5-(N-ethyl-N-laurylamino)toluene
CDA-4: 4-[N-Ethyl-N-(β-hydroxyethyl)amino]aniline
CDA-5: 2-Methyl-4-[N-ethyl-N-(β-hydroxyethylamino)]aniline
CDA-6: 4-Amino-3-methyl-N-ethyl-N-[β-(methanesulfonamido)ethyl]aniline
CDA-7: N-(2-Amino-5-diethylaminophenylethyl)methanesulfonamide
CDA- 8: N,N-Dimethyl-p-phenylenediamine
CDA-9: 4-Amino-3-methyl-N-ethyl-N-methoxyethylaniline
CDA-10: 4-Amino-3-methyl-N-ethyl-N-β-ethoxyethylaniline
CDA-11: 4-Amino-3-methyl-N-ethyl-N-β-butoxyethylaniline Particularly preferred of these p-phenylenediamine derivatives, are (CDA-2), (CDA-4), (CDA-5), and (CDA-6).

These p-phenylenediamine derivatives may be also in the form of a salt, such as a sulfate, a hydrochloride, a sulfite, and a p-toluenesulfonate. The aromatic primary amine developing agent is preferably used in an amount of from about 0.1 g to about 20 g, and more preferably from about 0.5 g to about 10 g, per liter of the developing solution.

If desired, the color developing solution can contain a preservative, such as a sulfite (e.g., sodium sulfite, potassium sulfite, sodium bisulfite, potassium bisulfite, sodium metasulfite, potassium metasulfite) and the carbonyl-sulfite addition product of the present invention. These preservatives can be employed in an amount of generally from 0.5 to 10 g/l, and preferably from 1 to 5 g/l.

The color developing solution preferably contains a compound which directly preserves the above-described color developing agent. Examples of such a compound include various hydroxylamine compounds, hydroxamic acids described in JP-A-63-43138, hydrazines described in European Patent 254280A, phenols described in JP-A-63-44657 and JP-A-63-58443, α-hydroxyketones and α-aminoketones described in JP-A-63-44656, and various saccharides described in JP-A-63-36244. These compounds can be advantageously used in combination with monoamines described in Japanese Patent Application No. 61-164515 and JP-A-63-4235, JP-A-63-24254, JP-A-63-21647, JP-A-63-27841 and JP-A-63-27841, diamines described in Japanese Patent Application No. 61-164515, and JP-A-63-30845 and JP-A-63-43139, polyamines described in JP-A-63-21647, JP-A-63-26655 and JP-A-63-44655, nitroxyl radicals described in JP-A-63-53551, alcohols described in JP-A-63-43140 and JP-A-63-56654, oximes described in JP-A-63-56654, and tertiary amines described in Japanese Patent Application No. 61-265149.

If desired, the developing solution may further contain, as a preservative, various metals described in JP-A-57-44148 and JP-A-57-53749, salicylic acid derivatives described in JP-A-59-180588, alkanolamines described in JP-A-54-3532, polyethyleneimines described in JP-A-56-94349, aromatic polyhydroxyl compounds described in U.S. Pat. No. 3,746,544, etc. In particular, use of an aromatic polyhydroxyl compound is preferred.

The color developing solution preferably has a pH of generally from 9 to 12, and more preferably from 9 to 11.0.

In addition to the above-described components, the color developing solution can contain various additives known as developing solution components.

For example, various buffering agents are preferably used for maintaining the above-recited pH range. Specific but non-limiting examples of these buffering agents are sodium carbonate, potassium carbonate, sodium bicarbonate, .potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent can be preferably employed in the color developing solution in an amount of 0.1 mol/l or more, and more preferably from 0.1 to 0.4 mol/l.

Various chelating agents can be used in the color developing solution to prevent precipitation of calcium or magnesium or to improve the stability of the developing solution. Preferred chelating agents include organic acid compounds, such as aminopolycarboxylic acids, organic phosphonic acids, and phosphonocarboxylic acids. Specific but non-limiting examples of suitable chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid,trans-cyclohexanediaminetetraacetic acid, 1,2-diaminopropanetetraacetic acid, hydroxyethyliminodiacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid. These chelating agents may be used either individually or as a combination of two or more thereof.

The chelating agent is employed in an amount sufficient for blocking metallic ions in a color developing solution, usually in an amount of from about 0.1 g to about 10 g per liter of the color developing solution.

If desired, a developing accelerator may be used in the color developing solution. However, it is preferable in view of the prevention of environmental pollution and color stain and the preparation of the solution that the color developing solution to be used in the present invention contains substantially no benzyl alcohol. The terminology "substantially no benzyl alcohol" as used herein means that the amount of benzyl alcohol is not more than 2 ml/l, and preferably is zero.

Examples of suitable developing accelerators include thioether compounds as described in JP-B-37-16088, JP-B-37-5987, JP-B-38-7826, JP-B-44-12380, JP-B-45-9019, and U.S. Pat. No. 3,813,247; p-phenylenediamine compounds as described in JP-A-52-49829 and JP-A-50-15554; quaternary ammonium salts as described in JP-A-50-137726, JP-B-44-30074, JP-A-56-156826, and JP-A-52-43429; amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides as described in JP-B-37-16088, JP-B-42-25201, U.S. Pat. No. 3,128,183, JP-B-41-11431, JP-B-42-23883, and U.S. Pat. No. 3,532,501; 1-phenyl-3-pyrazolidones; and imidazoles.

If desired, an antifoggant may also be employed in the color developing solution. Examples of suitable antifoggants include alkali metal halides, e.g., sodium chloride, potassium bromide and potassium iodide; and organic antifoggants. Typical examples of organic antifoggants are nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution may contain a fluorescent brightening agent. Examples of suitable fluorescent brightening agents include 4,4'-diamino-2,2'-disulfostilbene compounds. The fluorescent brightening agent is used in an amount of generally up to 5 g/l, and preferably from 0.1 to 4 g/l.

If desired, various surface active agents, such as alkylsulfonic acids, arylsulfonic acids, aliphatic carboxylic acids, and aromatic carboxylic acids, may also be employed in the color developing solution.

Development processing with the above-described color developing solution is carried out at a processing temperature usually ranging from 20° to 50° C., and preferably from 30° to 40° C., for a processing time of generally from 20 seconds to 5 minutes, and preferably from 30 seconds to 2 minute. The rate of replenishment is preferably as small as possible and suitably ranges from 100 to 1,500 ml/m$^2$, preferably from 100 to 800 ml/m$^2$, and more preferably from 100 to 400 ml/m$^2$.

If desired, the color developing bath may be separated into two or more baths, and the first or final bath is replenished with a replenisher to thereby reduce the developing time or the rate of replenishment.

The method of processing according to the present invention is applicable to color reversal processing. The black-and-white developing solution which can be used in color reversal development is a black-and-white first developing solution which is used in reversal processing of color light-sensitive materials or a developing solution which is used for processing of black-and-white light-sensitive materials. The black-and-white developing solution generally contains various additives commonly employed in the art. Typical additives include developing agents, e.g., 1-phenyl-3-pyrazolidone, metol, and hydroquinone; preservatives, e.g., sulfites; alkali agents, e.g., sodium hydroxide, sodium carbonate, and potassium carbonate; organic or inorganic inhibitors, e.g., potassium bromide, 2-methylbenzimidazole, and methylbenzothiazole; water softeners, e.g., polyphosphates; and development inhibitors, e.g., a trace amount of an iodide, and a mercapto compound.

An exposed color light-sensitive material is subjected to color development, desilvering, and washing.

Desilvering comprises a bleaching step using a bleaching bath and a fixing step using a fixing bath or bleach-fixing (blixing) step using a bleach-fixing bath. These steps may be used in various orders to complete desilvering as follows.

1) Bleaching/fixing
2) Bleaching/bleach-fixing
3) Bleaching/bleach-fixing/fixing
4) Bleaching/washing/fixing
5) Bleaching/fixing/fixing
6) Bleach-fixing
7) Bleach-fixing/bleach-fixing The color developed light-sensitive material may be directly subjected to bleaching or bleach-fixing without any intermediate step. Alternatively, the color developed light-sensitive material may be subjected to an intermediate step, such as stopping, compensation development, and washing, prior to bleaching or bleach-fixing for the purpose of preventing unnecessary post development and aerial fog and reducing the carry-over of a color developing solution into the desilvering step or for the purpose of washing out components of the light-sensitive material, e.g., sensitizing dyes and dyes, and color developing agent impregnated in a light-sensitive material to eliminate the adverse influences of these components.

If desired, washing may be followed by stabilizing, or washing may be replaced by stabilizing. These steps may be combined with prehardening, neutralizing, stop-fixing, and the like. Washing or rinsing may be conducted between these steps, if desired.

Replenishment in desilvering is usually carried out by supplying a replenisher to a processing solution, while discarding the overflow as a waste liquid. Replenishment may be effected by a cocurrent system in which an overflow of a prebath is introduced into a succeeding bath, or a countercurrent system in which an overflow of a succeeding bath is introduced into a prebath. For example, the overflow from a washing or stabilizing bath can be returned to a fixing bath or a bleach-fixing bath.

The effects of the present invention are achieved to a more much greater extent as the total time of desilvering is decreased. The preferred total time for desilvering is generally from 1 to 10 minutes, and more preferably from 1 to 6 minutes. The processing temperature of desilvering is generally from 25° to 50° C., and preferably from 35° to 45° C. Within the preferred temperature range, the rate of desilvering increases, and stain formation after processing can be effectively prevented.

It is desirable that desilvering should be performed under good stirring. Methods for achieving good stirring include a method in which a stream of a processing solution is jetted against the surface of the emulsion layer as described in JP-A-62-183460, JP-A-62-183461, and U.S. Pat. No. 4,758,858; a method of using a rotating means to enhance the stirring effects as described in JP-A-62-183461; a method in which a light-sensitive material is moved with its emulsion surface in contact with a wire blade placed in a processing solution to create a turbulence; and a method of increasing a total flow of circulating processing solution. These stirring means are effective in any of a bleaching bath, a bleach-fixing bath and a fixing bath. Enhanced stirring appears to accelerate the supply of the bleaching agent or the fixing agent into the emulsion layers and, as a result, to increase the rate of desilvering.

The above-described means for improved stirring is more effective where a bleaching accelerator is used, markedly enhancing the acceleration effects and eliminating the inhibitory effect on fixing of the bleaching accelerator.

An automatic developing machine which can be used in the present invention preferably has a means for conveying a light-sensitive material as described in JP-A-60-191257, JP-A-60-191258, JP-A-60-191259, *Research Disclosure,* No. 29118 (Jul., 1988), and U.S. Pat. No. 4,758,858. As mentioned in JP-A-60-191257 supra, such a conveying means is effective to considerably reduce carry-over of a processing solution from a prior bath into a succeeding bath thereby to prevent a reduction of processing capacity. The means described in *Research Disclosure,* No. 29118 is also preferred. These means are particularly effective to achieve a reduction in the processing time or replenishment rate in each processing step.

The above-described means for enhanced stirring is effective not only in desilvering but also in washing and development to reduce the processing time and the rate of replenishment.

While bleach-fixing or fixing is generally followed by washing and stabilizing, a simplified method may be used, in which the processing in a processing solution having fixing ability is followed directly by stabilizing without any substantial amount of washing being conducted.

Water to be used for washing may contain various known additives if desired. Suitable additives include hard water softeners, e.g., inorganic phosphonic acids, aminopolycarboxylic acids, and organic phosphonic acids; bactericides or antifungal agents for preventing growth of various bacteria or algae (e.g., isothiazolone, chlorinated organic compounds, benzotriazoles), and surface active agents for reducing the drying load and drying unevenness. The compounds described in L. E. West, *Water Quality Criteria,* Photo. Sci. and Eng., Vol. 9, No. 6, pp. 344–359 (1965) are also useful.

A stabilizing bath used for stabilizing is a processing solution for stabilizing a dye image, including a solution providing buffering at a pH of 3 to 6, and a solution containing an aldehyde (e.g., glutaraldehyde). Formaldehyde is disadvantageous from the standpoint of environmental pollution. If desired, the stabilizing bath may contain an ammonium compound, a metallic compound (e.g., Bi compounds, Al compounds), a fluorescent brightening agent, a chelating agent (e.g., EDTA, 1-hydroxyethylidene-1,1-diphosphonic acid), a bactericide, an antifungal agent, a hardening agent, and a surface active agent.

Examples of effective antifungal agents include thiazolone compounds, e.g., 5-chloro-2-methylisothiazolin-3-one and 1,2-benzisothiazolin-3-one.

Preferred surface active agents are silicone compounds represented by the formula shown below because of their effects in preventing water spots and defoaming effects.

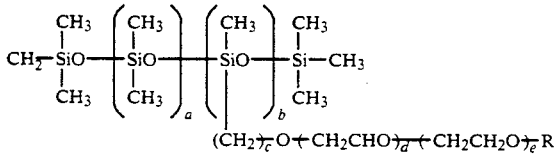

wherein a, b, d, and e each represents an integer of from 5 to 30; c represents an integer of from 2 to 5; and R represents an alkyl group having from 3 to 6 carbon atoms. alkanolamine for preventing sulfuration of thiosulfate ion which has been brought in with the light-sensitive material. The details of use of alkanolamines are described in U.S. Pat. No. 4,786,583.

Use of formaldehyde which is generally added to a stabilizing bath is not preferred in the present invention.

The stabilizing bath has a pH of generally from 3 to 8, and preferably from 5 to 7, and the temperature is generally from 5° to 45° C., and preferably from 10° to 40° C.

Washing and/or stabilizing is preferably carried out in a multi-stage countercurrent system using 2 to 4 stages. Two or more stabilizing baths may be used in multiple stages. The amount of a replenisher is generally from 1 to 50 times, preferably from 2 to 30 times, and more preferably from 2 to 15 times, the carry-over per unit area from a prior bath.

The effects of the present invention are accomplished to a greater extent with decreased time of washing or stabilizing. From the standpoint of rapid processing, the total time required for washing and stabilizing is preferably from 10 to 50 seconds, and particularly preferably from 10 to 30 seconds.

The smaller is the rate of replenishment in washing or stabilizing, the greater the effects of the present invention. A preferred rate of replenishment ranges from 50 to 400 ml, and particularly from 50 to 200 ml, per $m^2$ of the light-sensitive material.

Water which can be used in washing or stabilizing includes tap water, deionized water having Ca and Mg concentrations each reduced to 5 mg/l or less by treatment with an ion-exchange resin, etc., and water sterilized by a ultraviolet germicidal lamp.

Where each of the above-described processing steps is conducted in a continuous manner using an automatic developing machine, the processing solution tends to become concentrated due to evaporation, which is particularly conspicuous when a small amount of light-sensitive material is processed or when the processing tank has a wide open area. Such being the case, it is desirable to supply an adequate amount of water or a replenisher to make up for the loss due to vaporization.

It is possible to reduce the amount of waste liquid by recycling the overflow from the washing or stabilizing bath to a preceding bath having a fixing ability.

The color light-sensitive material generally contains yellow couplers, magenta couplers, and cyan couplers which develop a yellow, magenta, and cyan color, respectively, on coupling with an oxidation product of an aromatic amine color developing agent.

Cyan couplers, magenta couplers, and yellow couplers which can be advantageously used in the present invention are those represented by formula (C-I), (C-II), (M-I), (M-II), and (Y) shown below, respectively.

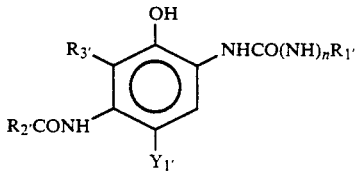

(C-I)

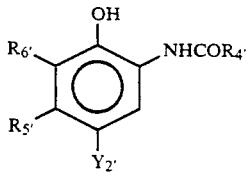

(C-II)

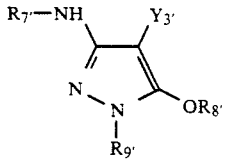

(M-I)

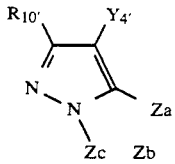

(M-II)

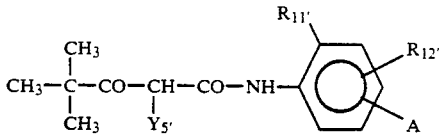

(Y)

In formulae (C-I) and (C-II), $R_{1'}$, $R_{2'}$, and $R_{4'}$ each represents a substituted or unsubstituted aliphatic, aromatic or heterocyclic group; $R_{3'}$, $R_{5'}$, and $R_{6'}$ each represents a hydrogen atom, a halogen atom, an aliphatic group, an aromatic group or an acylamino group; or $R_{3'}$ represents a non-metal atomic group forming a 5- or 6-membered nitrogen-containing ring together with $R_{2'}$; $Y_{1'}$ and $Y_{2'}$ each represents a hydrogen atom or a group releasable on coupling with the oxidation product of a developing agent; and n represents 0 or 1.

$R_{5'}$ in formula (C-II) preferably represents an aliphatic group, e.g., methyl, ethyl, propyl, butyl, pentadecyl, t-butyl, cyclohexyl, cyclohexylmethyl, phenylthiomethyl, dodecyl, oxyphenylthiomethyl, butaneamidomethyl, and methoxymethyl groups.

Of the cyan couplers represented by formula (C-I) or (C-II), the following compounds are preferred.

In formula (C-I), $R_{1'}$ preferably represents an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. When $R_{3'}$ and $R_{2'}$ do not form a ring, $R_{2'}$ preferably represents a substituted or unsubstituted alkyl or aryl group, and more preferably an alkyl group substituted with a substituted aryloxy group, and $R_{3'}$ preferably represents a hydrogen atom.

In formula (C-II), $R_{4'}$ preferably represents a substituted or unsubstituted alkyl or aryl group, and more preferably an alkyl group substituted with a substituted aryloxy group. $R_{5'}$ preferably represents an alkyl group having from 2 to 15 carbon atoms or a methyl group with a substituent containing at least one carbon atom. Suitable substituents for the methyl group preferably include an arylthio group, an alkylthio group, an acylamino group, an aryloxy group, and an alkyloxy group. $R_{5'}$ more preferably represents an alkyl group having from 2 to 15 carbon atoms and particularly, from 2 to 4 carbon atoms. $R_{6'}$ preferably represents a hydrogen atom or a halogen atom, and more preferably a chlorine atom or a fluorine atom.

In formulae (C-I) and (C-II), $Y_{1'}$ and $Y_{2'}$ each preferably represents a hydrogen atom, a halogen atom, an alkoxy group, an aryloxy group, an acyloxy group, or a sulfonamide group.

In formula (M-I), $R_{7'}$ and $R_{9'}$ each represents a substituted or unsubstituted aryl group; $R_{8'}$ represents a hydrogen atom, an aliphatic or aromatic acyl group, or an aliphatic or aromatic sulfonyl group; and $Y_{3'}$ represents a hydrogen atom or a releasing group.

In formula (M-I), the substituents for the aryl group (preferably a phenyl group) as represented by $R_{7'}$ or $R_{9'}$ are the same as for $R_{1'}$. When two or more substituents are present, they may be the same or different. $R_{8'}$ preferably represents a hydrogen atom, an aliphatic acyl group, or an aliphatic sulfonyl group, and more preferably a hydrogen atom. $Y_{c'}$ preferably represents a group releasable at any of sulfur, oxygen and nitrogen atoms. For example, sulfur-releasing groups as described in U.S. Pat. No. 4,351,897 and International Publication WO 88/04795 are particularly preferred.

In formula (M-II), $R_{10'}$ represents a hydrogen atom or a substituent; $Y_{4'}$ represents a hydrogen atom or a releasable group, and preferably a halogen atom or an arylthio group; $Z_a$, $Z_b$, and $Z_c$ each represents a methine group, a substituted methine group, =N—, or —NH—; either one of $Z_a$–$Z_b$ and $Z_b$–$Z_c$ is a double bond, with the other is a single bond; when the $Z_b$–$Z_c$ bond is a carbon-carbon double bond, it may be a part of an aromatic ring; and formula (M-II) may form a polymer including a dimer formed at any of $R_{10'}$, $Y_{4'}$, or a substituted methine group represented by $Z_a$, $Z_b$ or $Z_c$.

Imidazo[1,2-b]pyrazoles described in U.S. Pat. No. 4,500,630 are preferred of the pyrazoloazole couplers of formula (M-II), in view of the reduced yellow side absorption and fastness to light. Pyrazolo[1,5-b][1,2,4]triazoles described in U.S. Pat. No. 4,540,654 are particularly preferred.

Additional examples of suitable pyrazoloazole couplers include pyrazolotriazole couplers having a branched alkyl group at the 2-, 3- or 6-position of the pyrazolotriazole ring as described in JP-A-61-65245; pyrazoloazole couplers containing a sulfonamide group in the molecule thereof as described in JP-A-61-65246; pyrazoloazole couplers having an alkoxyphenylsulfonamido ballast group as described in JP-A-61-147254; and pyrazolotriazole couplers having an alkoxy group or an aryloxy group at the 6-position as described in European Patent Publication Nos. 226,849 and 294,785.

In formula (Y), $R_{11'}$ represents a halogen atom, an alkoxy group, a trifluoromethyl group, or an aryl group; $R_{12'}$ represents a hydrogen atom, a halogen atom, or an alkoxy group; A represents $—NHCOR_{13'}$, $—NHSO_2—R_{13'}$, $—SO_2NHR_{13'}$, $—COOR_{13}$, or $$—SO_2N(R_{13'})(R_{14'})$$

(wherein $R_{13'}$ and $R_{14'}$ each represents an alkyl group, an aryl group, or an acyl group); and $Y_{5'}$ represents a releasing group. The substituents for $R_{12'}$, $R_{13'}$, or $R_{14'}$ are the same as for $R_{1'}$. The releasing group, $Y_{5'}$ is preferably a group releasable at an oxygen atom or a nitrogen atom, and more preferably a nitrogen-atom releasing group.

Specific examples of couplers represented by formulae (C-I), (C-II), (M-I), (M-II), and (Y) which can be used are shown below.

(C-1)

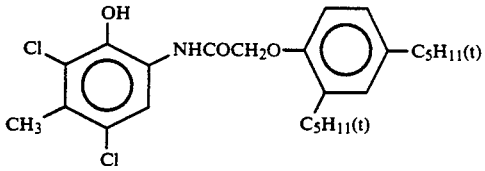

(C-2)

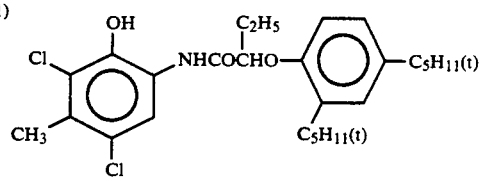

(C-3)

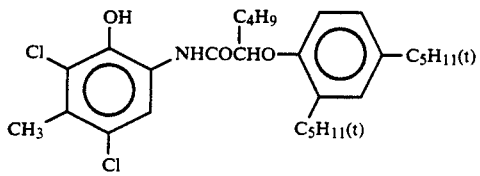

(C-4)

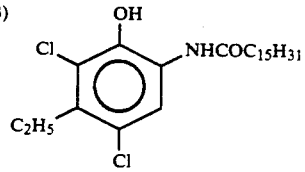

-continued
(C-5)
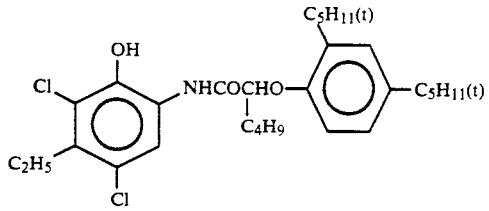
(C-6)
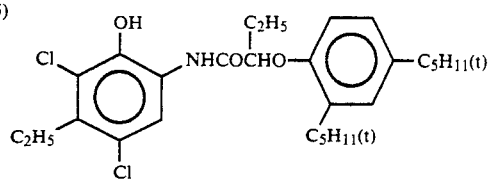
(C-7)
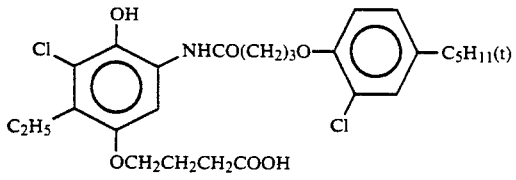
(C-8)
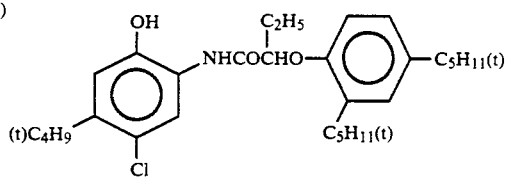
(C-9)
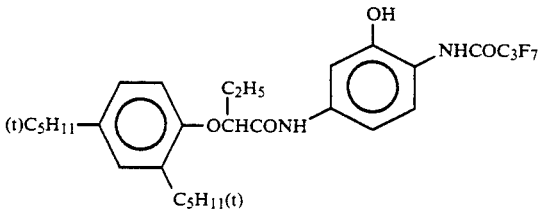
(C-10)
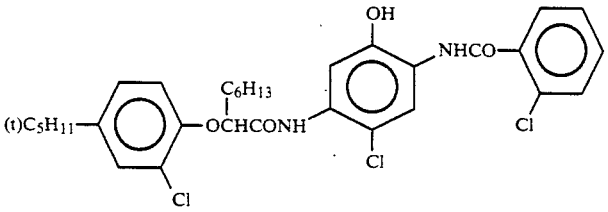
(C-11)
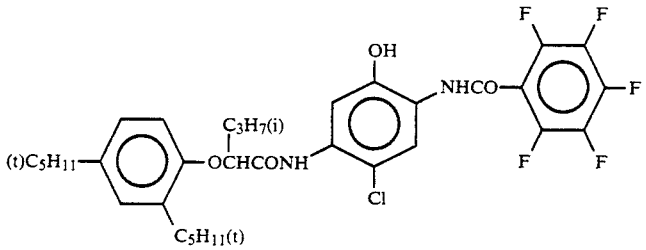
(C-12)
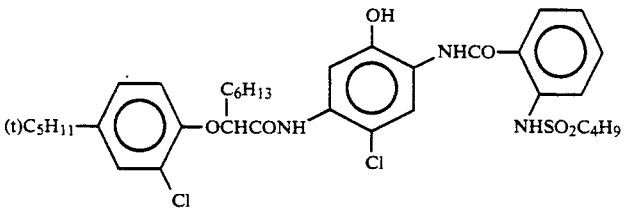
(C-13)
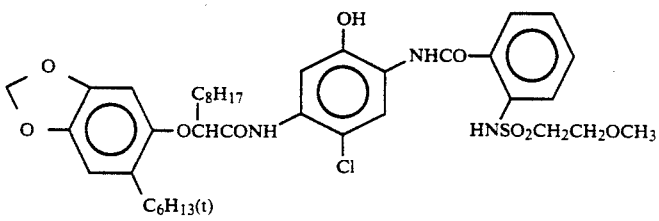

-continued
(C-14)
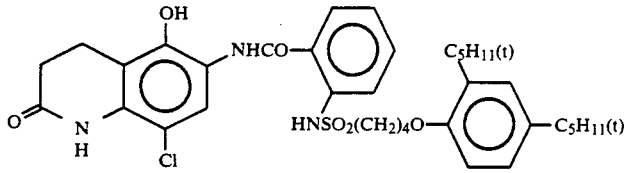
(C-15)
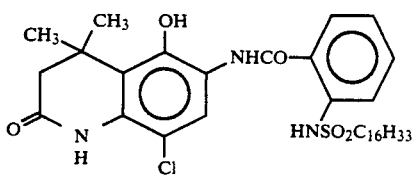
(C-16)
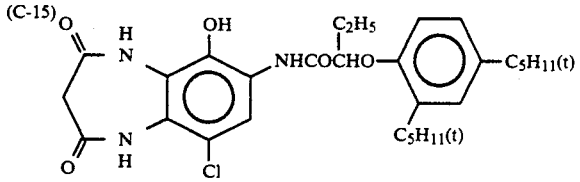
(C-17)
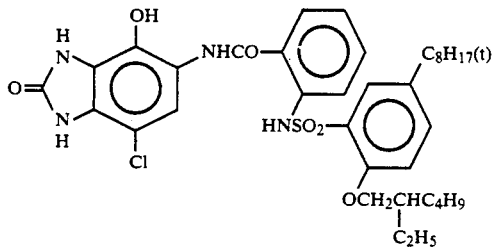
(C-18)
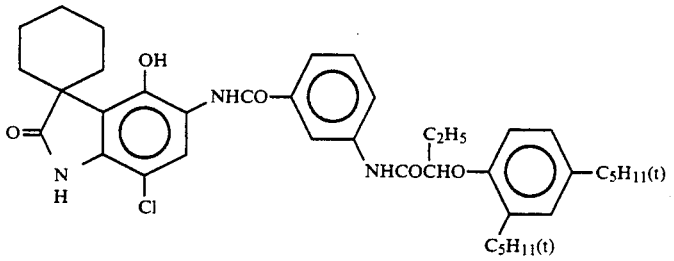
(C-19)
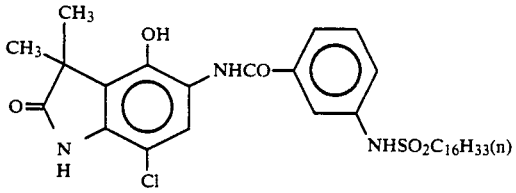
(C-20)
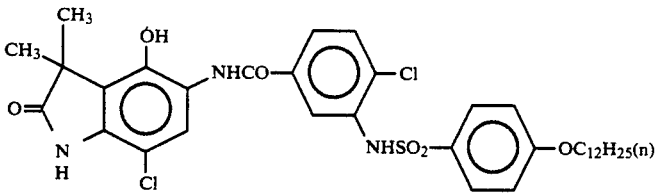
(C-21)
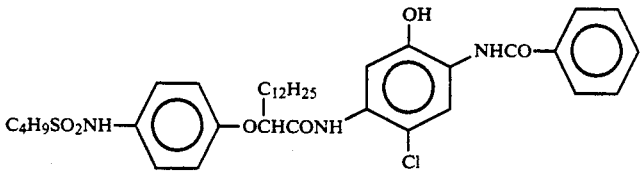

-continued
(C-22)
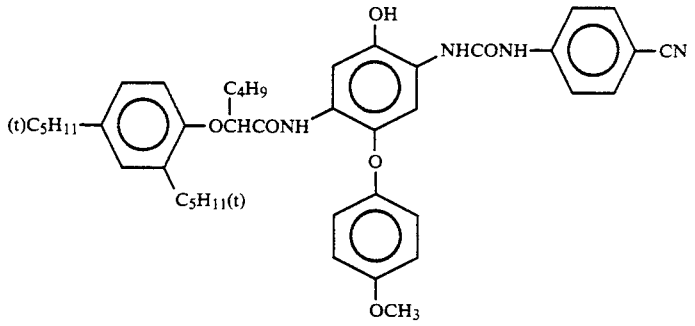
(M-1)
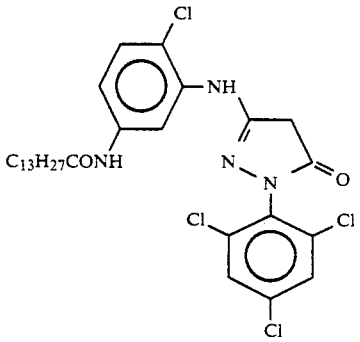
(M-2)
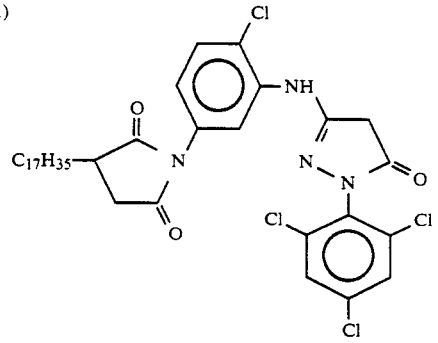
(M-3)
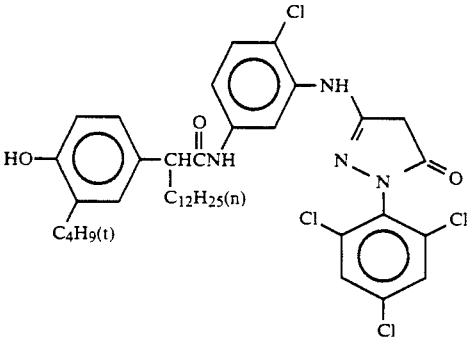
(M-4)
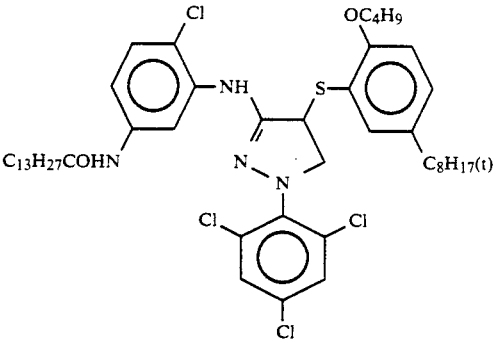
(M-5)
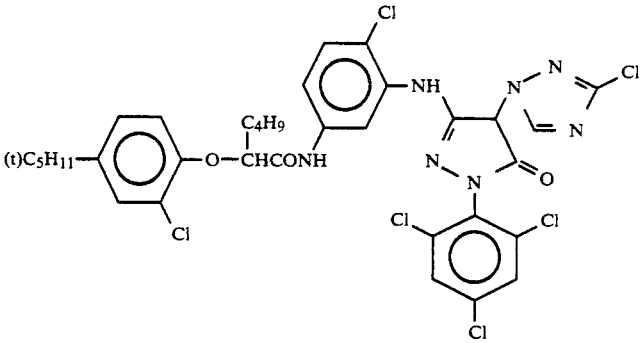

-continued
(M-6)
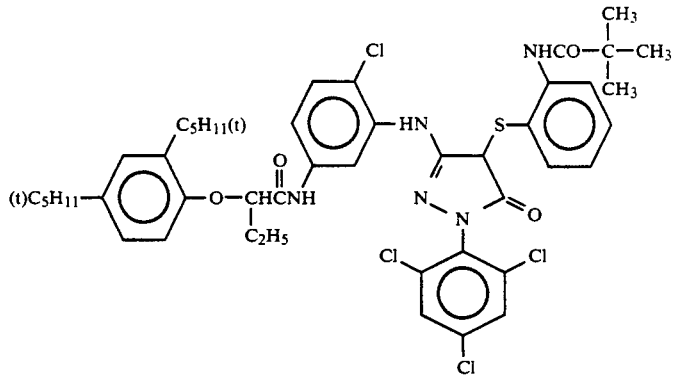
(M-7)
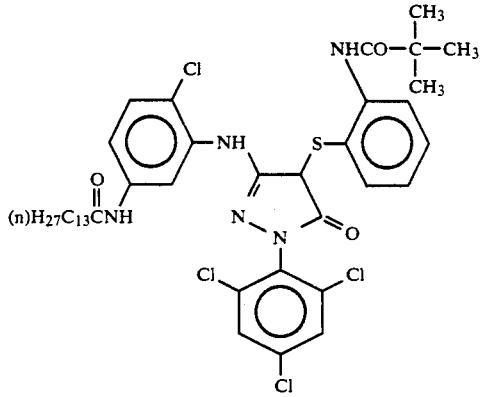
(M-8)
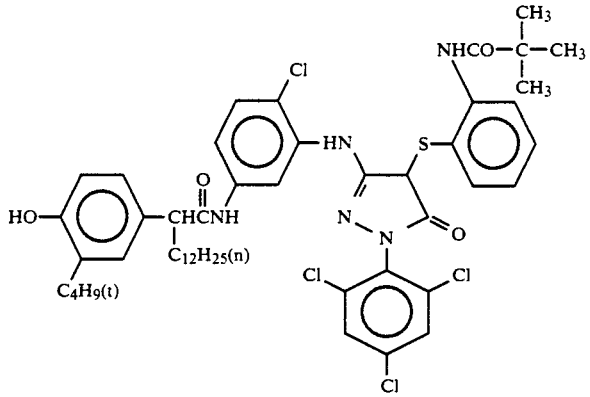

| Compound | $R_{10}'$ | $R_{15}'$ | $Y_4'$ |
|---|---|---|---|
| | | 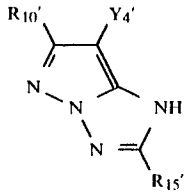 | |
| M-9 | $CH_3-$ | 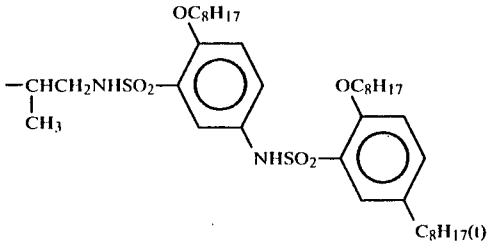 | Cl |
| M-10 | $CH_3-$ | 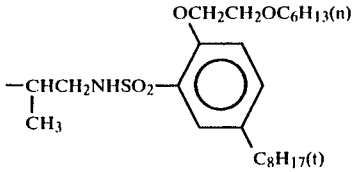 | Cl |
| M-11 | $(CH_3)_3C-$ | 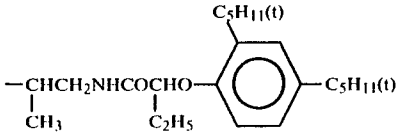 | 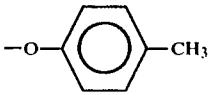 |
| M-12 | 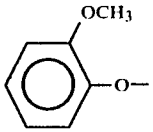 | 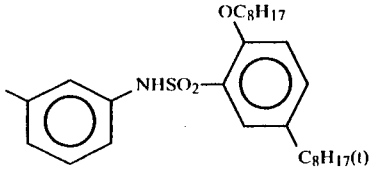 | 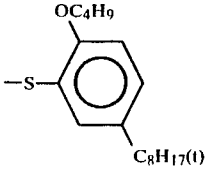 |

-continued
| Compound | $R_{10}'$ | $R_{15}'$ | $Y_4'$ |
|---|---|---|---|
| M-13 | $CH_3$— | 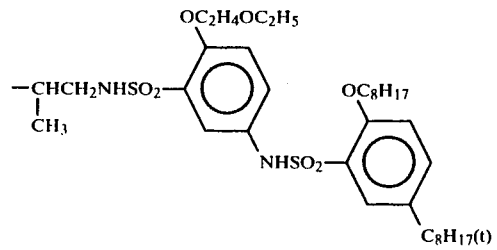 | Cl |
| M-14 | $CH_3$— | 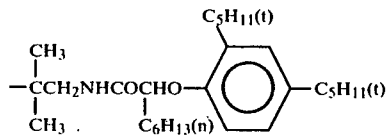 | Cl |
| M-15 | $CH_3$— | 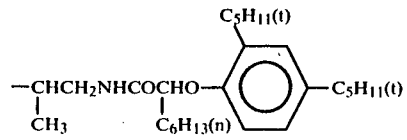 | Cl |
| M-16 | $CH_3$— | 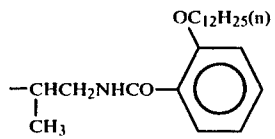 | Cl |
| M-17 | $CH_3$— | 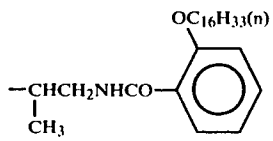 | Cl |

-continued
| Compound | $R_{10}'$ | $R_{15}'$ | $Y_4'$ |
|---|---|---|---|
| M-18 | 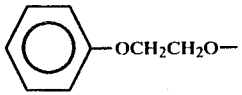 | 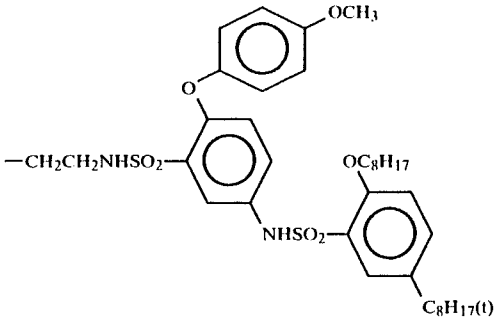 | 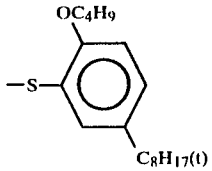 |
| M-19 | $CH_3CH_2O-$ | 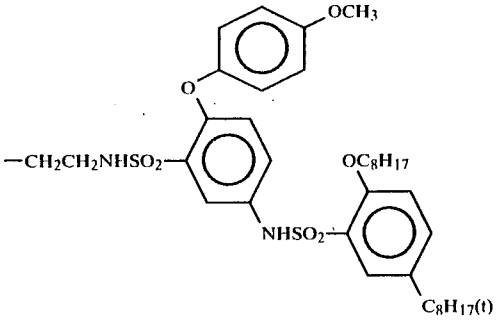 | 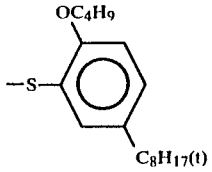 |
| M-20 | 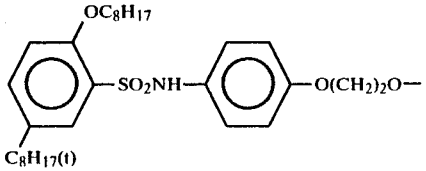 | 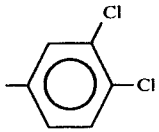 | 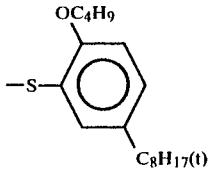 |
| M-21 | 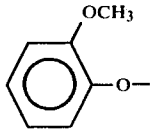 | 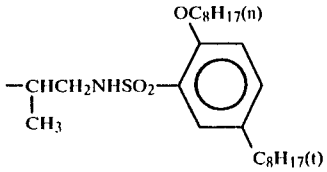 | Cl |

-continued
| Compound | $R_{10}'$ | $R_{15}'$ | $Y_4'$ |
|---|---|---|---|
| | | 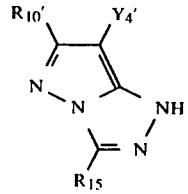 | |
| M-22 | $CH_3-$ | 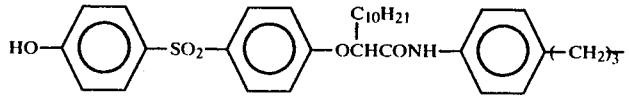 | Cl |
| M-23 | $CH_3-$ | 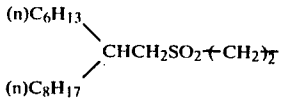 | Cl |
| M-24 | 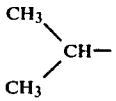 | 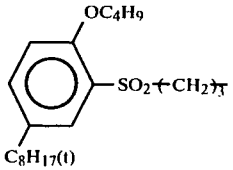 | Cl |
| M-25 | 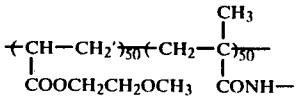 | 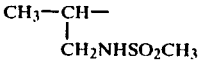 | Cl |
| M-26 | 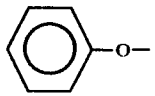 | 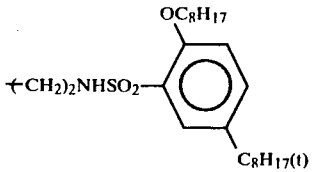 | Cl |

-continued
| Compound | $R_{10}'$ | $R_{15}'$ | $Y_4'$ |
|---|---|---|---|
| M-27 | $CH_3$— | 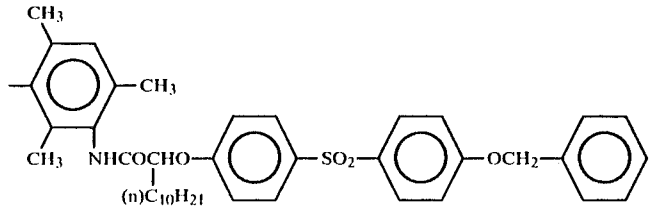 | Cl |
| M-28 | $(CH_3)_3C$— | 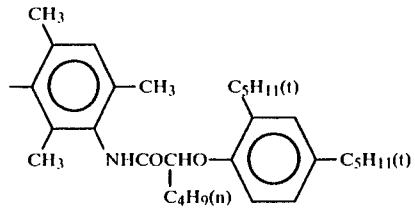 | Cl |
| M-29 | 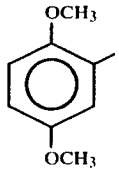 | 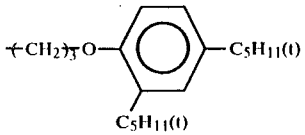 | Cl |
| M-30 | $CH_3$— | 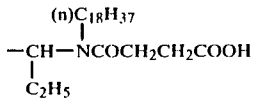 | Cl |

The couplers can be incorporated into silver halide emulsion layers using known methods, e.g., the method of U.S. Pat. No. 2,322,027. For example, the coupler can be dissolved in a high-boiling point organic solvent, such as alkyl phthalates (e.g., dibutyl phthalate, dioctyl phthalate), phosphoric esters (e.g., diphenyl phosphate, triphenyl phosphate, tricresyl phosphate, dioctylbutyl phosphate), citric esters (e.g., acetyl tributyl citrate), benzoic esters (e.g., octyl benzoate), alkylamides (e.g., diethyllaurylamide), and fatty acid esters (e.g., dibutoxyethyl succinate, dioctylazelate), or a low-boiling point organic solvent having a boiling point of from about 30° to 150° C., such as lower alkyl acetates (e.g., ethyl acetate, butyl acetate), ethyl propionate, sec-butyl alcohol, methyl isobutyl ketone, β-ethoxyethyl acetate, and methyl Cellosolve acetate, and the resulting solution is dispersed in a hydrophilic colloid. The above-described high-boiling organic solvent and low-boiling point organic solvent may be used in combination, if desired.

For the details of the high-boiling point organic solvents, reference can be made in JP-A-62-215272. Other usable high-boiling organic solvents which can be effectively used for dissolving the couplers include N,N-dialkylaniline derivatives. Of them, those having an alkoxy group at the o-position of the N,N-dialkylamino group thereof are preferred. Examples of suitable compounds are represented by the following formula:

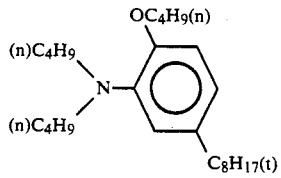

High-boiling organic solvents of the above formula are effective to prevent formation of magenta stain on white background of color prints with time and also to prevent fog due to development. The N,N-dialkylaniline derivative as a solvent is usually used in an amount of from 10 to 500 mol %, and preferably from 20 to 300 mol, based on the coupler.

It is also possible to impregnate the coupler into a loadable latex polymer (described, e.g., in U.S. Pat. No. 4,203,716) in the presence or absence of the above-described high-boiling point organic solvent or dissolved in a water-insoluble and organic solvent-soluble polymer and emulsified and dispersed in a hydrophilic colloid aqueous solution. The homo- or copolymers described in WO 88/00723, pp. 12–30 are preferably employed. In particular, acrylamide polymers are preferred from the standpoint of dye image stability.

A dispersion method using a polymer as described in JP-B-51-39853 and JP-A-51-59943 can also be employed.

Couplers having an acid radical, e.g., a carboxyl group and a sulfo group, may be introduced into a hydrophilic colloid in the form of an alkaline aqueous solution.

Silver halides which can be used in photographic emulsion layers of the light-sensitive material may be any of silver chloride, silver bromide, silver chlorobromide, silver iodobromide, silver chloroiodobromide, and silver iodobromide.

The silver halide grains of the photographic emulsions may have a regular crystal form, such as a cubic form, a tetradecahedral form, and an octahedral form; an irregular crystal form, such as a spherical form and a plate form; a crystal form having a crystal defect, such as a twinning plane; or a composite crystal form thereof.

The silver halide grains can have a wide range of grain sizes, including fine grains of about 0.2 μm or less to large grains having a projected area diameter of 10 μm. The silver halide emulsion may be a mono-dispersed emulsion or a poly-dispersed emulsion.

Silver halide photographic emulsions which can be used in the present invention can be prepared by the processes described, e.g., in *Research Disclosure,* No. 17643 (Dec., 1978), pp. 22–23, "I. Emulsion Preparation and Types", and ibid, No. 18716 (Nov., 1979).

Mono-dispersed emulsions described in U.S. Pat. Nos. 3,574,628 and 3,655,394 and British Patent 1,413,748 can be advantageously used as well.

Tabular silver halide grains having an aspect ratio of about 5 or more are also useful. Suitable tabular grains can easily be prepared by the processes described, e.g., in Gutoff, *Photographic Science and Engineering,* Vol. 14, pp. 248–257 (1970), U.S. Pat. Nos. 4,434,226, 4,414,310, 4,433,048, and 4,439,520, and British Patent 2,112,157.

The silver halide grains may be homogeneous grains having a uniform crystal structure throughout the individual grains or heterogeneous grains including those in which the inside and the outer shell have different halogen compositions, those in which the halogen composition differs within layers thereof, and those having a silver halide of a different halogen composition epitaxially grown. Silver halide grains fused with compounds other than silver halides, e.g., silver rhodanide or lead oxide may also be used. A mixture comprising grains of various crystal forms can also be used.

The silver halide emulsions are usually subjected to physical ripening, chemical ripening, and spectral sensitization. Additives which can be used in these steps are described in *Research Disclosure,* Nos. 17643 and 18716 as listed below. Other known photographic additives which can be used in the present invention are also described therein as listed below.

| Additive | RD 17643 | RD 18716 |
|---|---|---|
| 1. Chemical Sensitizers | p. 23 | p. 648, right column (RC) |
| 2. Sensitivity Increasing Agents | | p. 648, right column (RC) |
| 3. Spectral Sensitizers, Supersensitizers | pp. 23–24 | p.648, RC to p. 649, RC |
| 4. Brightening Agents | p. 24 | |
| 5. Antifoggants and Stabilizers | pp. 24–25 | p. 649, RC |
| 6. Light Absorbers, Filter Dyes, Ultrasonic Absorbers | pp. 25–26 | p.649, RC to P. 650, left column (LC) |
| 7. Stain Inhibitors | p. 25, RC | P. 650, LC to RC |
| 8. Dye Image Stabilizers | p. 25 | — |
| 9. Hardening Agents | p. 26 | p. 651, LC |
| 10. Binders | p. 26 | " |
| 11. Plasticizers, Lubricants | p. 27 | P. 650, RC |
| 12. Coating Aids, Surface Active Agents | pp. 26–27 | p. 650, RC |
| 13. Antistatic Agents | p. 27 | " |

Various couplers can be used in the present invention. Specific examples of useful couplers are described in the patents cited in *Research Disclosure,* No. 17643, supra, VII-C to G.

Examples of suitable yellow couplers are described in U.S. Pat. Nos. 3,933,501, 4,022,620, 4,326,024, and 4,401,752, JP-B-58-10739, British Patents 1,425,020 and 1,476,760.

Cyan couplers which can be used include phenol couplers and naphthol couplers. Examples of suitable couplers are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent 3,329,729, EP 121,365A, U.S. Pat. Nos. 3,446,622, 4,333,999, 4,451,559, and 4,427,767, and EP 161,626A.

Examples of suitable colored couplers which can be used for correcting unnecessary absorption of the developed dye are described in *Research Disclosure,* No. 17643, VII-G, U.S. Pat. No. 4,163,670, JP-B-57-39413, U.S. Pat. Nos. 4,004,929 and 4,138,258 and British Patent 1,146,368.

Examples of suitable couplers which develop a dye having a moderate diffusibility are described in U.S. Pat. No. 4,366,237, British Patent 2,125,570, EP 96,570, and West German Patent (OLS) No. 3,234,533.

Typical examples of polymer dye-forming couplers are described in U.S. Pat. Nos. 3,451,820, 4,080,211, and 4,367,282, and British Patent 2,102,173.

Couplers which release a photographically useful residue on coupling can also be used to advantage. Examples of suitable DIR couplers which release a development inhibitor are described in the patents cited in *Research Disclosure,* No. 17643, VII-F, JP-A-57-151944, JP-A-57-154234, JP-A-60-184248, and U.S. Pat. No. 4,248,962.

Examples of suitable couplers which imagewise release a nucleating agent or a development accelerator at the time of development are described in British Patents 2,097,140 and 2,131,188, JP-A-59-157638, and JP-A-59-170840.

Couplers which can be additionally used in the light-sensitive material of the present invention include competing couplers described in U.S. Pat. No. 4,130,427, polyequivalent couplers described in U.S. Pat. Nos. 4,283,472, 4,338,393, and 4,310,618, DIR redox compound-releasing couplers described in JP-A-60-185950, and couplers releasing a dye which restores its color after release as described in EP 173,302A.

These couplers can be incorporated into the photographic emulsion layers using various known dispersion methods. Examples of high-boiling point organic solvents which can be used in a oil-in-water dispersion method are described, e.g., in U.S. Pat. No. 2,322,027. A method of using a polymer as a medium for dispersing couplers as described in JP-B-48-30494, U.S. Pat. No. 3,619,195, West German Patent 1,957,467, and JP-B-51-39835 can also be employed. With respect to the latex dispersion method, the steps involved, the effects, and specific examples of impregnatable lattices are described in U.S. Pat. No. 4,199,363 and West German Patent (OLS) Nos. 2,541,274 and 2,541,230.

Antistatic agents which can be suitably used in the light-sensitive material include fluorine-containing surface active agents or polymers as described in JP-A-62-109044 and JP-A-62-215272, nonionic surface active agents as described in JP-A-60-76742, JP-A-60-80846, JP-A-60-80848, JP-A-60-80839, JP-A-60-76741, JP-A-58-208743, and JP-A-62-172343, JP-A-62-173459 and JP-A-62-215272, and electrically conductive polymers or lattices (including nonionic, anionic, cationic, and amphoteric) as described in JP-A-57-204540 and JP-A-62-215272. Preferred of them are the cationic latex polymers described in JP-B-44-16238, JP-A-50-54672, JP-A-54-1398, U.S. Pat. Nos. 4,118,231 and 3,988,158, JP-B-58-56858, JP-A-55-65950, JP-A-55-67746. Examples of suitable inorganic antistatic agents include halides, nitrates, perchlorates, sulfates, acetates, phosphates or thiocyanates of ammonium, alkali metals or alkaline earth metals and, in addition, electrically conductive tin oxide or zinc oxide, or complex oxides thereof (metal oxides doped with antimony, etc.). Further, various charge transfer complexes, $\pi$-conjugated high polymers and doped products thereof, organic metal compounds, and interlayer compounds are also useful as antistatic agents. Such compounds include TCNO(tetracyanoquinodimethane)/TTF(tetrathiofulvalene), polyacetylene, and polypyrrole. Examples of these antistatic agents are described in Morita, et al., *Kagaku to Kogyo,* Vol. 59 (3), pp. 103–111 (1985), ibid, Vol. 59 (4), pp. 146–152 (1985).

Fluorine-containing compounds or silicon-containing compounds can be used as an antistatic agent, an adhesion preventing agent, a slipping agent, or a coating aid to improve various characteristics of the light-sensitive material. These compounds may be either low-molecular weight compounds or high-molecular weight compounds. A choice is made depending on the end use from known fluorine-containing compounds and silicon-containing compounds including, for example, the compounds described in JP-A-62-215272.

Polymers can also be used in the present invention. Polymers may be used in the form of a polymer latex. In the present invention, polymers have the following functions:

a) When used in gelatin, to increase dimensional stability and softness, and to decrease frictional resistance; or to diminish the tendency of a dispersed material to agglomerate due to presence of a metal salt.
b) To increase electrical conductivity for a reduction in the quantity of static electricity.
c) To accelerate drying.
d) To prevent destruction of a color forming layer.
e) To increase the wet strength of a photographic paper.
f) To increase covering and protective power of dispersed materials.
g) To accelerate development.
h) To reduce high temperature fog.
i) To increase color density.
j) To reduce distortion desensitization.

Disclosures of these functions of polymers are found, e.g., in JP-A-62-215272. These and other known polymers can be used depending on the end use of a light-sensitive material.

In the present invention, other various known additives or modifiers for improving the coating characteristics and film properties, such as surface active agents, slipping agents, thickeners, antistatic agents, matting agents, and the like, can be employed. Any known additives, including those described in JP-A-62-215272, can be used depending on to the end use to achieve these effects.

Examples of supports which can be appropriately used in the present invention are described, e.g., in *Research Disclosure,* No. 17632, p. 28, and ibid, No. 18716, pp. 647 (right column) to 648 (left column).

The method of processing according to the present invention is applicable to various color light-sensitive materials. It is also applicable to color light-sensitive materials described in JP-A-64-59351 and JP-A-63-129341.

In light-sensitive materials for photography, hydrophilic colloidal layers on the side having the emulsion layers preferably have a total film thickness of not more than 28 μm and a rate of swell $T_{178}$ of not more than 30 seconds. The terminology "total film thickness" as used herein means the film thickness as measured after conditioning at 25° C. and a relative humidity of 55% for 2 days. The terminology "rate of swell $T_{\frac{1}{2}}$" means the time required for a color light-sensitive material to swell to ½ the saturated swollen thickness, the saturated swollen thickness being defined to be 90% of the maximum swollen thickness which is reached when the color light-sensitive material is swollen with a color developing solution at 30° C. for 3 minutes and 15 seconds. The rate of swell can be determined by methods known in the art using, for example, a swellometer of the type described in A. Green et al , *Photographic Science and Engineering*, Vol. 19, No. 2, pp. 124–129.

The rate of swell $T_{178}$ can be controlled by adding a hardening agent for a gelatin binder or by varying the aging conditions of the coating compositions.

Further, the light-sensitive material preferably has a degree of swelling of from 150 to 400%. The terminology "degree of swelling" as used herein means the value obtained from the maximum swollen film thickness as defined above according to formula: (maximum swollen film thickness—film thickness)/film thickness.

The present invention is illustrated in greater detail with reference to the following Examples, but it should be understood that the present invention is not deemed to be limited thereto. All percents, parts, and ratios are by weight unless otherwise indicated.

EXAMPLE 1

Multi-layers having the following compositions were coated on a cellulose triacetate film support having coated on the back side thereof a dispersion of silica and a methyl methacrylate/dodecyl methacrylate copolymer using cellulose diacetate and a low-boiling organic solvent according to the process described in JP-A-62-115035. The resulting multi-layer color light-sensitive material was designated Sample 101.

With respect to the compositions of the layers, the coating amounts of silver halide and colloidal silver are given in terms of the silver coating amount in g/m². The coating amounts of couplers, additives and gelatin are given in units of g/m², and the coating amounts of sensitizing dyes are given in units of mols per mol of silver halide contained in the same layer. All parts are given by weight, unless indicated otherwise.

The additives used are set forth below and are denoted by the following symbols according to their function. Where an additive had two or more functions, a typical function was chosen.

| | |
|---|---|
| UV | Ultraviolet Absorbent |
| Solv | High-Boiling Organic Solvent |
| ExF | Dye |
| ExS | Sensitizing Dye |
| ExC | Cyan Coupler |
| ExM | Magenta Coupler |
| ExY | Yellow Coupler |
| Cpd | Additive Compound |

| First Layer (Anti-halation Layer): | |
|---|---|
| Black Colloidal Silver | 0.15 g/m² |
| Gelatin | 2.9 g/m² |
| UV-1 | 0.03 g/m² |
| UV-2 | 0.06 g/m² |
| UV-3 | 0.07 g/m² |
| Solv-2 | 0.08 g/m² |
| ExF-1 | 0.01 g/m² |
| ExF-2 | 0.01 g/m² |

| Second Layer (Slow-Speed Red-Sensitive Emulsion Layer): | |
|---|---|
| Silver iodobromide emulsion (AGI: 4 mol %, uniformly distributed; sphere-equivalent diameter: 0.4 μm; coefficient of variation of sphere-eq. diameter: 37%; tabular grains having a diameter/thickness ratio of 3.0) | 0.4 g-Ag/m² |
| Gelatin | 0.8 g/m² |
| ExS-1 | $2.3 \times 10^{-4}$ mol/mol-AgX (X: halogen) |
| ExS-2 | $1.4 \times 10^{-4}$ mol/mol-AgX |
| ExS-5 | $2.3 \times 10^{-4}$ mol/mol-AgX |
| ExS-7 | $8.0 \times 10^{-6}$ mol/mol-AgX |
| ExC-1 | 0.08 g/m² |
| ExC-13 | 0.06 g/m² |
| ExC-2 | 0.03 g/m² |
| ExC-3 | 0.13 g/m² |

| Third Layer (Medium-Speed Red-Sensitive Emulsion Layer): | |
|---|---|
| Silver iodobromide emulsion (AGI: 6 mol %, distributed at a core/shell ratio of 2:1 (inner high AgI type); sphere-eq. diameter: 0.65 μm; coefficient of variation of sphere-eq. diameter: 25%; tabular grains having diameter/thickness ratio of 2.0) | 0.65 g-Ag/m² |
| Silver iodobromide emulsion (AGI: 4 mol %, uniformly distributed; sphere-eq. diameter: 0.4 μm; coefficient of variation of sphere-eq. diameter: 37%; tabular grains having diameter/thickness ratio of 3.0) | 0.1 g-Ag/m² |
| Gelatin | 1.0 g/m² |
| ExS-1 | $2 \times 10^{-4}$ mol/mol-AgX |
| ExS-2 | $1.2 \times 10^{-4}$ mol/mol-AgX |
| ExS-5 | $2 \times 10^{-4}$ mol/mol-AgX |
| ExS-7 | $7 \times 10^{-6}$ mol/mol-AgX |
| ExC-1 | 0.16 g/m² |
| ExC-13 | 0.10 g/m² |
| ExC-2 | 0.01 g/m² |
| ExC-3 | 0.06 g/m² |

| Fourth Layer (High-Speed Red-Sensitive Emulsion Layer): | |
|---|---|
| Silver iodobromide emulsion (AGI: 6 mol %, distributed at a core/shell ratio of 2:1 sphere-eq. diameter: 0.7 μm; coefficient of variation of sphere-eq. diameter: 25%; tabular grains having diameter/thickness ratio of 2.5) | 0.9 g-Ag/m² |
| Gelatin | 0.8 g/m² |
| ExS-1 | $1.6 \times 10^{-4}$ mol/mol-Agx |
| ExS-2 | $1.6 \times 10^{-4}$ mol/mol-Agx |
| ExS-5 | $1.6 \times 10^{-4}$ mol/mol-Agx |
| ExS-7 | $6 \times 10^{-4}$ mol/mol-Agx |
| ExC-1 | 0.07 g/m² |
| ExC-4 | 0.05 g/m² |
| Solv-1 | 0.07 g/m² |
| Solv-2 | 0.20 g/m² |
| Cpd-7 | $4.6 \times 10^{-4}$ g/m² |

| Fifth Layer (Intermediate Layer): | |
|---|---|
| Gelatin | 0.6 g/m² |
| UV-4 | 0.03 g/m² |
| UV-5 | 0.04 g/m² |
| Cpd-1 | 0.1 g/m² |
| Polyethyl Acrylate Latex | 0.08 g/m² |
| Solv-1 | 0.05 g/m² |

| Sixth Layer (Slow-Speed Green-Sensitive Emulsion Layer): | |
|---|---|
| Silver iodobromide emulsion (AGI: 4 mol %, uniformly distributed; sphere-eq. diameter: 0.4 μm; coefficient of variation of sphere-eq. diameter: 37%; tabular grains having | 0.18 g-Ag/m² |

-continued

| | |
|---|---|
| diameter/thickness ratio of 2.0) | |
| Gelatin | 0.4 g/m$^2$ |
| ExS-3 | 2 × 10$^{-4}$ mol/mol-AgX |
| ExS-4 | 7 × 10$^{-4}$ mol/mol-AgX |
| ExS-5 | 1 × 10$^{-4}$ mol/mol-AgX |
| ExM-5 | 0.11 g/m$^2$ |
| ExM-7 | 0.03 g/m$^2$ |
| ExY-8 | 0.01 g/m$^2$ |
| Solv-1 | 0.14 g/m$^2$ |
| Solv-4 | 0.01 g/m$^2$ |

Seventh Layer (Medium-Speed Green-Sensitive Emulsion Layer):

| | |
|---|---|
| Silver iodobromide emulsion (AGI: 4 mol %, distributed at a core/shell ratio of 1:1 (surface high AgI type): sphere-eq. diameter: 0.5 μm; coefficient of variation of sphere-eq. diameter: 20%; tabular grains having diameter/thickness ratio of 4.0) | 0.27 g-Ag/m$^2$ |
| Gelatin | 0.6 g/m$^2$ |
| ExS-3 | 2 × 10$^{-4}$ mol/mol-AgX |
| ExS-4 | 7 × 10$^{-4}$ mol/mol-AgX |
| ExS-5 | 1 × 10$^{-4}$ mol/mol-AgX |
| ExM-5 | 0.17 g/m$^2$ |
| ExM-7 | 0.04 g/m$^2$ |
| ExY-8 | 0.02 g/m$^2$ |
| Solv-1 | 0.21 g/m$^2$ |
| Solv-4 | 0.02 g/m$^2$ |

Eighth Layer (High-Speed Green-Sensitive Emulsion Layer):

| | |
|---|---|
| Silver iodobromide emulsion (AGI: 8.7 mol %; multi-layer structure with AgI ratio of 3:4:2 and AgI ratio of 24:0:3 (by mol % from the inside); sphere-eq. diameter: 0.7 μm; coefficient of variation of sphere-eq. diameter: 25%; tabular grains having diameter/thickness ratio of 1.6) | 0.7 g-Ag/m$^2$ |
| Gelatin | 0.8 g/m$^2$ |
| ExS-4 | 5.2 × 10$^{-4}$ mol/mol-AgX |
| ExS-5 | 1 × 10$^{-4}$ mol/mol-AgX |
| ExS-8 | 0.3 × 10$^{-4}$ mol/mol-AgX |
| ExM-5 | 0.1 g/m$^2$ |
| ExM-6 | 0.03 g/m$^2$ |
| ExY-8 | 0.02 g/m$^2$ |
| ExC-1 | 0.02 g/m$^2$ |
| ExC-4 | 0.01 g/m$^2$ |
| Solv-1 | 0.25 g/m$^2$ |
| Solv-2 | 0.06 g/m$^2$ |
| Solv-4 | 0.01 g/m$^2$ |
| Cpd-7 | 1 × 10$^{-4}$ g/m$^2$ |

Ninth Layer (Intermediate Layer):

| | |
|---|---|
| Gelatin | 0.6 g/m$^2$ |
| Cpd-1 | 0.04 g/m$^2$ |
| Polyethyl Acrylate Latex | 0.12 g/m$^2$ |
| Solv-1 | 0.02 g/m$^2$ |

Tenth Layer (Layer donating interlayer effect to red-sensitive layer):

| | |
|---|---|
| Silver iodobromide emulsion (AGI: 6 mol %, distributed at a core/shell ratio of 2:1 (inner high AgI type); sphere-eq. diameter: 0.7 μm; coefficient of variation of sphere-eq. diameter: 25%; tabular grains having diameter/thickness ratio of 2.0) | 0.68 g-Ag/m$^2$ |
| Silver iodobromide emulsion (AGI: 4 mol %, uniformly distributed; sphere-eq. diameter: 0.4 μm; coefficient of variation of sphere-eq. diameter: 37%; tabular grains having diameter/thickness ratio of 3.0) | 0.19 g-Ag/m$^2$ |
| Gelatin | 1.0 g/m$^2$ |
| ExS-3 | 6 × 10$^{-4}$ mol/mol-AgX |
| ExM-10 | 0.19 g/m$^2$ |
| Solv-1 | 0.20 g/m$^2$ |

-continued

Eleventh Layer (Yellow Filter Layer):

| | |
|---|---|
| Yellow Colloidal Silver | 0.06 g/m$^2$ |
| Gelatin | 0.8 g/m$^2$ |
| Cpd-2 | 0.13 g/m$^2$ |
| Solv-1 | 0.13 g/m$^2$ |
| Cpd-1 | 0.07 g/m$^2$ |
| Cpd-6 | 0.002 g/m$^2$ |
| H-1 | 0.13 g/m$^2$ |

Twelfth Layer (Slow-Speed Blue-Sensitive Emulsion Layer):

| | |
|---|---|
| Silver iodobromide emulsion (AGI: 4.5 mol %, uniformly distributed; sphere-eq. diameter: 0.7 μm; coefficient of variation of sphere-eq. diameter: 15%; tabular grains having diameter/thickness ratio of 7.0) | 0.3 g-Ag/m$^2$ |
| Silver iodobromide emulsion (AgI: 3 mol % uniformly distributed; sphere-eq. diameter: 0.3 μm; coefficient of variation of sphere-eq. diameter: 30%; tabular grains having diameter/thickness ratio of 7.0) | 0.15 g-Ag/m$^2$ |
| Gelatin | 1.8 g/m$^2$ |
| ExS-6 | 9 × 10$^{-4}$ mol/mol-AgX |
| ExC-1 | 0.06 g/m$^2$ |
| ExC-4 | 0.03 g/m$^2$ |
| ExY-9 | 0.14 g/m$^2$ |
| ExY-11 | 0.45 g/m$^2$ |
| ExY-14 | 0.42 g/m$^2$ |
| Solv-1 | 0.52 g/m$^2$ |

Thirteenth Layer (Intermediate Layer):

| | |
|---|---|
| Gelatin | 0.7 g/m$^2$ |
| ExY-12 | 0.20 g/m$^2$ |
| Solv-1 | 0.34 g/m$^2$ |

Fourteenth Layer (High-Speed Blue-Sensitive Emulsion Layer):

| | |
|---|---|
| Silver iodobromide emulsion (AGI: 10 mol %, inner high AgI type; sphere-eq. diameter: 1.0 μm; coefficient of variation of sphere-eq. diameter: 25%; multi-twinned tabular grains having diameter/thickness ratio of 2.0) | 0.5 g-Ag/m$^2$ |
| Gelatin | 0.5 g/m$^2$ |
| ExS-6 | 1 × 10$^{-4}$ mol/mol-AgX |
| ExY-9 | 0.01 g/m$^2$ |
| ExY-11 | 0.10 g/m$^2$ |
| ExY-14 | 0.10 g/m$^2$ |
| ExC-1 | 0.02 g/m$^2$ |
| Solv-1 | 0.12 g/m$^2$ |

Fifteenth Layer (First Protective Layer):

| | |
|---|---|
| Fine silver iodobromide emulsion (AgI: 2 mol %, uniformly distributed; sphere-eq. diameter: 0.07 μm) | 0.12 g-Ag/m$^2$ |
| Gelatin | 0.9 g/m$^2$ |
| UV-4 | 0.11 g/m$^2$ |
| UV-5 | 0.16 g/m$^2$ |
| Solv-5 | 0.02 g/m$^2$ |
| H-1 | 0.13 g/m$^2$ |
| Cpd-5 | 0.10 g/m$^2$ |
| Polyethyl Acrylate Latex | 0.09 g/m$^2$ |

Sixteenth Layer (Second Protective Layer):

| | |
|---|---|
| Fine silver iodobromide emulsion (AgI: 2 mol %, uniformly distributed; sphere-eq. diameter: 0.07 μm) | 0.36 g-Ag/m$^2$ |
| Gelatin | 0.55 g/m$^2$ |
| Polymethyl Methacrylate (particle size: 1.5 μm) | 0.2 g/m$^2$ |
| H-1 | 0.17 g/m$^2$ |

Each layer further contained 0.07 g/m$^2$ of Cpd-3 as an emulsion stabilizer and 0.03 g/m$^2$ of a surface active agent, Cpd-4 as a coating aid.

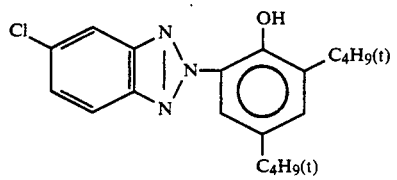
UV-1
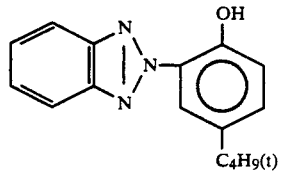
UV-2
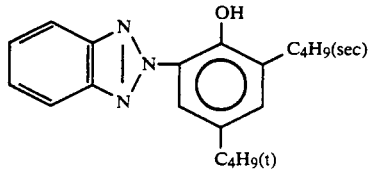
UV-3
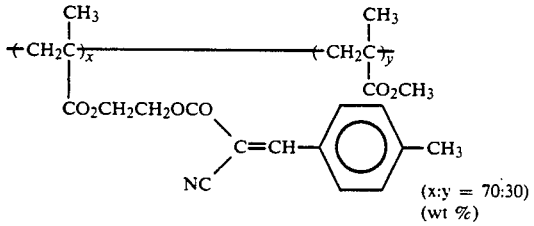
UV-5
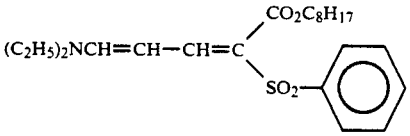
Tricresyl Phosphate — Solv-1
Dibutyl Phthalate — Solv-2
Solv-4
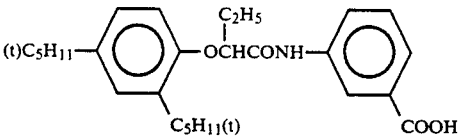
Trihexyl Phosphate — Solv-5
ExF-1
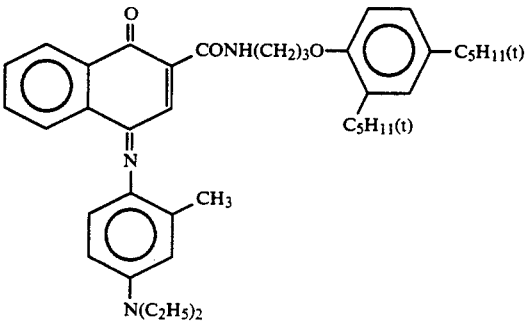

-continued
ExF-2
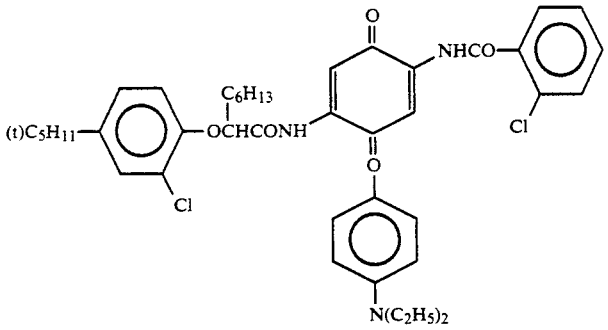
ExS-1
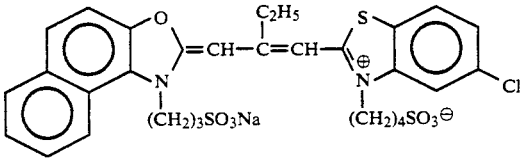
ExS-2
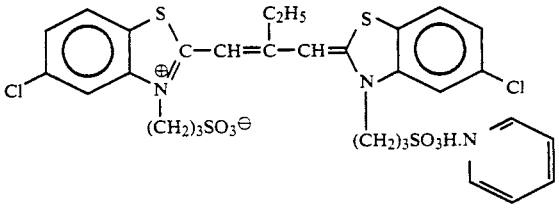
ExS-3
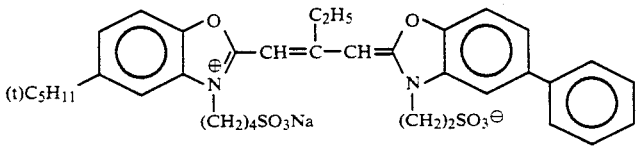
ExS-4
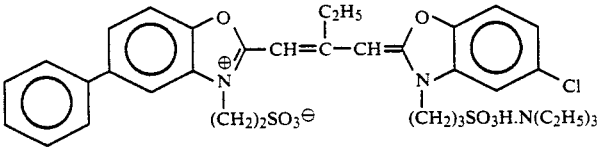
ExS-5
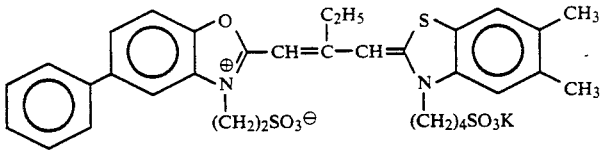
ExS-6
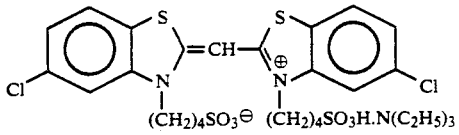
ExS-7
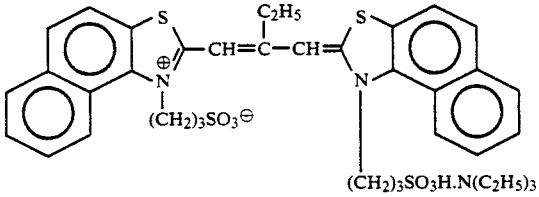

-continued
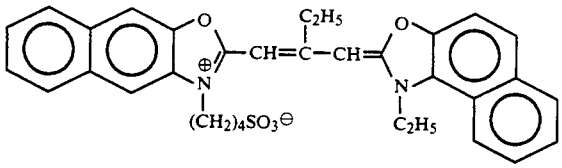
ExS-8
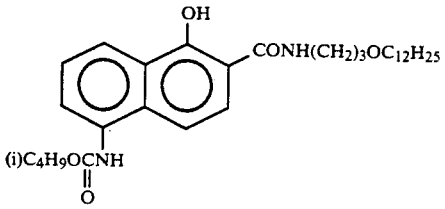
ExC-1
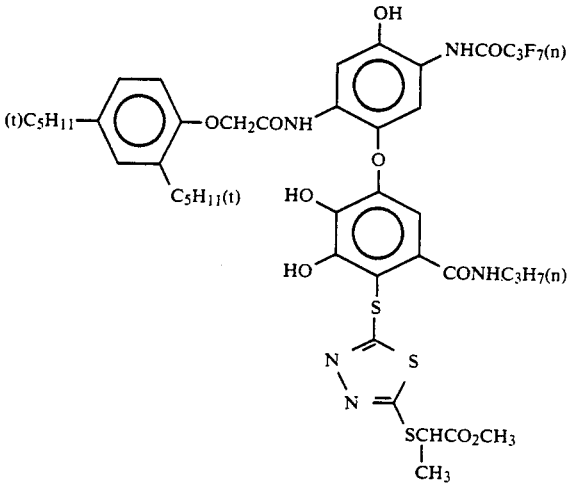
ExC-2
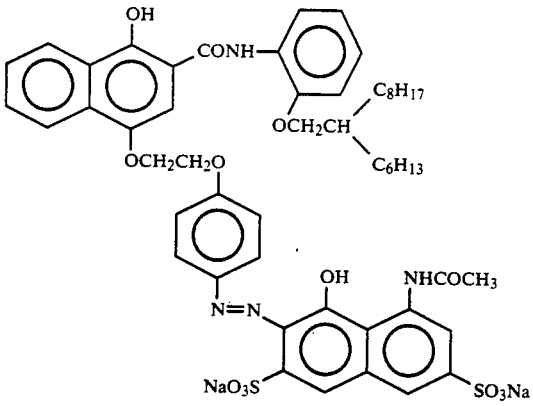
ExC-3
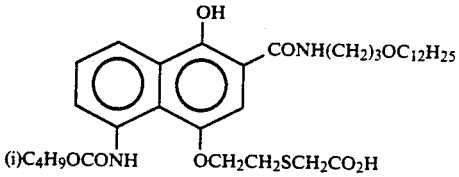
ExC-4

-continued
ExM-5
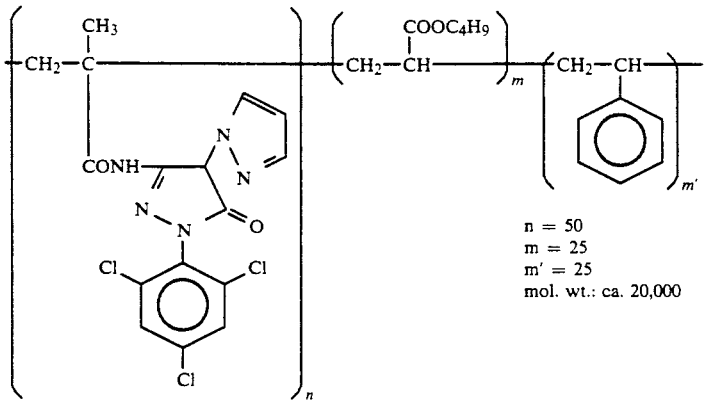
ExM-6
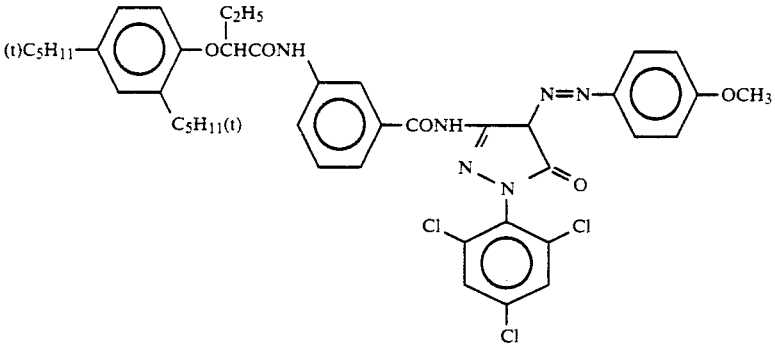
ExM-7
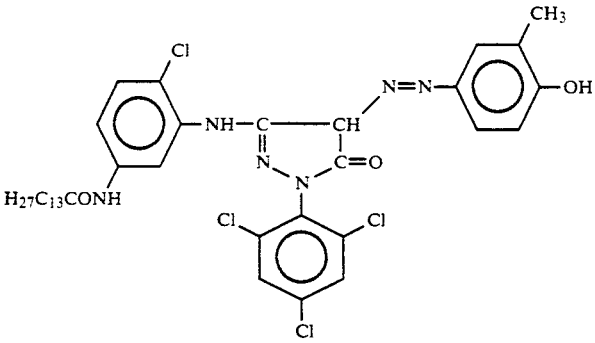
ExM-10
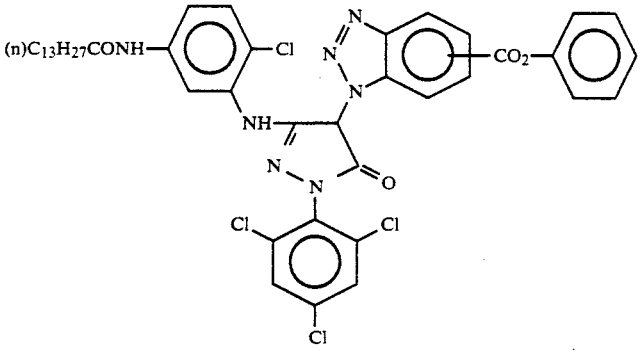

-continued
ExY-8
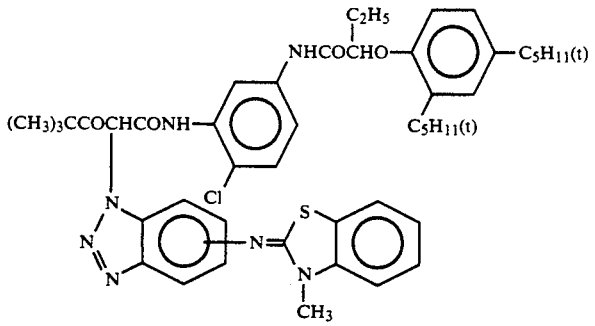
ExY-9
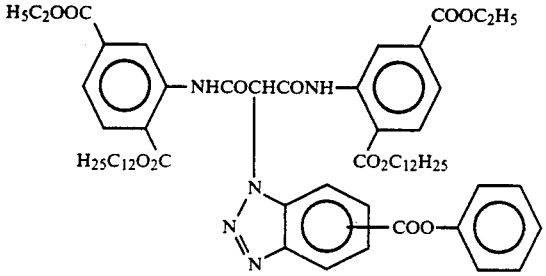
ExY-11
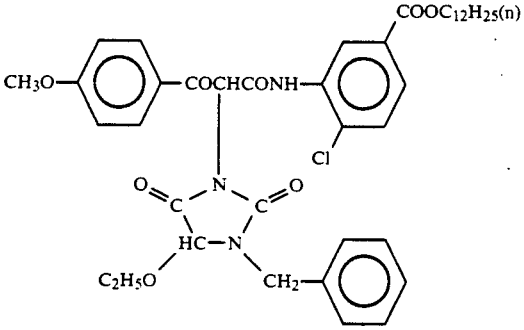
ExY-12
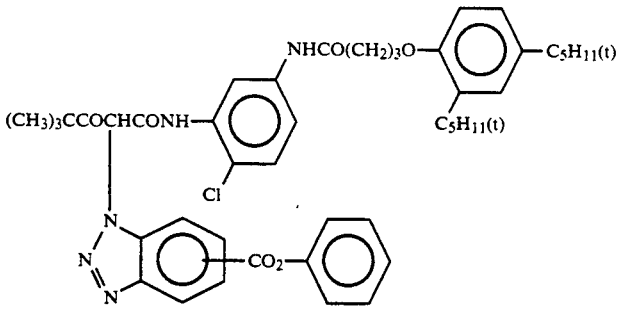
Cpd-7
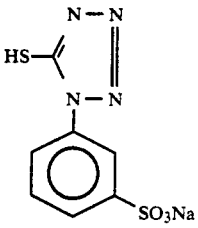

-continued

Cpd-1

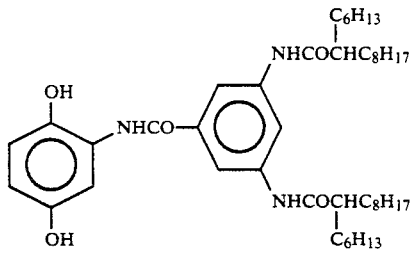

ExC-13

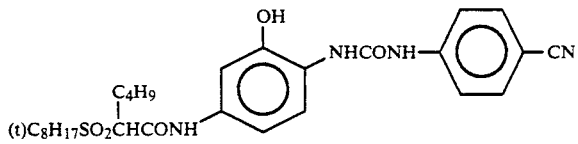

ExY-14

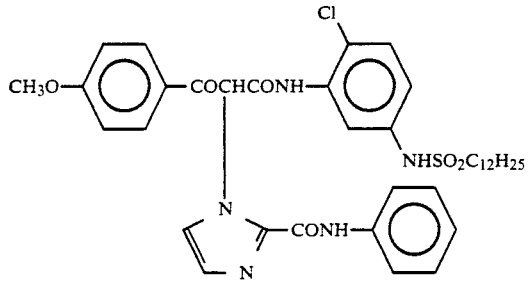

Cpd-2

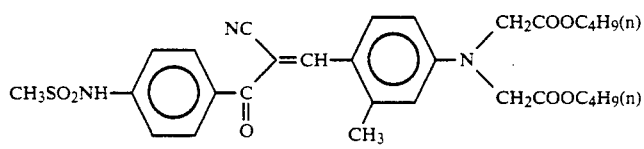

Cpd-6

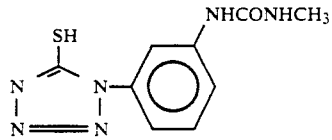

Cpd-5

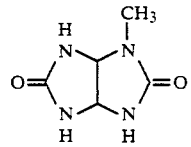

Cpd-3

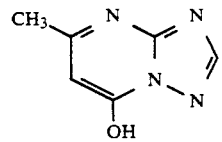

Cpd-4

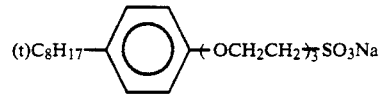

H-1

$CH_2{=}CH{-}SO_2{-}CH_2{-}CONH{-}CH_2$ $CH_2{=}CH{-}SO_2{-}CH_2{-}CONH{-}CH_2$

Sample 102 was prepared in the same manner as for Sample 101, except for replacing the magenta coupler (ExM-5) used in the Sixth, Seventh, Eighth, and Tenth Layers with an equimolar amount (calculated according to the molecular weight converted to a unit containing one molecule of the pyrazolone nucleus of ExM-5) of Magenta Coupler (1) shown below.

Magenta Coupler (1):

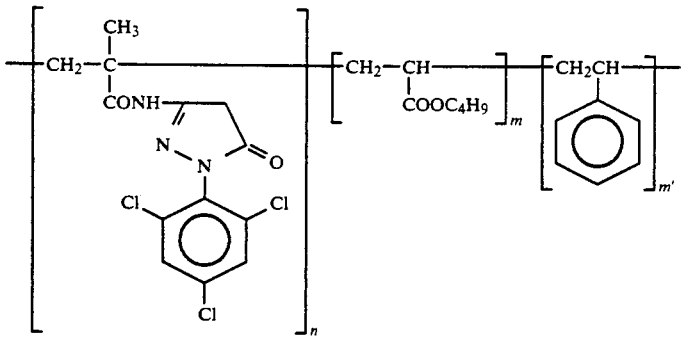

wherein n = 50, m' = m = 25
mol. wt.: ca. 20,000

Each of Samples 101 and 102 was cut to a width of 35 mm. A part of the samples was exposed to light at an adjusted exposure amount so as to provide a grey density of 2.0. The unexposed samples and the exposed samples were processed according to the following procedures using processing solutions having the following compositions and a processing machine for motion picture film (running test). The ratio of the unexposed sample and the exposed sample was 1:1. Samples evaluated as hereinafter described were processed after the total amount of the color developer replenisher reached 3 times the volume of the tank of the start liquor.

| Processing Step | Time (sec) | Temp. (°C.) | Rate of Replenishment (ml/m*) | Tank Capacity (l) |
|---|---|---|---|---|
| Color Development | 195 | 37.8 | 23 | 10 |
| Bleaching | 40 | 38.0 | 5 | 5 |
| Fixing | 90 | 38.0 | 30 | 10 |
| Washing (1**) | 30 | 38.0 | — | 5 |
| Washing (2**) | 30 | 38.0 | 30 | 5 |
| Stabilizing | 30 | 38.0 | 20 | 5 |
| Drying | 60 | 55 | — | — |

Note:
*Amount of replenisher per m of 35 mm wide sample
**Countercurrent system of from bath (2) to bath (1)

The carry-over of the developing solution into the bleaching bath and the carry-over of the fixing bath into the washing bath were 2.5 ml and 2.0 ml, respectively, per m of the 35 mm wide light-sensitive material.

The cross-over time between two adjacent steps was 5 seconds, which was included in the processing time of the preceding bath.

The contact area of each processing solution with air was 500 cm².

| | Start Liquor | Replenisher |
|---|---|---|
| Color Developing Solution: | | |
| Diethylenetriaminepentaacetic Acid | 1.0 g | 1.1 g |
| 1-Hydroxyethylidene-1,1-diphosphonic Acid | 3.0 g | 3.2 g |
| Sodium Sulfite | 4.0 g | 4.9 g |
| Potassium Carbonate | 30.0 g | 30.0 g |
| Potassium Bromide | 1.4 g | — |
| Potassium Iodide | 1.5 mg | — |
| Hydroxylamine Sulfate | 2.4 g | 3.6 g |
| 4-[N-Ethyl-N-β-hydroxyethylamino]-2-methylaniline Sulfate | 4.5 g | 6.4 g |

-continued

| | Start Liquor | Replenisher |
|---|---|---|
| Water to male | 1.0 l | 1.0 l |
| pH | 10.05 | 10.10 |
| Bleaching Bath (A): | | |
| Ammonium (1,3-diaminopropanetetraacetato)iron (III) Monohydrate (hereinafter referred to as 1,3-DPTA.Fe(III)) | 144.0 g | 206.0 g |
| 1,3-diaminopropanetetraacetic Acid | 2.8 g | 4.0 g |
| Ammonium Bromide | 84.0 g | 120.0 g |
| Ammonium Nitrate | 90.0 g | 125.0 g |
| Acetic acid (98 wt % aq. soln.) | 63.0 g | 90.0 g |
| Water to make | 1.0 l | 1.0 l |
| pH (adjusted with 27 wt % aq. ammonia) | 4.0 | 3.2 |

Fixing Bath

The start liquor and the replenisher had the same composition.

| | |
|---|---|
| Diammonium Ethylenediaminetetraacetate | 1.7 g |
| Preservative | see Table 1 |
| Ammonium Thiosulfate (700 g/l) | 340.0 ml |
| Water to make | 1.0 l |
| pH | 7.0 |

Washing Water

The start liquor and the replenisher had the same composition.

Tap water was passed through a mixed bed column packed with an H type strongly acidic cation-exchange resin ("Amberlite IR-120B" produced by Rohm & Haas Co.) and an OH type strongly basic anion-exchange resin ("Amberlite IRA-400" produced by Rohm & Haas) to decrease the amount of calcium and magnesium ions, each to 3 mg/l or less. To the deionized water were added 20 mg/l of dichlorinated sodium isocyanurate and 150 mg/l of sodium sulfate. The resulting washing water had a pH between 6.5 and 7.5.

Stabilizing Bath

The start liquor and the replenisher had the same composition.

| | |
|---|---|
| Formaldehyde (37 wt % aq. soln.) | 1.2 ml |

-continued

| | |
|---|---|
| Surface Active Agent ($C_{10}H_{21}$—O(—$CH_2CH_2O$—)$_{10}$H) | 0.4 g |
| Ethylene Glycol | 1.0 g |
| Water to make | 1.0 l |
| pH | 5.0–7.0 |

Then, the same running test as described above was conducted, except for carrying out bleaching at 38° C. for 40 seconds using Bleaching Bath (B) shown below in place of Bleaching Bath (A) at a rate of replenishment of 25 ml/m.

| Bleaching Bath (B): | Start Liquor | Replenisher |
|---|---|---|
| Ammonium (ethylenediaminetetra-acetato)iron (III) Trihydrate (hereinafter referred to as EDTA.Fe(III)) | 100.0 g | 120.0 g |
| Disodium Ethylenediaminetetra-acetate | 10.0 g | 11.0 g |
| Ammonium Bromide | 140.0 g | 160.0 g |
| Ammonium Nitrate | 30.0 g | 35.0 g |
| Ammonia (27 wt % aq. soln.) | 6.5 ml | 4.0 ml |
| Water to make | 1.0 l | 1.0 l |
| pH | 6.0 | 5.7 |

Each of the processed samples obtained from samples which had been uniformly exposed to light to provide a grey density of 2.0 was analyzed using a fluorescent X-ray method to determine the amount of residual silver. On the other hand, each of the processed samples obtained from the unexposed samples was stored under a high temperature and high humidity condition (60° C., 70% RH) for 35 days to observe stain (the increase in minimum density of the yellow or magenta image).

The stain was expressed in terms of a difference in minimum density ($D_{min}$) between the yellow or magenta image before storage and the yellow or magenta image after storage ($\Delta D_B$ or $\Delta D_G$, respectively).

$\Delta D_B$=($D_{min}$ of yellow image after storage)−($D_{min}$ of yellow image before storage)

$\Delta D_g$=($D_{min}$ of magenta image before storage)−($D_{min}$ of magenta image after storage)

Further, the fixing bath, washing water, and stabilizing bath were examined to determine whether or not any precipitate was formed.

The results of these measurements and evaluations are shown in Table 2 below.

TABLE 1

| Run No. | Sample No. | Magenta Coupler in 6th, 7th, and 8th Layers | Bleaching Agent | Preservative of Fixer* | Remarks |
|---|---|---|---|---|---|
| 1 | 101 | ExM-5 | 1,3-DPTA.Fe(III) | sodium sulfite | Comparison |
| 2 | 102 | (1) | " | " | " |
| 3 | 101 | ExM-5 | " | acetaldehyde bisulfite addition compound | |
| 4 | 102 | (1) | " | acetaldehyde bisulfite addition compound | " |
| 5 | 101 | ExM-5 | " | bisulfite addition compound of A'-1 | Invention |
| 6 | 102 | (1) | " | bisulfite addition compound of A'-1 | " |
| 7 | 101 | ExM-5 | " | bisulfite addition compound of A'-2 | " |
| 8 | 102 | (1) | " | bisulfite addition compound of A'-2 | " |
| 9 | 101 | ExM-5 | " | bisulfite addition compound of A'-3 | " |
| 10 | 102 | (1) | " | bisulfite addition compound of A'-3 | " |
| 11 | 101 | ExM-5 | " | bisulfite addition compound of salicylaldehyde | Comparison |
| 12 | 101 | ExM-5 | " | bisulfite addition compound of sodium o-hydroxy-p-benzaldehydesulfonate | " |
| 13 | 101 | ExM-5 | EDTA.Fe(III) | sodium sulfite | Comparison |
| 14 | 102 | (1) | " | " | " |
| 15 | 101 | ExM-5 | " | acetaldehyde bisulfite addition compound | |
| 16 | 102 | (1) | " | acetaldehyde bisulfite addition compound | " |
| 17 | 101 | ExM-5 | " | bisulfite addition compound of A'-1 | Invention |
| 18 | 102 | (1) | " | bisulfite addition compound of A'-1 | " |
| 19 | 101 | ExM-5 | " | bisulfite addition compound of A'-2 | " |
| 20 | 102 | (1) | " | bisulfite addition compound of A'-2 | " |
| 21 | 101 | ExM-5 | " | bisulfite addition compound of A'-3 | " |
| 22 | 102 | (1) | " | bisulfite addition compound of A'-3 | " |
| 23 | 101 | ExM-5 | " | bisulfite addition compound of salicylaldehyde | Comparison |
| 24 | 101 | ExM-5 | " | bisulfite addition compound of sodium o-hydroxy- | " |

TABLE 1-continued

| Run No. | Sample No. | Magenta Coupler in 6th, 7th, and 8th Layers | Bleaching Agent | Preservative of Fixer* | Remarks |
|---|---|---|---|---|---|
| | | | | p-benzaldehydesulfonate | |

Note: *The preservative was added in an amount of 0.30 mol/l, except that in Run Nos. 11, 12, 23, and 24 two kinds of preservatives were added each in an amount of 0.30 mol/l.

TABLE 2

| Run No. | Sample No. | Residual Silver Amount ($\mu g/cm^2$) | $\Delta D_B$ | $\Delta D_G$ | Precipitation in Processing Solution | Remarks |
|---|---|---|---|---|---|---|
| 1 | 101 | 8.1 | +0.10 | +0.08 | observed | Comparison |
| 2 | 102 | 7.5 | +0.12 | +0.07 | " | " |
| 3 | 101 | 4.3 | +0.23 | +0.08 | slightly observed | " |
| 4 | 102 | 5.9 | +0.35 | +0.09 | slightly observed | " |
| 5 | 101 | 1.3 | +0.05 | +0.02 | not observed | Invention |
| 6 | 102 | 1.2 | +0.08 | +0.05 | " | " |
| 7 | 101 | 1.6 | +0.07 | +0.02 | " | " |
| 8 | 102 | 1.5 | +0.09 | +0.06 | " | " |
| 9 | 101 | 1.4 | +0.06 | +0.03 | " | " |
| 10 | 102 | 1.3 | +0.09 | +0.05 | " | " |
| 11 | 101 | 1.8 | +0.11 | +0.08 | slightly observed | Comparison |
| 12 | 101 | 1.7 | +0.13 | +0.09 | slightly observed | " |
| 13 | 101 | 9.0 | +0.11 | +0.13 | slightly observed | Comparison |
| 14 | 102 | 8.6 | +0.13 | +0.11 | slightly observed | " |
| 15 | 101 | 6.1 | +0.21 | +0.10 | slightly observed | " |
| 16 | 102 | 6.4 | +0.32 | +0.11 | slightly observed | " |
| 17 | 101 | 3.1 | +0.06 | +0.03 | not observed | Invention |
| 18 | 102 | 3.0 | +0.09 | +0.06 | " | " |
| 19 | 3.6 | 3.6 | +0.11 | +0.05 | " | " |
| 20 | 102 | 3.4 | +0.13 | +0.05 | " | " |
| 21 | 101 | 3.2 | +0.18 | +0.06 | " | " |
| 22 | 102 | 3.3 | +0.05 | +0.08 | " | " |
| 23 | 101 | 3.9 | +0.18 | +0.08 | slightly observed | Comparison |
| 24 | 101 | 4.1 | +0.20 | +0.10 | slightly observed | " |

As can be seen from the results in Tables 1 and 2 above, when the compound according to the present invention is used in a fixing bath, the fixing bath and the succeeding processing solutions have improved stability, and no precipitates are formed. Further, as compared with known aldehyde bisulfite addition compounds described, e.g., in JP-A-48-42733, the compound of the present invention proves effective to improve image preservability. The compound of the present invention improves the stability of a processing solution with time as compared with the acetaldehyde bisulfite addition compound. This seems to be because the amount of acetaldehyde is decreased due to oxidative deterioration or evaporation loss, whereas the compound of the present invention is not so influenced and shows excellent stability of itself. It is also seen that use of a 2-equivalent magenta coupler (ExM-5) provides an improvement in image preservability.

The reason why the washing bath and the stabilizing bath also show improved stability as well as the fixing bath to which the compound of the present invention is added is believed due to the carry-over from the fixing bath into the succeeding baths.

The compound of the present invention also surpassed the compounds proposed in JP-A-1-267540 in improving stability of processing solutions with time (i.e., reduction in tendency to form precipitates).

EXAMPLE 2

A running test was carried out in the same manner as in Run No. 1 of Example 1, except for changing the preservative of the fixing bath as shown in Table 3 below. The formation of precipitates in each processing solution of fixing, washing, and stabilizing and the increase of coloring of the fixing bath were evaluated. The results obtained are shown in Table 3 below.

TABLE 3

| Run No. | Sample No. | Bleaching Agent | Preservative of Fixer | Precipitation in Processing Solution | Coloration of Fixer | Remarks |
|---|---|---|---|---|---|---|
| 1 | 101 | 1,3-DPTA.Fe(III) | sodium sulfite | considerably observed in every processing solution | not observed | Comparison |
| 2 | " | " | acetaldehyde bisulfide | observed in washing and stabilizing | " | " |

TABLE 3-continued

| Run No. | Sample No. | Bleaching Agent | Preservative of Fixer | Precipitation in Processing Solution | Coloration of Fixer | Remarks |
|---|---|---|---|---|---|---|
| | | | addition compound | baths | | |
| 3 | " | " | salicylaldehyde bisulfite addition compound | observed in washing bath | turned to black brown | " |
| 4 | " | " | bisulfite addition compound of sodium o-hydroxy-p-benzaldehyde sulfonate | observed in washing bath | turned to black brown | " |
| 5 | " | " | bisulfite addition compound of A'-1 | not observed | not observed | Invention |
| 6 | " | " | bisulfite addition compound of A'-2 | " | " | " |
| 7 | " | " | bisulfite addition compound of A'-3 | " | " | " |
| 8 | " | " | bisulfite addition compound of A'-4 | " | " | " |
| 9 | 101 | 1,4-DPTA.Fe(III) | bisulfite addition compound of A'-5 | not observed | not | Invention |
| 10 | " | " | bisulfite addition compound of A'-6 | " | " | " |
| 11 | " | " | bisulfite addition compound of A'-7 | " | " | " |
| 12 | " | " | bisulfite addition compound of A'-8 | " | " | " |

As is apparent from the results in Table 3 above, when the preservative of the present invention is used as a preservative in a fixing bath, the fixing bath and the succeeding processing solutions exhibit improved stability with time as compared with conventional preservatives, i.e., sodium sulfite or an acetaldehyde bisulfite addition compound described, e.g., in JP-A-48-42733.

The compound of the present invention also proved to be advantageous in that precipitation in the processing solutions was reduced and the fixing bath underwent no coloration as compared with the carbonyl bisulfite addition compound described in JP-A-1-267540.

EXAMPLE 3

The following layers were coated on a cellulose triacetate film support having polyethylene laminated on both sides thereof and having colloidal silica and colloidal alumina coated on the back side thereof. The resulting multi-layer color paper was designated Sample 301.

The coating compositions were prepared as follows.

Preparation of First Layer Coating Composition

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 8.2 g of a solvent (Solv-3) to form a solution. The resulting solution was emulsified and dispersed in 185 ml of a 10% gelatin aqueous solution containing 8 ml of 10% sodium dodecylbenzenesulfonate.

Separately, a cubic silver chlorobromide emulsion having a mean grain size of 0.88 μm and a coefficient of variation of size distribution of 0.08 and locally containing 0.2 mol % of silver bromide on the grain surface was prepared, and each of blue-sensitive sensitizing dyes shown below was added thereto in an amount of $2.0\times10^{-4}$ mol/mol-Ag. The thus spectrally sensitized emulsion was then subjected to sulfur sensitization.

The above-prepared coupler dispersion and the finished emulsion were mixed to prepare a First Layer coating composition having the composition shown below.

Coating compositions for the Second to Seventh Layers were also prepared in the same manner as the First Layer coating composition.

To each coating composition, 1-oxy-3,5-dichloro-s-triazine sodium salt was added as a gelatin hardening agent.

The spectral sensitizing dyes used in each light-sensitive layer and their amounts are shown below.

Blue-Sensitive Layer:

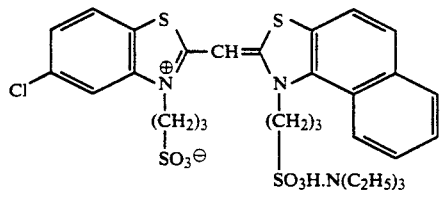

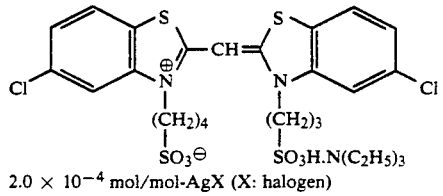

$2.0\times10^{-4}$ mol/mol-AgX (X: halogen)

-continued

Green-Sensitive Layer:

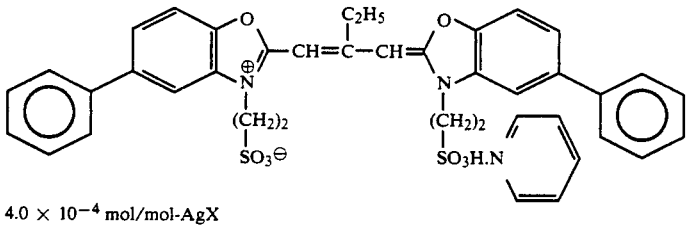

$4.0 \times 10^{-4}$ mol/mol-AgX

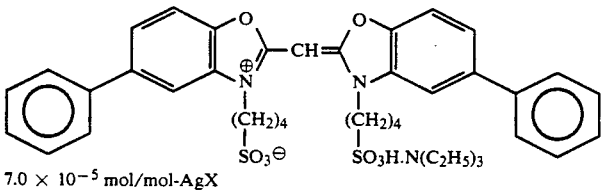

$7.0 \times 10^{-5}$ mol/mol-AgX

Red-Sensitive Emulsion Layer:

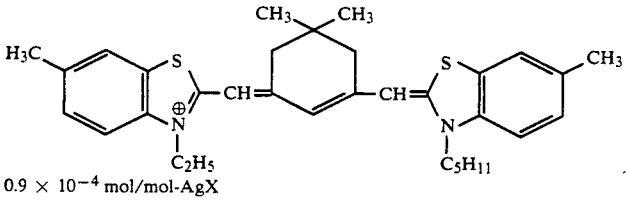

$0.9 \times 10^{-4}$ mol/mol-AgX

To the coating composition for the red-sensitive emulsion layer was further added a compound shown below in an amount of $2.6 \times 10^{-3}$ mol/mol-AgX.

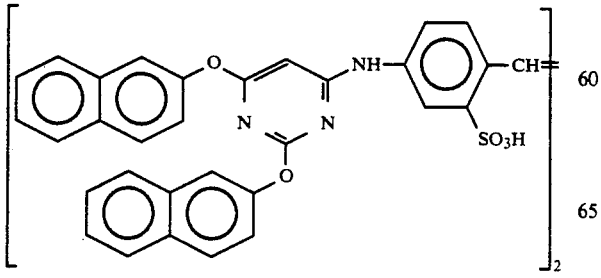

To each of the coating compositions for the blue-, green- and red-sensitive emulsion layers was further added 1-(5-methylureidophenyl)-5-mercaptotetrazole in an amount of $8.5 \times 10^{-5}$ mol, $7.7 \times 10^{-4}$ mol, and $2.5 \times 10^{-4}$ mol, respectively, per mol of AgX.

For the purpose of preventing irradiation, the following dyes were added to the emulsion layers.

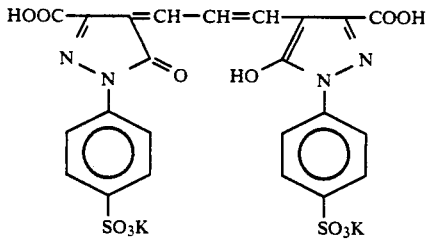

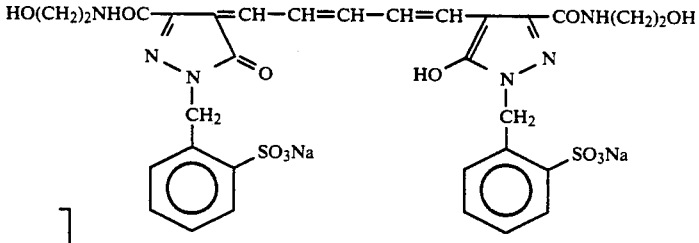

The layer structure of the multi-layer color paper is shown below. The amount of silver halide coated is shown as silver coverage (g/m$^2$).

Support

Polyethylene-laminated paper, the polyethylene layer on the side to be coated with the First Layer contained a white pigment ($TiO_2$) and a bluish dye (ultramarine).

| | Amount ($g/m^2$) |
|---|---|
| First Layer (Blue-Sensitive Layer): | |
| The above-described silver chlorobromide emulsion | 0.30 |
| Gelatin | 1.86 |
| Yellow Coupler (ExY) | 0.82 |
| Dye Image Stabilizer (Cpd-1) | 0.19 |
| Solvent (Solv-3) | 0.35 |
| Dye Image Stabilizer (Cpd-7) | 0.06 |
| Second Layer (Color Mixing Preventive Layer): | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Layer): | |
| Silver chlorobromide emulsion (cubic grains; a 1:3 (by Ag mol) mixture of an emulsion having a mean grain size of 0.55 μm and a coefficient of variation of size distribution of 0.10 and an emulsion having a mean grain size of 0.39 μm and a coefficient of variation of size distribution of 0.08, each locally containing 0.8 mol % of AgBr on the grain surface) | 0.12 |
| Gelatin | 1.24 |
| Magenta Coupler (ExM) | 0.24 |
| Dye Image Stabilizer (Cpd-3) | 0.15 |
| Dye Image Stabilizer (Cpd-8) | 0.02 |
| Dye Image Stabilizer (Cpd-9) | 0.03 |
| Solvent (Solv-2) | 0.46 |
| Fourth Layer (Ultraviolet Absorbing Layer): | |

-continued

| | Amount ($g/m^2$) |
|---|---|
| Gelatin | 1.58 |
| Ultraviolet Absorbent (UV-1) | 0.47 |
| Color Mixing Inhibitor (Cpd-5) | 0.05 |
| Solvent (Solv-5) | 0.24 |
| Fifth Layer (Red-Sensitive Layer): | |
| Silver chlorobromide emulsion (cubic grains; a 1:4 (by Ag mol) mixture of an emulsion having a mean grain size of 0.58 μm and a coefficient of variation of size distribution of 0.09 and an emulsion having a mean grain size of 0.45 μm and a coefficient of variation of size distribution of 0.11, each locally containing 0.6 mol % of AgBr on the grain surface) | 0.23 |
| Gelatin | 1.34 |
| Cyan Coupler (ExC) | 0.32 |
| Dye Image Stabilizer (Cpd-6) | 0.17 |
| Dye Image Stabilizer (Cpd-10) | 0.04 |
| Dye Image Stabilizer (Cpd-7) | 0.40 |
| Solvent (Solv-6) | 0.15 |
| Sixth Layer (Ultraviolet Absorbing Layer): | |
| Gelatin | 0.53 |
| Ultraviolet Absorbent (UV-1) | 0.16 |
| Color Mixing Inhibitor (Cpd-5) | 0.02 |
| Solvent (Solv-5) | 0.08 |
| Seventh Layer (Protective Layer): | |
| Gelatin | 1.33 |
| Acryl-Modified Copolymer of Polyvinyl Alcohol (degree of modification: 17%) | 0.17 |
| Liquid Paraffin | 0.03 |

The couplers and other photographic additives used above are shown below.

Yellow Coupler (ExY):

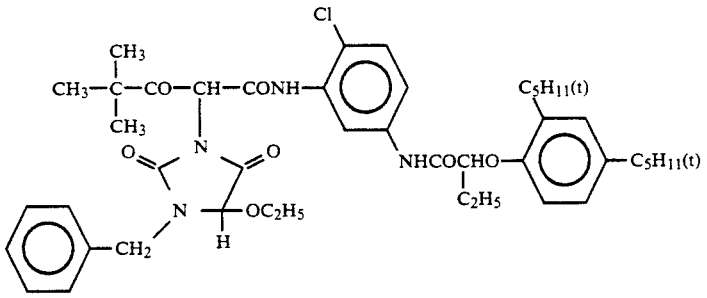

Magenta Coupler (ExM):

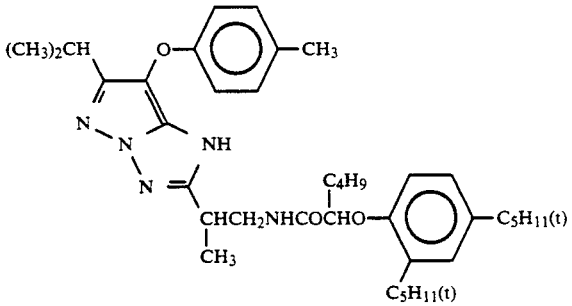

Cyan Coupler (ExC):

2:4:4 (by weight) mixture of:

-continued
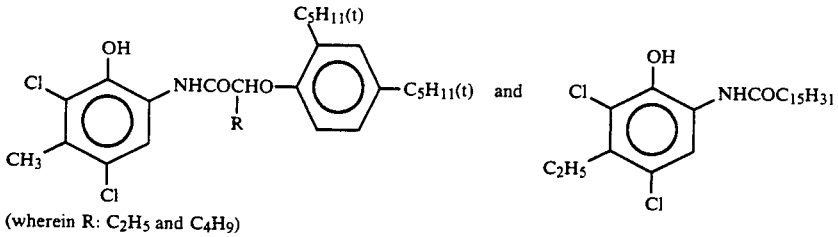
(wherein R: $C_2H_5$ and $C_4H_9$)
Dye Image Stabilizer (Cpd-1):
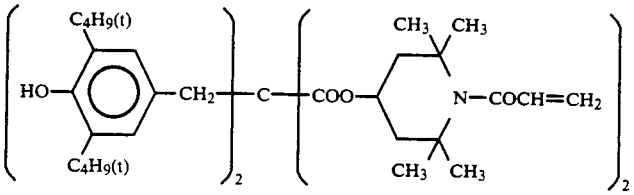
Dye Image Stabilizer (Cpd-3):
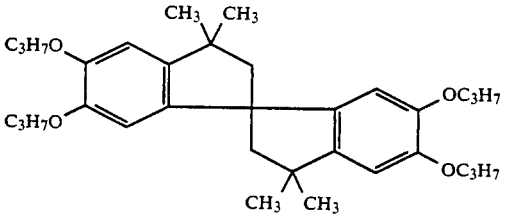
Color Mixing Inhibitor (Cpd-5):
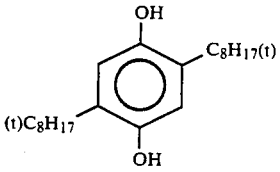
Dye Image Stabilizer (Cpd-6):
2:4:4 (by weight) mixture of:
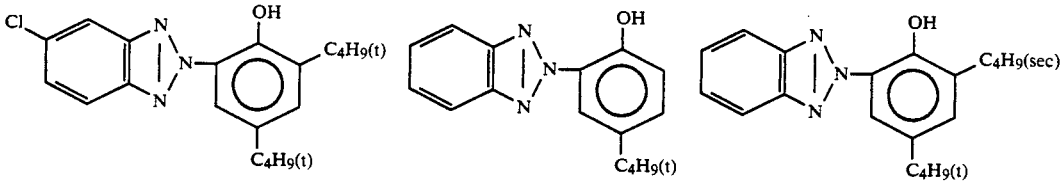
Dye Image Stabilizer (Cpd-7):
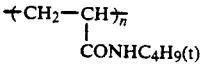
(Average Molecular Weight: 60,000)
Dye Image Stabilizer (Cpd-8):
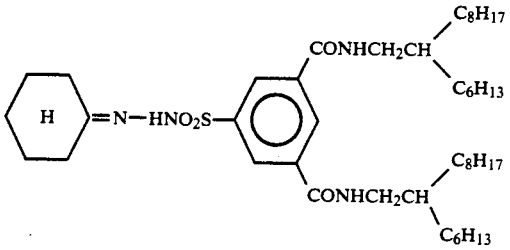
Dye Image Stabilizer (Cpd-9):

-continued
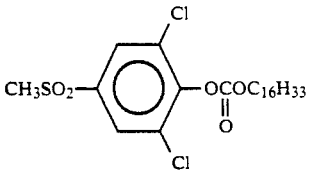
Dye Image Stabilizer (Cpd-10):
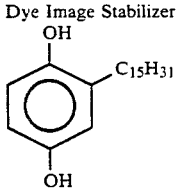
Ultraviolet Absorbent (UV-1):
4:2:4 (by weight) mixture of:
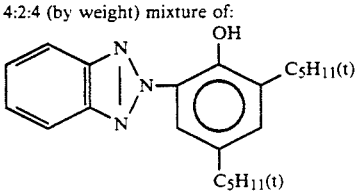
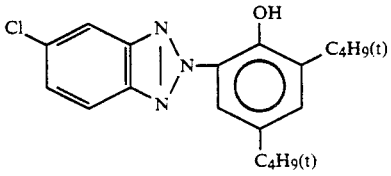
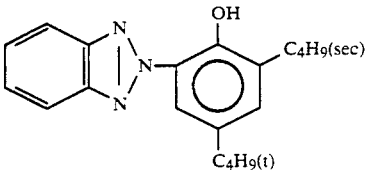
Solvent (Solv-1):
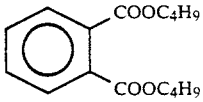
Solvent (Solv-2):
2:1 (by volume) mixture of:
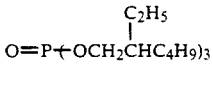
and
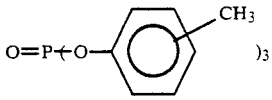
Solvent (Solv-3):
$O{=}P{+}O{-}C_9H_{19}(iso))_3$
Solvent (Solv-4):
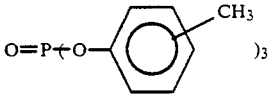
Solvent (Solv-5):
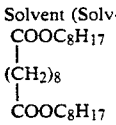
Solvent (Solv-6):
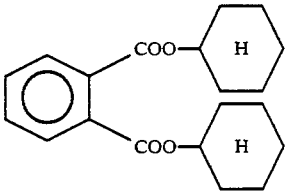

Sample 302 was prepared in the same manner as Sample 301, except for using the following layer as the

| Third Layer (Green-Sensitive Emulsion Layer): | Amount ($g/m^2$) |
|---|---|
| Silver chlorobromide emulsion (the same as in the 3rd layer of Sample 301) | 0.18 |
| Gelatin | 1.24 |
| Magenta Coupler (2) | 0.32 |
| Dye Image Stabilizer (Cpd-3) | 0.09 |
| Dye Image Stabilizer (Cpd-11) | 0.06 |
| Solvent (Solv-7) | 0.30 |
| Solvent (Solv-8) | 0.17 |

Magenta Coupler (2):

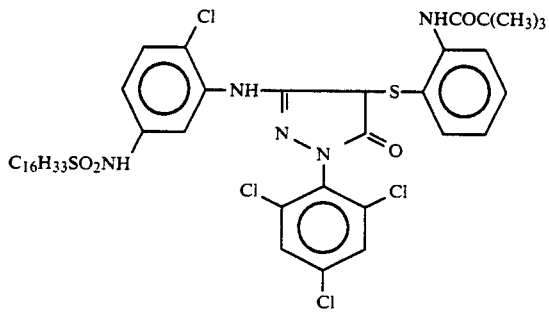

Dye Image Stabilizer (Cpd-11):

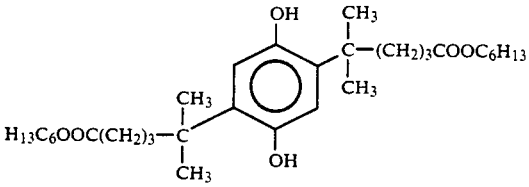

Solvent (Solv-7):

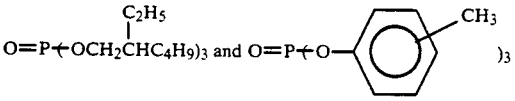

Solvent (Solv-8):

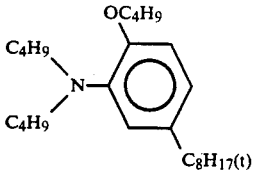

Samples 301 and 302 were cut to a fixed size and fabricated. After imagewise exposure, the samples were processed according to the following procedure using processing solutions having the following compositions using a paper processor until the total amount of the color developer replenisher reached 3 times the tank volume of the start liquor (running test). Then, a pair of samples were processed in the same manner, one pair being unexposed, and the other pair being exposed to light at an adjusted exposure amount so as to provide a grey density of 2.0.

| Processing Step | Temp. (°C.) | Time (sec) | Rate of Replenishment ($ml/m^2$)* | Tank Volume (l) |
|---|---|---|---|---|
| Color Development | 38 | 45 | 109 | 17 |
| Bleach-fixing | 35 | 45 | 30 | 17 |
| Rinsing (1)** | 35 | 30 | — | 10 |
| Rinsing (2)** | 35 | 30 | — | 10 |
| Rinsing (3)** | 35 | 30 | 364 | 10 |
| Drying | 80 | 60 | — | — |

Note:
*Amount of replenisher per $m^2$ of the light-sensitive material
**Three tank countercurrent system of from bath (3) to bath (1)

The bleach-fixing bath was replenished with a bleach-fixing bath replenisher and the rinsing bath (1) (121 ml).

The contact area of each processing solution with air was 500 $cm^2$.

| | Start Liquor | Replenisher |
|---|---|---|
| Color Developing Solution: | | |
| Water | 800 ml | 800 ml |
| Ethylenediamine-N,N,N,N-tetra-methylenephosphonic Acid | 3.0 g | 3.0 g |
| Triethanolamine | 5.0 g | 5.0 g |
| Potassium Chloride | 3.1 g | — |
| Potassium Bromide | 0.015 g | — |
| Potassium Carbonate | 25 g | 25 g |
| Hydrazinodiacetic Acid | 5.0 g | 7.0 g |
| N-Ethyl-N-(β-sulfonamidoethyl)-3-methyl-4-aminoaniline Sulfate | 5.0 g | 9.5 g |
| Fluorescent Brightening Agent ("WHITEX" produced by Sumitomo Chemical Co., Ltd.) | 1.0 g | 2.5 g |
| Water to make | 1000 ml | 1000 ml |
| pH (adjusted with potassium hydroxide) | 10.05 | 10.60 |
| Bleach-Fixing Bath: | | |
| Water | 600 ml | 150 ml |
| Ammonium Thiosulfate (700 g/l) | 100 ml | 245 ml |
| Preservative (see Table 4) | 0.2 mol | 0.5 mol |
| Ammonium Sulfite | 0.2 mol | 0.5 mol |
| Ammonium (ethylenediamine-tetraacetato)iron (III) | 55 g | 135 g |
| Ethylenediaminetetraacetic Acid | 3.0 g | 8.0 g |
| Ammonium Bromide | 30 g | 75 g |
| Nitric acid (67 wt % aq. soln..) | 27 g | 68 g |
| Water to make | 1000 ml | 1000 ml |
| pH | 5.50 | 5.20 |

Rinsing Bath (The start liquor and the replenisher had the same composition.)

Ion-exchange water having calcium and magnesium levels each reduced to 3 ppm or less.

Then, the same procedure was repeated, except for replacing the bleaching agent of the bleach-fixing bath, ammonium(ethylenediaminetetraacetato)iron (III), with an equimolar amount of ammonium (1,3-diamino-propanetetraacetato)iron (III).

Each of the processed samples obtained from those which had been uniformly exposed to light to provide a grey density of 2.0 was analyzed using a fluorescent X-ray method to determine the amount of residual silver. Further, the bleach-fixing bath and washing water were examined whether or not any precipitate was formed. The results of these measurements and evaluations are shown in Table 4 below.

TABLE 4

| Run No. | Sample No. | Bleach-Fixing Agent | Preservative of Bleach-Fixing Bath | Residual Silver (μg) | Precipitation in Bleach-Fixing Bath and Washing Water | Coloring of Bleach-Fixing Bath | Remarks |
|---|---|---|---|---|---|---|---|
| 1 | 301 | Ammonium (ethylenediamine-tetraacetato)iron (III) | — | 2.5 | observed in washing water | not observed | Comparison |
| 2 | " | Ammonium (ethylenediamine-tetraacetato)iron (III) | acetaldehyde | 3.2 | observed in washing water | " | " |
| 3 | " | Ammonium (ethylenediamine-tetraacetato)iron (III) | salicylaldehyde | 0.8 | suspended matter in washing water | turned to black brown | " |
| 4 | " | Ammonium (ethylenediamine-tetraacetato)iron (III) | o-carboxysalicyl-aldehyde | 0.7 | suspended matter in washing water | not observed | " |
| 5 | " | Ammonium (ethylenediamine-tetraacetato)iron (III) | sodium o-hydroxy-p-benzaldehydesul-fonate | 0.6 | suspended matter in washing water | turned to black brown | " |
| 6 | " | Ammonium (ethylenediamine-tetraacetato)iron (III) | Compound A'-1 | 0.2 | not observed | not observed | Invention |
| 7 | " | Ammonium (ethylenediamine-tetraacetato)iron (III) | Compound A'-2 | 0.3 | " | " | " |
| 8 | " | Ammonium (ethylenediamine-tetraacetato)iron (III) | Compound A'-3 | 0.2 | " | " | " |
| 9 | " | Ammonium (ethylenediamine-tetraacetato)iron (III) | Compound A'-4 | 0.4 | " | " | " |
| 10 | " | Ammonium (ethylenediamine-tetraacetato)iron (III) | Compound A'-5 | 0.5 | " | " | " |
| 11 | " | Ammonium (ethylenediamine-tetraacetato)iron (III) | Compound A'-6 | 0.4 | " | " | " |
| 12 | " | Ammonium (ethylenediamine-tetraacetato)iron (III) | Compound A'-7 | 0.5 | " | " | " |
| 13 | " | Ammonium (ethylenediamine-tetraacetato)iron (III) | Compound A'-8 | 0.5 | " | " | " |

As shown by the results in Table 4 above, the compounds according to the present invention, when used as a preservative in a bleach-fixing bath, improves the stability of the bleach-fixing bath and the succeeding processing solution as compared with known preservatives, such as ammonium sulfite and acetaldehyde (described in JP-A-48-42733).

When, in particular, a (1,3-propanediaminetetraacetato)iron (III) complex salt is used as a bleaching agent, not only the bleach-fixing bath but also the succeeding processing solutions undergo serious deterioration due to poor stability with time. It can be seen that the use of the compounds according to the present invention as a preservative results in a marked improvement in stability of these processing solutions, thus achieving rapid desilvering consistently with improved stability of processing solutions.

The compounds of the present invention also proved advantageous in that precipitation in the processing solutions is reduced as compared with the use of the carbonyl bisulfite addition compound described in JP-A-1-267540. It is believed that performance of carbonyl compounds as a preservative depends on its readiness to form an addition compound with bisulfite ion. The compounds of the present invention appear to be superior to salicylaldehyde in this respect and, therefore, achieve stabilization of the washing water as demonstrated above. Further, the compounds of the present invention have the advantage of preventing coloration of the bleach-fixing bath. Considering that coloration of the processing solution is a phenomenon characteristic of aldehydes having a hydroxyl group, a hydroxyl group seems to undergo a chemical reaction with a component carried over from the developing solution to form a coloring component.

Thus, the present invention is effective to improve the stability of processing solutions.

Also, in case of Sample 302, the same results as in Sample 301 can be obtained.

EXAMPLE 4
Samples 401 to 410 were prepared in the same manner as Sample 301 of Example 3, except for replacing the cyan coupler ExC used in the Fifth Layer of Sample 301 with each of Cyan Couplers C-i to C-viii and Cyan Couplers C-a and C-b shown below.
Cyan Coupler (C-i):
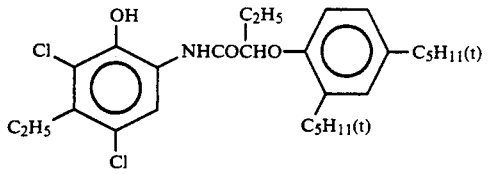
Cyan Coupler (C-ii):
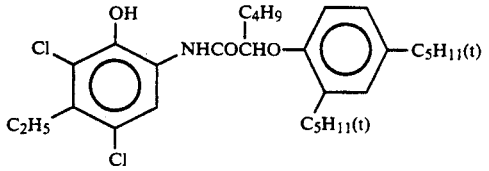
Cyan Coupler (C-iii):
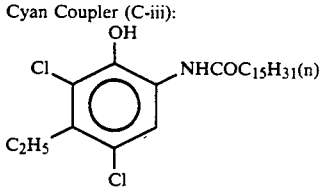
Cyan Coupler (C-iv):
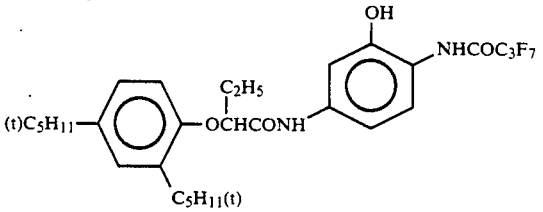
Cyan Coupler (C-v):
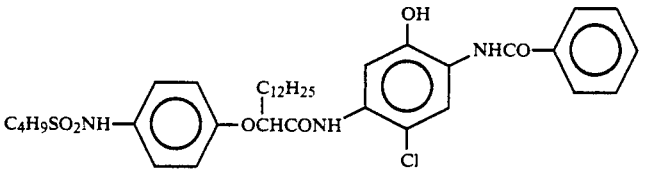
Cyan Coupler (C-vi)
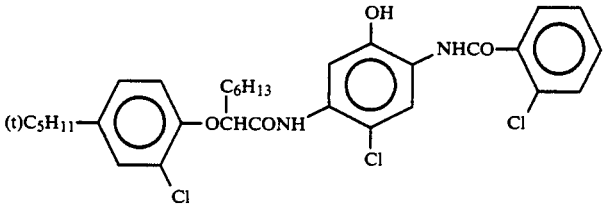
Cyan Coupler (C-vii)
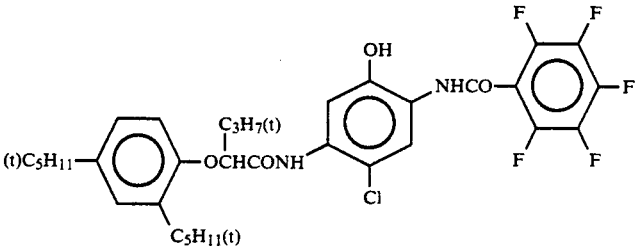

-continued

Cyan Coupler (C-viii):

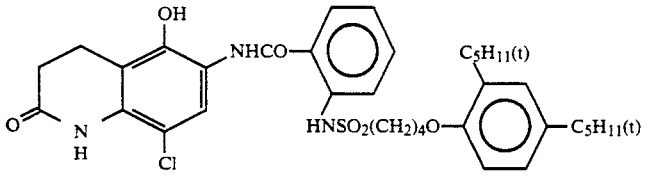

Cyan Coupler (C-a):

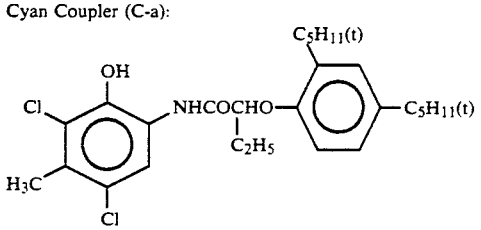

Cyan Coupler (C-b):

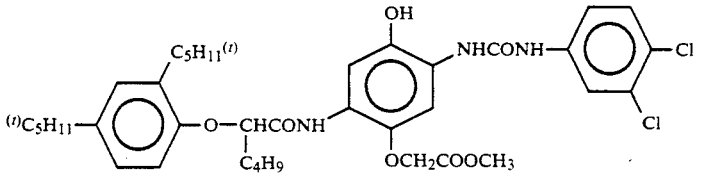

Each of Samples 401 to 410 was cut to a width of 35 mm and fabricated, and the unexposed sample was continuously processed in the same manner as in Run Nos. 3 or 7 of Example 3. The processed sample was stored under high temperature and high humidity conditions (60° C., 70% RH) for 35 days, and stain (the increase in minimum density of the yellow image) was evaluated. The stain was expressed in terms of the difference in minimum density ($D_{min}$) between the yellow image before storage and that after storage ($\Delta D_{minR}$). The results obtained are shown in Table 5 below.

TABLE 5

| Run No. | Sample No. | Cyan Coupler | Preservative of Bleach-Fixing Bath (0.4 mol/l) | $\Delta D_{minR}$ | Remarks |
|---|---|---|---|---|---|
| 1 | 401 | C-a | salicylaldehyde | +0.25 | Comparison |
| 2 | " | C-b | " | +0.23 | " |
| 3 | " | C-i | " | +0.18 | " |
| 4 | " | C-ii | " | +0.19 | " |
| 5 | " | C-iii | " | +0.20 | " |
| 6 | " | C-iv | " | +0.17 | " |
| 7 | " | C-v | " | +0.18 | " |
| 8 | " | C-vi | " | +0.17 | " |
| 9 | " | C-vii | " | +0.19 | " |
| 10 | " | C-viii | " | +0.20 | " |
| 11 | " | C-a | Compound A'-3 | +0.10 | Invention |
| 12 | " | C-b | " | +0.13 | " |
| 13 | " | C-i | " | +0.05 | " |
| 14 | " | C-ii | " | +0.06 | " |
| 15 | " | C-iii | " | +0.05 | " |
| 16 | " | C-iv | " | +0.08 | " |
| 17 | " | C-v | " | +0.07 | " |
| 18 | " | C-vi | " | +0.08 | " |
| 19 | " | C-vii | " | +0.05 | " |
| 20 | " | C-viii | " | +0.06 | " |

As shown by the results in Table 5 above, when the bleach-fixing is conducted with a processing solution containing a compound of the present invention, the resulting image has excellent preservability as compared with a processing solution containing the conventional carbonyl bisulfite addition compound as described in JP-A-1-267540.

EXAMPLE 5

The following First to Fourteenth Layers were coated on a 100 μm thick paper support having polyethylene laminated on both sides thereof, and the following Fifteenth to Sixteenth Layers were coated on the opposite side of the support. The polyethylene layer on the First Layer side of the support contained titanium oxide as a white pigment and a trace amount of ultramarine as a bluish dye. The chromaticity of the surface of the support was 88.0, −0.20, and −0.75 according to an L*a*b* colorimetric system. The resulting sample was designated Sample 501.

The silver bromide emulsions used in the light-sensitive emulsion layers except for the Fourteenth Layer were prepared according to the following process.

A potassium bromide aqueous solution and a silver nitrate aqueous solution were simultaneously added to a gelatin aqueous solution at 75° C. over a 15 minute period under vigorous stirring to obtain an octahedral silver bromide emulsion having a mean grain size of 0.40 μm. To the emulsion were added 0.3 g of 3,4-dimethyl-1,3-thiazolin-2-thione, 6 mg of sodium thiosulfate, and 7 mg of chloroauric acid tetrahydrate each per mol of silver, and the emulsion was heated at 75° C. for 80 minutes for chemical sensitization. The thus obtained silver bromide grains were allowed to grow as a core in the same precipitation-inducing environment as described above to ultimately obtain an octahedral monodispersed core/shell silver bromide emulsion having a mean grain size of 0.7 μm and a coefficient of size variation of about 10%. To the emulsion were added 1.5 mg of sodium thiosulfate and 1.5 mg of chloroauric acid tetrahydrate each per mol of silver, followed by heating at 60° C. for 60 minutes for chemical sensitization. An internal latent image type silver halide emulsion was thus obtained. Further, the mixing ratio of each components is by weight.

In the Fourteenth Layer, a Lippmann emulsion which had not been subjected to surface chemical sensitization was used.

| | |
|---|---|
| First Layer (Antihalation Layer): | |
| Black Colloidal Silver | 0.10 g-Ag/m$^2$ |
| Gelatin | 0.70 g/m$^2$ |
| Second Layer (Intermediate Layer): | |
| Gelatin | 0.70 g/m$^2$ |
| Third Layer (Slow-Speed Red-Sensitive Layer): | |
| Silver bromide emulsion (octahedral; mean grain size: 0.25 μm; size distribution (coefficient of size variation): 8%) spectrally sensitized with red sensitizing dyes (ExS-1, 2, and 3) | 0.04 g-Ag/m$^2$ |
| Silver chlorobromide emulsion (octahedral; AgCl: 5 mol %; mean grain size: 0.40 μm; size distribution: 10%) spectrally sensitized with red sensitizing dyes (ExS-1, ExS-2, and ExS-3) | 0.08 g-Ag/m$^2$ |
| Gelatin | 1.00 g/m$^2$ |
| Cyan Coupler (ExC-1:ExC-2 = 1:1) | 0.30 g/m$^2$ |
| Discoloration Inhibitor (Cpd-1:Cpd-2:Cpd-3:Cpd-4 = 1:1:1:1) | 0.18 g/m$^2$ |
| Stain Inhibitor (Cpd-5) | 0.003 g/m$^2$ |
| Coupler Dispersing Medium (Cpd-6) | 0.03 g/m$^2$ |
| Coupler Solvent (Solv-1:Solv-2:Solv-3 = 1:1:1) | 0.12 g/m$^2$ |
| Fourth Layer (High-Speed Red-Sensitive Layer): | |
| Silver bromide emulsion (octahedral; mean grain size: 0.60 μm; size distribution: 15%) spectrally sensitized with red sensitizing dyes (ExS-1, ExS-2, and ExS-3) | 0.14 g-Ag/m$^2$ |
| Gelatin | 1.00 g/m$^2$ |
| Cyan Coupler (ExC-1:ExC-2 = 1:1) | 0.30 g/m$^2$ |
| Discoloration Inhibitor (Cpd-1:Cpd-2:Cpd-3:Cpd-4 = 1:1:1:1) | 0.18 g/m$^2$ |
| Coupler Dispersing Medium (Cpd-6) | 0.03 g/m$^2$ |
| Coupler Solvent (Solv-1:Solv-2:Solv-3 = 1:1:1) | 0.12 g/m$^2$ |
| Fifth Layer (Intermediate Layer): | |
| Gelatin | 1.00 g/m$^2$ |
| Color Mixing Inhibitor (Cpd-7) | 0.08 g/m$^2$ |
| Color Mixing Inhibitor solvent (Solv-4:Solv-5 = 1:1) | 0.16 g/m$^2$ |
| Polymer latex (Cpd-8) | 0.10 g/m$^2$ |
| Sixth Layer (Slow-Speed Green-Sensitive Layer): | |
| Silver bromide emulsion (octahedral; mean grain size: 0.25 μm; size distribution: 8%) spectrally sensitized with green sensitizing dye (ExS-4) | 0.04 g-Ag/m$^2$ |
| Silver chlorobromide emulsion (octahedral; silver chloride: 5 mol %; mean grain size: 0.40 μm; size distribution: 10%) spectrally sensitized with green sensitizing dye (ExS-4) | 0.06 g-Ag/m$^2$ |
| Gelatin | 0.80 g/m$^2$ |
| Magenta Coupler (ExM-1:ExM-2:ExM-3 = 1:1:1) | 0.10 g/m$^2$ |
| Discoloration Inhibitor (Cpd-9:Cpd-26 = 1:1) | 0.15 g/m$^2$ |
| Stain Inhibitor (Cpd-10:Cpd-11:Cpd-12:Cpd-13 = 10:7:7:1) | 0.025 g/m$^2$ |
| Coupler Dispersing Medium (Cpd-6) | 0.05 g/m$^2$ |
| Coupler Solvent (Solv-4:Solv-6 = 1:1) | 0.15 g/m$^2$ |
| Seventh Layer (High-Speed Green-Sensitive Layer): | |
| Silver bromide emulsion (octahedral; mean grain size: 0.65 μm; size distribution: 16%) spectrally sensitized with green sensitizing dye (ExS-4) | 0.10 g-Ag/m$^2$ |
| Gelatin | 0.80 g/m$^2$ |
| Magenta Coupler (ExM-1:ExM-2:ExM-3 = 1:1:1) | 0.10 g/m$^2$ |
| Discoloration Inhibitor (Cpd-9:Cpd-26 = 1:1) | 0.15 g/m$^2$ |
| Stain Inhibitor (Cpd-10:Cpd-11:Cpd-12:Cpd-13 = 10:7:7:1) | 0.025 g/m$^2$ |
| Coupler Dispersing medium (Cpd-6) | 0.05 g/m$^2$ |
| Coupler Solvent (Solv-4:Solv-6 = 1:1) | 0.15 g/m$^2$ |

-continued

| | |
|---|---|
| Eighth Layer (Intermediate Layer): | |
| The same as the Fifth Layer. | |
| Ninth Layer (Yellow Filter Layer): | |
| Yellow Colloidal Silver | 0.12 g/m$^2$ |
| Gelatin | 0.07 g/m$^2$ |
| Color Mixing Inhibitor (Cpd-7) | 0.03 g/m$^2$ |
| Color Mixing Inhibitor Solvent (Solv-4:Solv-5 = 1:1) | 0.10 g/m$^2$ |
| Polymer Latex (Cpd-8) | 0.07 g/m$^2$ |
| Tenth Layer (Intermediate Layer): | |
| The same as the Fifth Layer. | |
| Eleventh Layer (Slow-Speed Blue-Sensitive Layer): | |
| Silver bromide emulsion (octahedral; mean grain size: 0.40 μm; size distribution: 8%) spectrally sensitized with blue sensitizing dyes (ExS-5 and ExS-6) | 0.07 g-Ag/m$^2$ |
| Silver chlorobromide emulsion (octahedral; silver chloride: 8 mol %; mean grain size: 0.60 μm; size distribution: 11%) spectrally sensitized with blue sensitizing dyes (ExS-5 and ExS-6) | 0.14 g-Ag/m$^2$ |
| Gelatin | 0.80 g/m$^2$ |
| Yellow Coupler (ExY-1:ExY-2 = 1:1) | 0.35 g/m$^2$ |
| Discoloration Inhibitor (Cpd-14) | 0.10 g/m$^2$ |
| Stain Inhibitor (Cpd-5:Cpd-15 = 1:5) | 0.007 g/m$^2$ |
| Coupler Dispersing medium (Cpd-6) | 0.05 g/m$^2$ |
| Coupler Solvent (Solv-2) | 0.10 g/m$^2$ |
| Twelfth Layer (High-Speed Blue-Sensitive Layer): | |
| Silver bromide emulsion (octahedral; mean grain size: 0.85 μm; size distribution: 18%) spectrally sensitized with blue sensitizing dyes (ExS-5 and ExS-6) | 0.15 g-Ag/m$^2$ |
| Gelatin | 0.60 g/m$^2$ |
| Yellow Coupler (ExY-1:ExY-2 = 1:1) | 0.30 g/m$^2$ |
| Discoloration Inhibitor (Cpd-14) | 0.10 g/m$^2$ |
| Stain Inhibitor (Cpd-5:Cpd-15 = 1:5) | 0.007 g/m$^2$ |
| Coupler Dispersing Medium (Cpd-6) | 0.05 g/m$^2$ |
| Coupler Solvent (Solv-2) | 0.10 g/m$^2$ |
| Thirteenth Layer (Ultraviolet Absorbing Layer): | |
| Gelatin | 1.00 g/m$^2$ |
| Ultraviolet Absorbent (Cpd-2:Cpd-4:Cpd-16 = 1:1:1) | 0.50 g/m$^2$ |
| Color Mixing Inhibitor (Cpd-7:Cpd-17 = 1:1) | 0.03 g/m$^2$ |
| Dispersing Medium (Cpd-6) | 0.02 g/m$^2$ |
| Ultraviolet Absorbent Solvent (Solv-2:Solv-7 = 1:1) | 0.08 g/m$^2$ |
| Anti-Irradiation Dye (Cpd-18:Cpd-19:Cpd-20:Cpd-21:Cpd-27 = 10:10:13:15:20) | 0.05 g/m$^2$ |
| Fourteenth Layer (Protective Layer): | |
| Fine silver chlorobromide emulsion (silver chloride: 97 mol %; mean grain size: 0.1 μm) | 0.03 g-Ag/m$^2$ |
| Acryl-Modified Copolymer of Polyvinyl Alcohol | 0.01 g/m$^2$ |
| Polymethyl Methacrylate Particles (mean particle size: 2.4 μm):silicon oxide (mean particle size: 5 μm) = 1:1 | 0.05 g/m$^2$ |
| Gelatin | 1.80 g/m$^2$ |
| Gelatin Hardening Agent (H-1:H-2 = 1:1) | 0.18 g/m$^2$ |
| Fifteenth Layer (Backing Layer): | |
| Gelatin | 2.50 g/m$^2$ |
| Ultraviolet Absorbent (Cpd-2:Cpd-4:Cpd-16 = 1:1:1) | 0.50 g/m$^2$ |
| Dye (Cpd-18:Cpd-19:Cpd-20:Cpd-21:Cpd-27 = 1:1:1:1:1) | 0.06 g/m$^2$ |
| Sixteenth Layer (Back Protective Layer): | |
| Polymethyl Methacrylate Particles (mean particle size: 2.4 μm):silicon oxide (mean particle size: 5 μm) = 1:1 | 0.05 g/m$^2$ |
| Gelatin | 2.00 g/m$^2$ |
| Gelatin Hardening Agent (H-1:H-2 = 1:1) | 0.14 g/m$^2$ |

Each of the above light-sensitive layers further contained $1\times10^{-3}$% of a nucleating agent (ExZK-1), $1\times10^{-2}$% of a nucleating agent (ExZK-2), and $1\times10^{-2}$% of a nucleation accelerator (Cpd-22) each based on the silver halide. Further, each layer contained Alkanol XC (product of E. I. Du Pont) and a sodium alkylbenzenesulfonate as emulsification and dispersion aids, and a succinic ester and Magefac F-120 (product of Dai-nippon Ink) as coating aids. Furthermore, the silver halide- or colloidal silver-containing layer contained stabilizers (Cpd-23, Cpd-24, and Cpd-25).

The additives used in the preparation of Sample 501 are shown below.

ExS-1

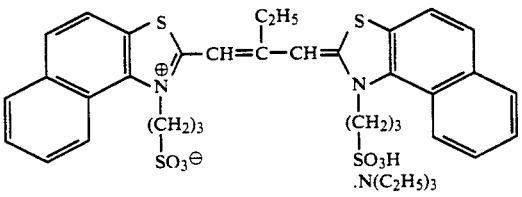

ExS-2

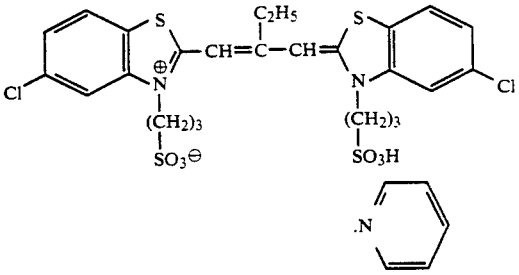

ExS-3

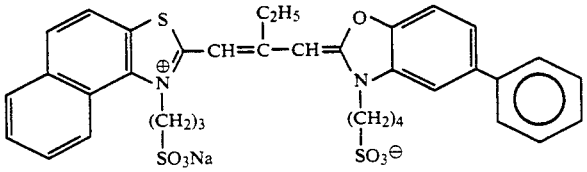

ExS-4

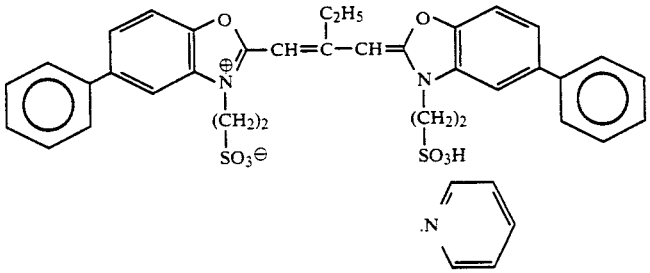

ExS-5

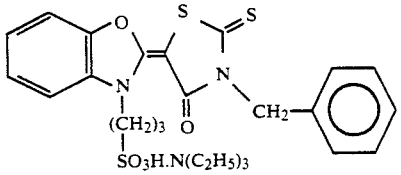

ExS-6

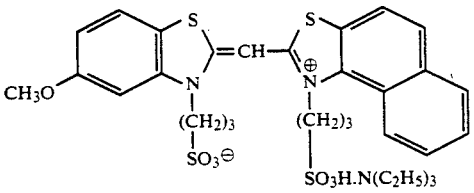

Cpd-1

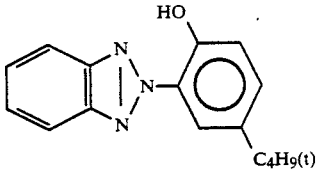

Cpd-2

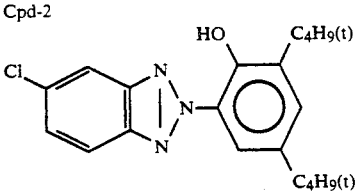

Cpd-3

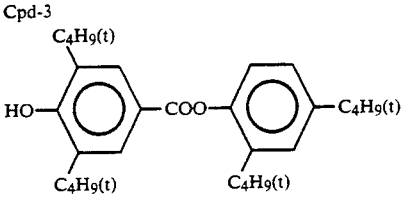

Cpd-4

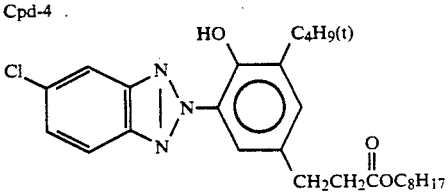

Cpd-5

Cpd-6

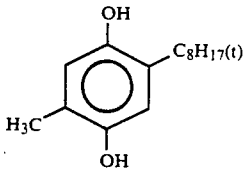
Cpd-7
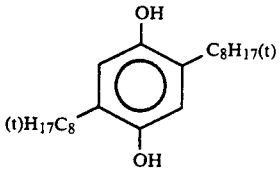
Cpd-9
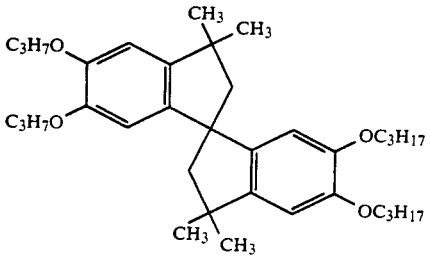
Cpd-11
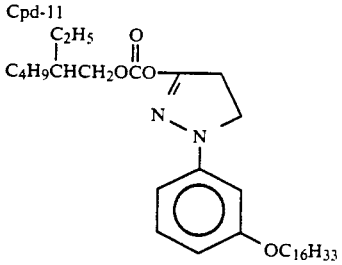
Cpd-13
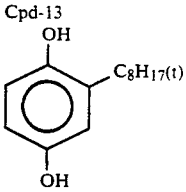
Cpd-15
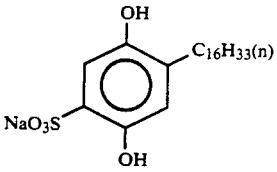
Cpd-17
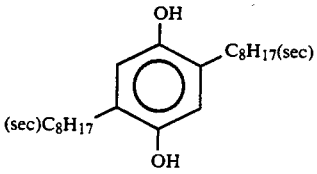
Cpd-19
-continued
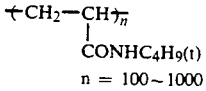
Cpd-8
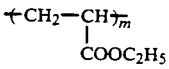
Cpd-10
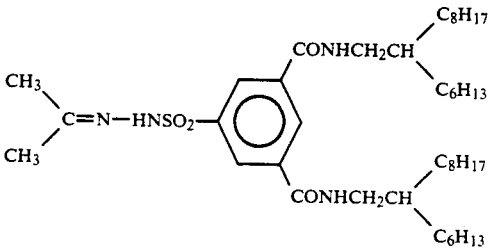
Cpd-12
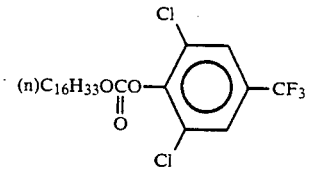
Cpd-14
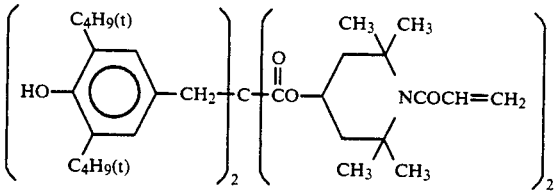
Cpd-16
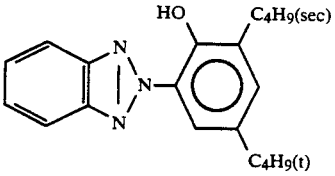
Cpd-18
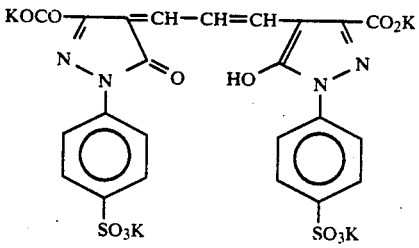

-continued
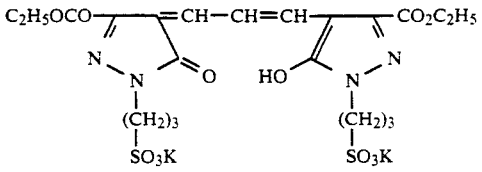
Cpd-20
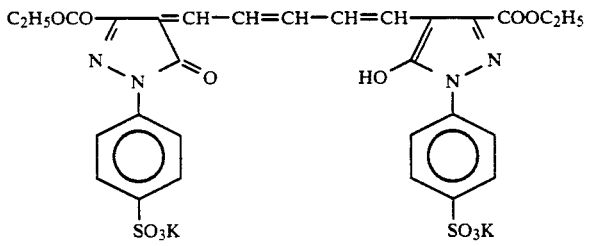
Cpd-21
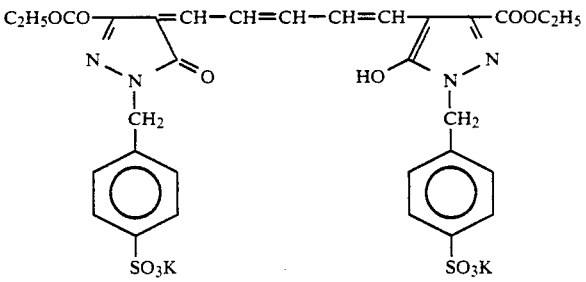
Cpd-22
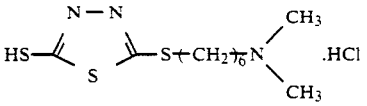
Cpd-23
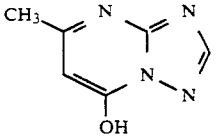
Cpd-24
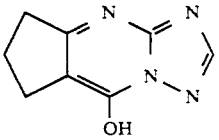
Cpd-25
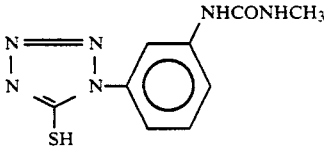
Cpd-26
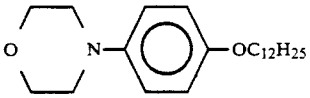
Cpd-27
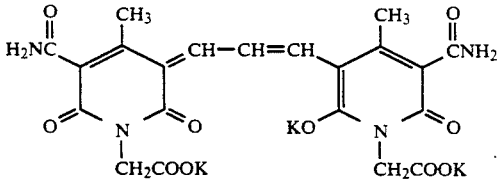
ExC-1
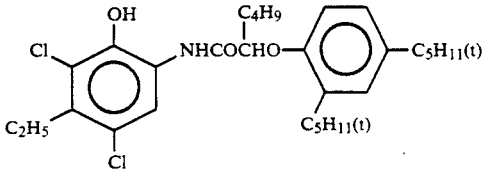
ExC-2

-continued
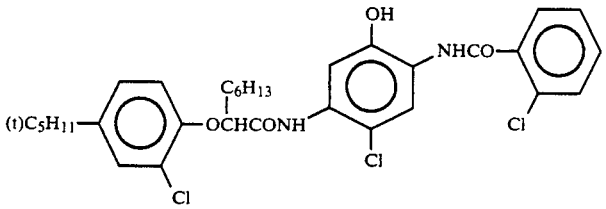
ExM-1
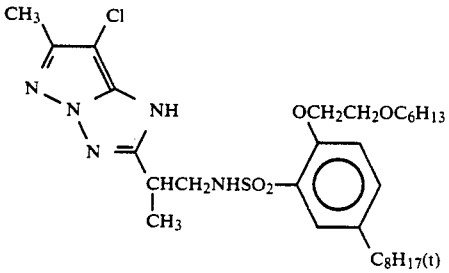
ExM-2
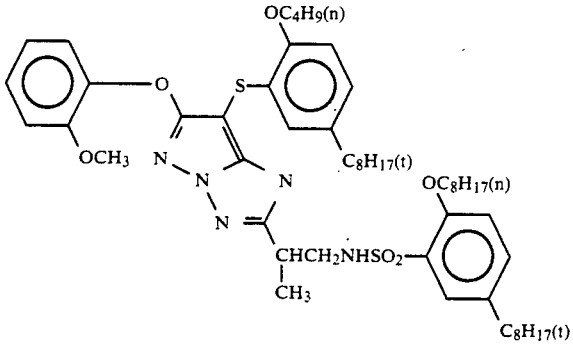
ExM-3
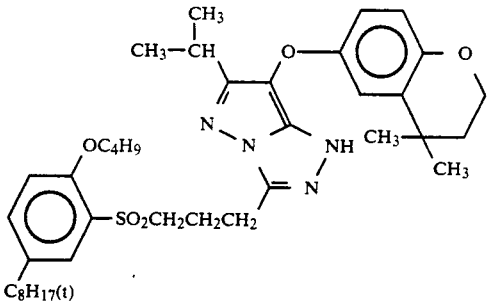
ExY-1
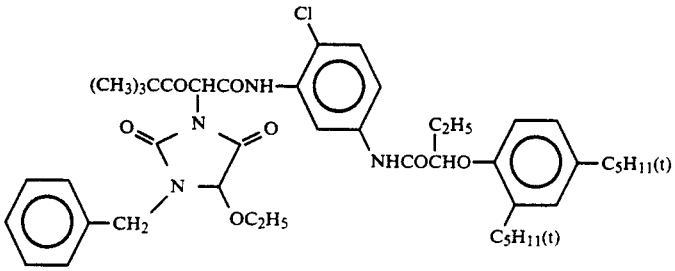
ExY-2

-continued

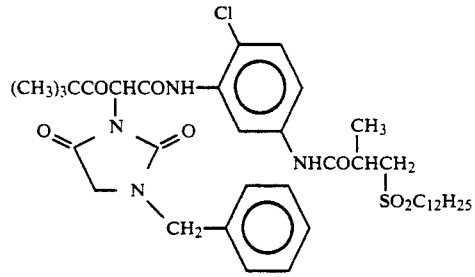

Solv-1: Di(2-ethylhexyl) Sebacate
Solv-2: Trinonyl Phosphate
Solv-3: Di(3-methylhexyl) Phthalate
Solv-4: Tricresyl Phosphate
Solv-5: Dibutyl Phthalate
Solv-6: Trioctyl Phosphate
Solv-7: Di(2-ethylhexyl) Phthalate
H-1: 1,2-bis(Vinylsulfonylacetamido)ethane
H-2: 4,6-Dichloro-2-hydroxy-1,3,5-triazine Na salt
ExZK-1: 7-(3-Ethoxythiocarbonylaminobenzamido)-9-methyl-10-propargyl-1,2,3,4-tetrahydroacridinium trifluoromethanesulfonate
ExZK-2: 2-[4-{3-[3-{3-[5-{3-[2-Chloro-5-(1-dodecyloxycarbonylethoxycarbonyl)phenylcarbamoyl]-4-hydroxy-1-naphthylthio}tetrazol-1-yl]phenyl-}ureido]benzenesulfonamido}phenyl]-1-formylhydrazine Sample 501 was cut and imagewise exposed and continuously processed according to the following processing procedure with an automatic developing machine until the total amount of a color developer replenisher reached 3 times the volume of the tank. Then, an unexposed sample and a sample uniformly exposed to light at an exposure amount adjusted to provide a grey density of 2.0 were processed for evaluation.

| Processing Step | Temp. (°C.) | Time (sec) | Rate of Replenishment (ml/m$^2$) | Tank Volume (l) |
|---|---|---|---|---|
| Color Development | 38 | 135 | 300 | 15 |
| Bleach-Fixing | 33 | 40 | 300 | 3 |
| Washing (1) | 33 | 40 | — | 3 |
| Washing (2) | 33 | 40 | 320 | 3 |
| Drying | 80 | 30 | — | — |

The washing bath was replenished with a countercurrent system, in which bath (2) was replenished while introducing the overflow therefrom into bath (1). The carry-over from the bleach-fixing bath into the washing bath (1) was 35 ml/m$^2$, and the amount of the washing water replenisher was 9.1 times the carry-over of the bleach-fixing bath.

The contact area of each processing solution with air was 75 cm$^2$.

The processing solutions used had the following compositions.

| | Start liquor | Replenisher |
|---|---|---|
| Color Developing Solution: | | |
| Ethylenediaminetetrakis-methylenephosphonic Acid | 1.5 g | 1.5 g |
| Diethylene Glycol | 10 ml | 10 ml |
| Benzyl Alcohol | 12.0 ml | 14.4 ml |

-continued

| | Start liquor | Replenisher |
|---|---|---|
| Potassium Bromide | 0.70 g | — |
| Benzotriazole | 0.003 g | 0.004 g |
| Sodium Sulfite | 2.4 g | 2.9 g |
| Glucose | 2.5 g | 3.0 g |
| N,N-bis(Carboxymethyl)hydrazine | 4.0 g | 4.8 g |
| Triethanolamine | 6.0 g | 7.2 g |
| N-Ethyl-N-(β-methanesulfonamidoethyl)-3-methyl-4-aminoaniline Sulfate | 6.0 g | 7.2 g |
| Potassium Carbonate | 30.0 g | 25.0 g |
| Fluorescent Brightening Agent ("WHITEX" produced by Sumitomo Chemical Co., Ltd.) | 1.0 g | 1.2 g |
| Water to make | 1000 ml | 1000 ml |
| pH (25° C.) | 10.25 | 10.85 |
| Bleach-Fixing Bath: | | |
| (The start liquor and the replenisher had the same composition.) | | |
| Disodium Ethylenediaminetetraacetate Dihydrate | | 4.0 g |
| Ammonium (ethylenediaminetetraacetato)-iron(III) Dihydrate | | 70.0 g |
| Ammonium Thiosulfate (700 g/l) | | 180 ml |
| Sodium p-Toluenesulfinate | | 20.0 g |
| Preservative (see Table 6) | | 0.3 mol |
| Ammonium Sulfite | | 0.3 mol |
| 5-Mercapto-1,3,4-triazole | | 0.5 g |
| Ammonium Nitrate | | 10.0 g |
| Water to make | | 1000 ml |
| pH (25° C.) | | 6.20 |

Washing Water (The start liquor and the replenisher had the same composition.)

Tap water was passed through a mixed bed column packed with an H type strongly acidic cation-exchange resin "Amberlite IR-120B" produced by Rohm & Haas) and an OH type anion-exchange resin ("Amberlite IRA-400" produced by Rohm & Haas) to decrease the calcium and magnesium each to 3 mg/l or less. To the deionized water were added 20 mg/l of dichlorinated sodium isocyanurate and 1.5 g/ of sodium nitrate. The resulting washing water had a pH between 6.5 and 7.5.

The processed sample obtained from the exposed sample was analyzed using a fluorescent X-ray method to determine the amount of residual silver.

The density of the cyan image was measured, and the sample was soaked in the bleaching bath used in Run No. 7 of Example 1 for 30 minutes, washed with water for 1 minute and dried. The color density of the thus treated cyan image was measured to evaluate color restoration insufficiency ($\Delta D_R$=(cyan density after re-bleaching)−(cyan density before re-bleaching)).

Further, the formation of a precipitate in the bleach-fixing bath and the washing water was determined.

The results obtained are shown in Table 6 below.

TABLE 6

| Run No. | Sample No. | Preservative of Bleach-Fixing Bath (μg/cm²) | Residual Silver | $\Delta D_R$ | Precipitation in Bleach-Fixing Bath and Washing Water | Coloring of Bleach-Fixing Bath | Remarks |
|---|---|---|---|---|---|---|---|
| 1 | 501 | — | 5.7 | +0.21 | slight turbidity was observed in washing water | not observed | Comparison |
| 2 | " | Compound A'-1 | 0.8 | +0.01 | not observed | " | Invention |
| 3 | " | Compound A'-2 | 0.6 | 0.00 | " | " | " |
| 4 | " | Compound A'-3 | 0.5 | +0.02 | " | " | " |
| 5 | " | Compound A'-4 | 0.9 | +0.01 | " | " | " |
| 6 | " | Compound A'-5 | 1.8 | +0.09 | " | " | " |
| 7 | " | Compound A'-6 | 2.0 | +0.08 | " | " | " |
| 8 | " | Compound A'-7 | 1.5 | +0.09 | " | " | " |
| 9 | " | Compound A'-8 | 1.7 | +0.07 | " | " | " |
| 10 | " | Compound A'-9 | 0.4 | +0.02 | " | " | " |
| 11 | " | Compound A'-10 | 0.6 | +0.03 | " | " | " |
| 12 | " | salicylaldehyde | 2.1 | +0.13 | " | turned to black brown | Comparison |
| 13 | " | " | 2.5 | +0.11 | " | turned to black brown | " |

As can be seen from the results in Table 6 above where processing is carried out with an automatic developing machine having a contact area between each processing solution and air as small as 75 cm², when a bleach-fixing bath containing ammonium sulfite conventionally used as a preservative is employed, satisfactory color restoration cannot be achieved, and the developed cyan dye becomes a leuco dye causing a reduction in color density. The color restoration insufficiency can be eliminated using the compound according to the present invention. This effect was particularly marked in using Compounds A'-1, A'-2, A'-3, A'-9, and A'-10.

Further, the compounds of the present invention proved to have the advantage of preventing coloration of the bleach-fixing bath as compared with a conventionally used carbonyl bisulfite addition compound (described in JP-A-1-267540).

EXAMPLE 6

A paper support laminated with polyethylene (on both sides) was coated with the following layers to prepare a multi-layer color paper. The coating compositions were prepared as follows.

To a mixture of 10.2 g of a yellow coupler (ExY-1), 9.1 g of a yellow coupler (ExY-2), and 4.4 g of a dye image stabilizer (Cpd-1) were added 27.2 ml of ethyl acetate and 7.7 ml (8.0 g) of a high-boiling point solvent (Solv-1) to prepare a solution. The solution was emulsified and dispersed in 185 ml of a 10 wt % gelatin aqueous solution containing 8 ml of 10 wt % sodium dodecylbenzenesulfonate. The resulting coupler dispersion was mixed with silver chlorobromide emulsions (EM1 and EM2) shown below, and the gelatin concentration of the mixture was adjusted to obtain a coating composition for a First Layer having the following composition.

Coating compositions for the Second to Seventh Layers were prepared in the same manner as described above.

Each layer contained the sodium salt of 1-oxy-3,5-dichloro-s-triazine as a gelatin hardening agent and a thickener (Cpd-2).

Layer Structure

Support

Polyethylene-laminated paper (the polyethylene layer on the First Layer side contained titanium oxide as a white pigment and a bluish dye)

| | |
|---|---|
| First Layer (Blue-Sensitive Layer): | |
| Mono-dispersed silver chlorobromide emulsion (EM1) spectrally sensitized with sensitizing dye (ExS-1) | 0.13 g-Ag/m² |
| Mono-dispersed silver chlorobromide emulsion (EM2) spectrally sensitized with sensitizing dye (ExS-1) | 0.13 g-Ag/m² |
| Gelatin | 1.86 g/m² |
| Yellow Coupler (ExY-1) | 0.44 g/m² |
| Yellow Coupler (ExY-2) | 0.39 g/m² |
| Dye Image Stabilizer (Cpd-1) | 0.19 g/m² |
| Solvent (Solv-1) | 0.35 g/m² |
| Second Layer (Color Mixing Preventive Layer): | |
| Gelatin | 0.99 g/m² |
| Color Mixing Inhibitor (Cpd-3) | 0.08 g/m² |
| Third Layer (Green-Sensitive Layer): | |
| Mono-dispersed silver chlorobromide emulsion (EM3) spectrally sensitized with sensitizing dyes (ExS-2, ExS-3) | 0.05 g-Ag/m² |
| Mono-dispersed silver chlorobromide emulsion (EM4) spectrally sensitized with sensitizing dyes (ExS-2, ExS-3) | 0.11 g-Ag/m² |
| Gelatin | 1.80 g/m² |
| Magenta Coupler (ExM-1) | 0.39 g/m² |
| Dye Image Stabilizer (Cpd-4) | 0.20 g/m² |
| Dye Image Stabilizer (Cpd-5) | 0.02 g/m² |
| Dye Image Stabilizer (Cpd-6) | 0.03 g/m² |
| Solvent (Solv-2) | 0.12 g/m² |
| Solvent (Solv-3) | 0.25 g/m² |
| Fourth Layer (Ultraviolet Absorbing Layer): | |
| Gelatin | 1.60 g/m² |
| Ultraviolet Absorbent (Cpd-7:Cpd-8:Cpd-9 = 3:2:6 by weight) | 0.70 g/m² |
| Color Mixing Inhibitor (Cpd-10) | 0.05 g/m² |
| Solvent (Solv-4) | 0.27 g/m² |
| Fifth Layer (Red-Sensitive Layer): | |
| Mono-dispersed silver chlorobromide emulsion (EM5) spectrally sensitized with sensitizing dyes (ExS-4, ExS-5) | 0.07 g-Ag/m² |
| Mono-dispersed silver chlorobromide emulsion (EM6) spectrally sensitized with sensitizing dyes (ExS-4, ExS-5) | 0.16 g-Ag/m² |
| Gelatin | 0.92 g/m² |
| Cyan Coupler (ExC-1) | 0.32 g/m² |
| Dye Image Stabilizer (Cpd-8:Cpd-9:Cpd-12 = 3:4:2 by weight) | 0.17 g/m² |
| Dispersion Polymer (Cpd-11) | 0.28 g/m² |
| Solvent (Solv-2) | 0.20 g/m² |
| Sixth Layer (Ultraviolet Absorbing Layer): | |
| Gelatin | 0.54 g/m² |
| Ultraviolet Absorbent (Cpd-7:Cpd-9:Cpd-12 = 1:5:3 by weight) | 0.21 g/m² |
| Solvent (Solv-2) | 0.08 g/m² |
| Seventh Layer (Protective Layer): | |
| Gelatin | 1.33 g/m² |
| Acryl-Modified Copolymer of Polyvinyl | 0.17 g/m² |

-continued

| | |
|---|---|
| Alcohol (degree of modification: 17%) | |
| Liquid Paraffin | 0.03 g/m$^2$ |
| Cpd-13 and Cpd-14 were used as anti-irradiation dye. | |

Each layer further contained Alkanol XC (product of E. I. Du Pont), a sodium alkylbenzenesulfonate, a succinic ester, and Megafax F-120 (product of Dai-nippon Ink) as emulsification and dispersion aid and coating aid. Cpd-15 and Cpd-16 were used as stabilizers for the silver halide.

The silver chlorobromide emulsions used are described below.

| Emulsion No. | Mean Grain Size (μm) | AgBr Content (mol %) | Coefficient of Size Variation |
|---|---|---|---|
| EM1 | 1.0 | 80 | 0.08 |
| EM2 | 0.75 | 80 | 0.07 |
| EM3 | 0.5 | 83 | 0.09 |
| EM4 | 0.4 | 83 | 0.10 |
| EM5 | 0.5 | 73 | 0.09 |
| EM6 | 0.4 | 73 | 0.10 |

The additives used in the sample preparation were as follows.

ExY-1

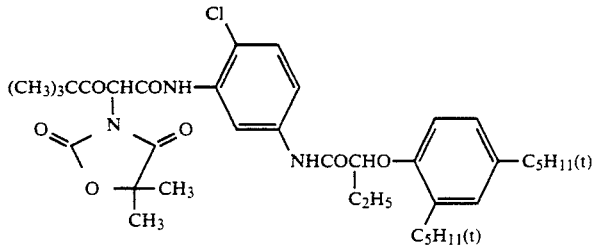

ExY-2 (Y-21)

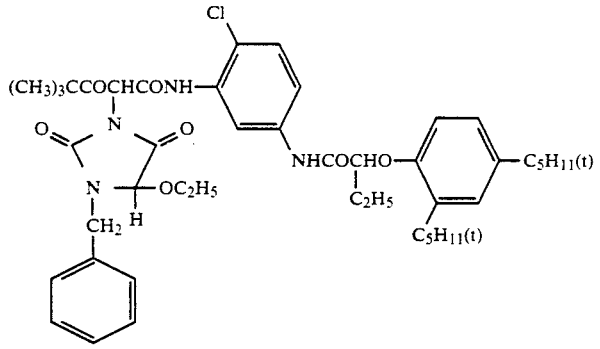

ExM-1 (M-6)

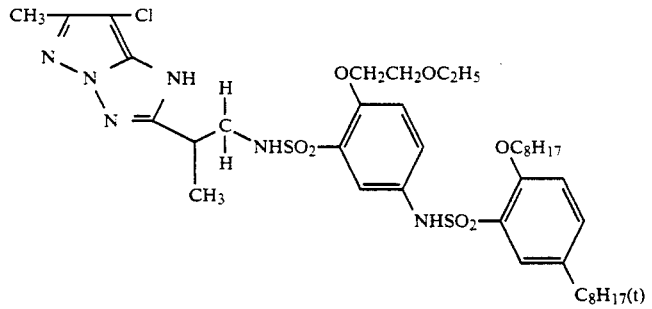

ExC-1 (C-10)

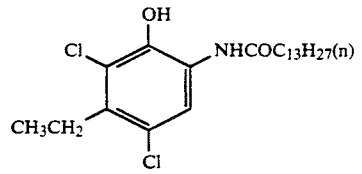

ExS-1

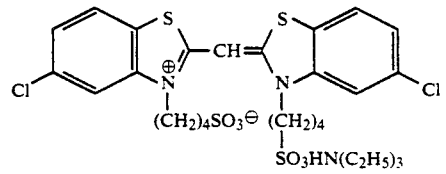

-continued
ExS-2
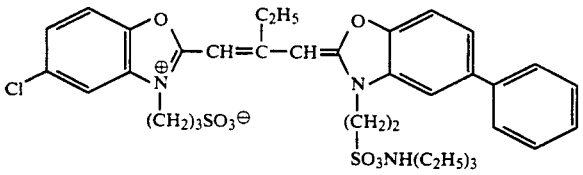
ExS-3
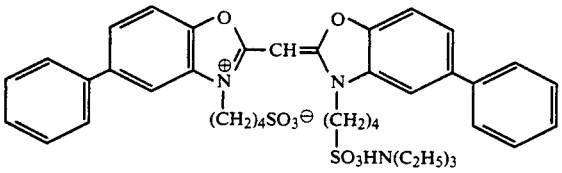
ExS-4
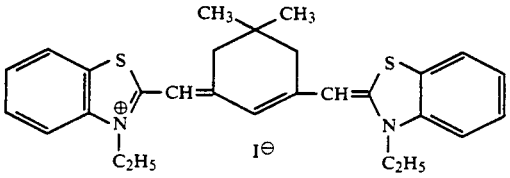
ExS-5
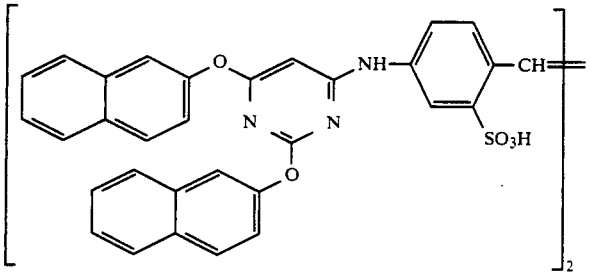
Cpd-1
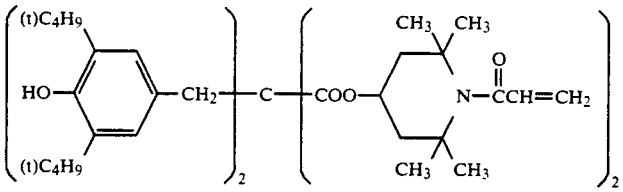
Cpd-2
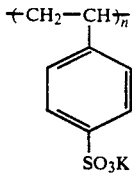
Cpd-3
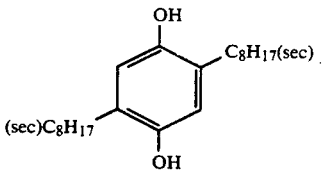
Cpd-4
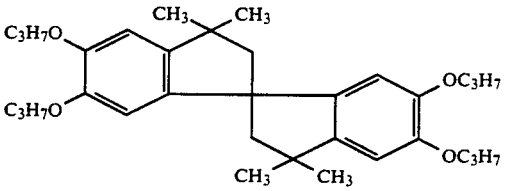

-continued
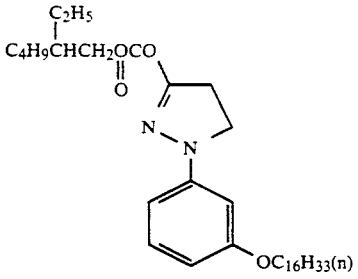
Cpd-5
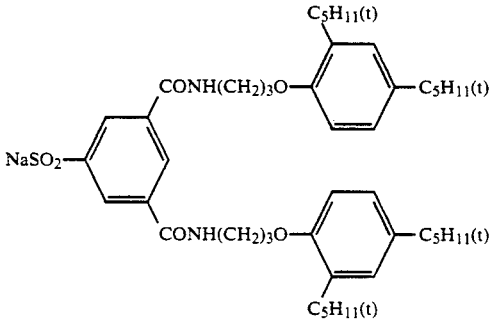
Cpd-6
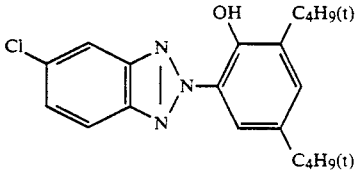
Cpd-7
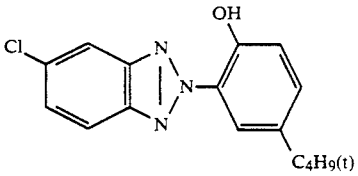
Cpd-8
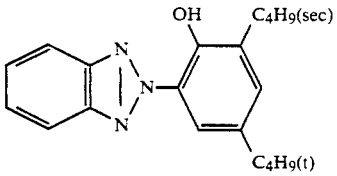
Cpd-9
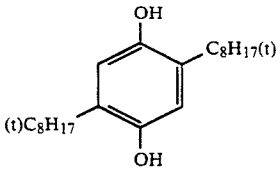
Cpd-10
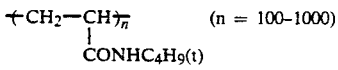
(n = 100–1000)
Cpd-11
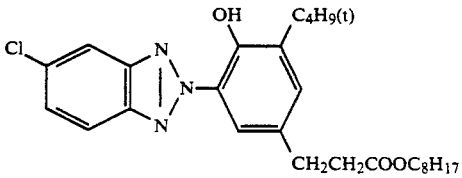
Cpd-12
| | |
|---|---|
| Dibutyl Phthalate | Solv-1 |
| Tricresyl Phosphate | Solv-2 |
| Trioctyl Phosphate | Solv-3 |

-continued

Trinonyl Phosphate — Solv-4

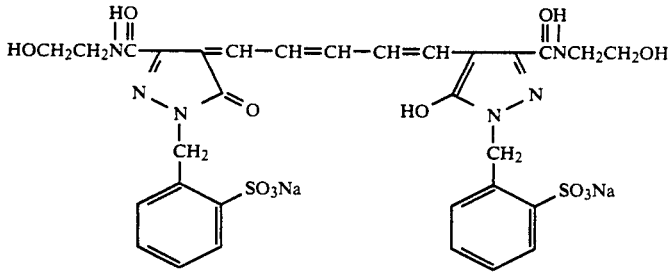

Cpd-13

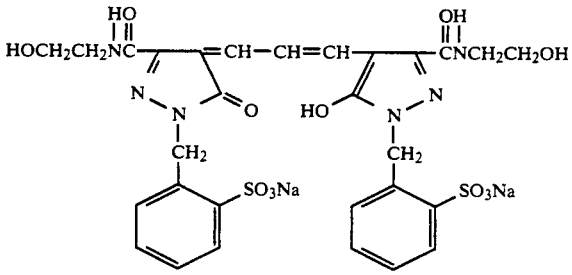

Cpd-14

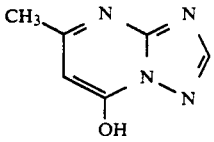

Cpd-15

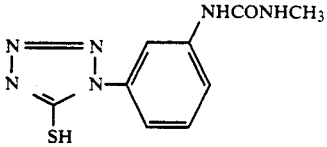

Cpd-16

The gelatin used in the preparation was alkali-processed gelatin having an isoelectric point of 5.

The thus prepared sample was designated Sample 601.

Sample 601 was imagewise exposed and continuously processed according to the following processing procedure until the amount of the color developing replenisher reached twice the volume of the tank (running test).

| Processing Step | Temp. (°C.) | Time (sec) | Rate of Replenishment (ml/m$^2$) | Tank Volume (l) |
|---|---|---|---|---|
| Color Development | 38 | 100 | 290 | 17 |
| Bleach-Fixing | 33 | 60 | 100 | 9 |
| Washing (1) | 30–34 | 15 | — | 4 |
| Washing (2) | 30–34 | 15 | — | 4 |
| Washing (3) | 30–34 | 15 | 200 | 4 |
| Drying | 70–80 | 50 | — | — |

Washing was effected in a three-tank counter-current system of from bath (3) toward bath (1).

The processing solutions used had the following compositions.

| | Start liquor | Replenisher |
|---|---|---|
| Color Developing Solution: | | |
| Water | 800 ml | 800 ml |

-continued

| | Start liquor | Replenisher |
|---|---|---|
| Diethylenetriaminepentaacetic Acid | 1.0 g | 1.0 g |
| Nitrilotriacetic Acid | 2.0 g | 2.0 g |
| 1-Hydroxyethylidene-1,1-diphosphonic Acid | 2.0 g | 2.0 g |
| Potassium Bromide | 0.5 g | — |
| Potassium Carbonate | 30 g | 30 g |
| N-Ethyl-N-(β-methanesulfonamidoethyl)-3-methyl-4-aminoaniline Sulfate | 5.5 g | 7.5 g |
| N,N-Diethylhydroxylamine | 3.6 g | 5.5 g |
| Fluorescent Brightening Agent ("WHITEX" produced by Sumitomo Chemical Co., Ltd.) | 1.5 g | 2.0 g |
| Triethylenediamine-1,4-diazabicyclo[2,2,2]octane | 5.0 g | 5.0 g |
| Water to make | 1000 ml | 1000 ml |
| pH (25° C.) | 10.20 | 10.060 |
| Bleach-Fixing Bath: | | |
| Water | 400 ml | 400 ml |
| Ammonium Thiosulfate (70 wt % aq. soln.) | 200 ml | 300 ml |
| Sodium Sulfite | 20 g | 40 g |
| Ammonium (Ethylenediaminetetraacetato)iron (III) | 60 g | 120 g |
| Disodium Ethylenediaminetetraacetate | 5 g | 10 g |
| Water to make | 1000 ml | 1000 ml |
| pH (25° C.) | 6.70 | 6.30 |

Washing Water

Ion-exchange water with calcium and magnesium concentrations each reduced to 3 ppm or less.

After the running test, each of the running solutions was recovered. The washing water of washing baths (1), (2), and (3) was divided into 500 ml portions, and the compound shown in Table 7 below was added to each portion as a preservative to prepare washing baths (a) to (i).

TABLE 7

| Washing Bath No. | Preservative | Amount of Preservative (mol/l) |
|---|---|---|
| (a) | bisulfite addition compound of A-1 | 0.005 |
| (b) | bisulfite addition compound of A-1 | 0.01 |
| (c) | E-1 | 0.005 |
| (d) | E-1 | 0.01 |
| (e) | bisulfite addition compound of A-1 | 0.005 |
| | E-1 | 0.005 |
| (f) | bisulfite addition compound of A-1 | 0.005 |
| | E-2 | 0.005 |
| (g) | bisulfite addition compound of A-6 | 0.005 |
| | F-1 | 0.005 |
| (h) | bisulfite addition compound of A-37 | 0.0025 |
| | G-6 | 0.005 |
| (i) | bisulfite addition compound of D-1 | 0.005 |
| | H-1 | 0.005 |

Sample 101 was exposed to light through an optical wedge and processed according to the above-described procedure using each of the thus prepared washing baths.

The densities of the yellow (B), magenta (G), and cyan (R) images immediately after processing and after storage at 60° C. and 70% RH for 1 month were measured with a reflection densitometer to obtain the change in minimum density ($\Delta D_{min}$) and in the density of the area which had a density of 2.0 immediately after processing ($\Delta D_{2.0}$).

Further, the formation of a precipitate in the washing water was determined.

The results obtained are shown in Table 8 below.

TABLE 8

| Run No. | Washing Bath No. | $\Delta D_{min}$ B | $\Delta D_{min}$ G | $\Delta D_{min}$ R | $\Delta D_{2.0}$ B | $\Delta D_{2.0}$ G | $\Delta D_{2.0}$ R | Precipitation in Washing Water | Remark |
|---|---|---|---|---|---|---|---|---|---|
| 1 | running solution | +0.20 | +0.10 | +0.11 | −0.02 | +0.03 | −0.25 | observed | Comparison |
| 2 | (a) | +0.18 | +0.08 | +0.09 | −0.01 | +0.02 | −0.24 | slightly observed | " |
| 3 | (b) | +0.14 | +0.07 | +0.06 | −0.01 | +0.01 | −0.22 | scarcely observed | " |
| 4 | (c) | +0.16 | +0.08 | +0.08 | −0.01 | +0.02 | −0.24 | slightly observed | " |
| 5 | (d) | +0.10 | +0.06 | +0.05 | 0 | +0.01 | −0.21 | scarcely obseved | " |
| 6 | (e) | +0.05 | +0.03 | +0.02 | 0 | 0 | −0.15 | not observed | Invention |
| 7 | (f) | +0.04 | +0.03 | +0.02 | 0 | 0 | −0.14 | " | " |
| 8 | (g) | +0.06 | +0.03 | +0.03 | 0 | +0.01 | −0.17 | " | " |
| 9 | (h) | +0.07 | +0.04 | +0.03 | 0 | 0 | −0.18 | " | " |
| 10 | (i) | +0.06 | +0.03 | +0.03 | 0 | +0.01 | −0.18 | " | " |

As is apparent from the results in Table 8, when compared with the use of component (I) or (II) alone, the combined use of the components (I) and (II) is markedly effective to prevent stain formation of the yellow, magenta, and cyan images. It is also seen that the combined use shows satisfactory results in preservability of dye images. Further, the formation of a precipitate in washing water .can be prevented by the combined use of components (I) and (II).

EXAMPLE 7

The procedures of Example 1 were repeated, except for altering the preservative in the fixing bath as shown in Table 9 below. The formation of a precipitate in the fixing bath, washing water and stabilizing bath and coloration of these processing solutions were determined. The results obtained are shown in Table 9 below.

TABLE 9

| Run No. | Bleaching Bath | Preservative of Fixing Bath | Preservative of Washing Water (1) | Residual Silver ($\mu g/cm^2$) | $\Delta D_B$ | $\Delta D_G$ | Precipitation in Fixing, Washing and Stabilizing Baths | Remarks |
|---|---|---|---|---|---|---|---|---|
| 1 | (A) | sodium sulfite (0.1 mol/l) | — | 8.4 | +0.10 | +0.08 | observed | Comparison |
| 2 | " | bisulfite addition compound of A-1 (A'-3) (0.1 mol/l) | — | 4.3 | +0.08 | +0.06 | scarcely observed | Invention |
| 3 | " | E-2 (0.1 mol/l) | — | 3.3 | +0.09 | +0.07 | " | Comparison |
| 4 | " | bisulfite addition compound of A-1 (A'-3) (0.05 mol/l) + E-2 (0.05 mol/l) | — | 0.9 | +0.03 | +0.03 | not observed | Invention |
| 5 | " | bisulfite addition compound of A-1 (A'-3) (0.05 mol/l) + E-1 (0.05 mol/l) | — | 1.0 | +0.04 | +0.04 | " | " |
| 6 | " | bisulfite addition compound of A'-6 (0.05 mol/l) + F-1 (0.05 mol/l) | — | 1.2 | +0.04 | +0.03 | " | " |
| 7 | (A) | bisulfite addition compound of A-10 | — | 1.1 | +0.03 | +0.04 | not observed | Invention |

TABLE 9-continued

| Run No. | Bleaching Bath | Preservative of Fixing Bath | Preservative of Washing Water (1) | Residual Silver ($\mu g/cm^2$) | $\Delta D_B$ | $\Delta D_G$ | Precipitation in Fixing, Washing and Stabilizing Baths | Remarks |
|---|---|---|---|---|---|---|---|---|
| 8 | " | (0.05 mol/l) + G-2 (0.05 mol/l) bisulfite addition compound of B-6 | — | 1.2 | +0.04 | +0.04 | " | " |
| 9 | " | (0.05 mol/l) + H-6 (0.05 mol/l) bisulfite addition compound of C-3 | — | 1.1 | +0.03 | +0.03 | " | " |
| 10 | " | (0.05 mol/l) + E-2 (0.05 mol/l) bisulfite addition compound of D-2 | — | 1.0 | +0.04 | +0.03 | " | " |
| 11 | (A) | (0.05 mol/l) + E-2 (0.05 mol/l) bisulfite addition compound of A-3 | — | 1.0 | +0.03 | +0.04 | not observed | Invention |
| 12 | " | (0.05 mol/l) + E-36 (0.05 mol/l) bisulfite addition compound of A-1 | E-2 (0.005 mol/l) | 1.2 | +0.07 | +0.05 | " | " |
| 13 | (B) | (A'-3) (0.05 mol/l) sodium sulfite (0.1 mol/l) | — | 9.5 | +0.14 | +0.16 | slightly observed | Comparison |
| 14 | " | bisulfite addition compound of A-1 | — | 5.1 | +0.11 | +0.13 | scarcely observed | Invention |
| 15 | " | (A'-3) (0.1 mol/l) E-2 (0.1 mol/l) | — | 6.1 | +0.10 | +0.12 | " | Comparison |
| 16 | " | bisulfite addition compound of A-1 (A'-3) | — | 2.5 | +0.05 | +0.06 | not observed | Invention |
| 17 | (B) | (0.05 mol/l) + E-2 (0.05 mol/l) bisulfite addition compound of A-1 | — | 2.7 | +0.06 | +0.06 | not observed | Invention |
| 18 | " | (A'-3) (0.05 mol/l) + E-1 (0.05 mol/l) bisulfite addition compound of A-6 | — | 2.9 | +0.06 | +0.07 | " | " |
| 19 | " | (0.05 mol/l) + F-1 (0.05 mol/l) bisulfite addition compound of A-10 | — | 2.9 | +0.06 | +0.07 | " | " |
| 20 | " | (0.05 mol/l) + G-2 (0.05 mol/l) bisulfite addition compound of B-6 | — | 2.9 | +0.06 | +0.07 | " | " |
| 21 | (B) | (0.05 mol/l) + H-6 (0.05 mol/l) bisulfite addition compound of C-3 | — | 2.6 | +0.07 | +0.08 | " | " |
| 22 | " | (0.05 mol/l) + E-2 (0.05 mol/l) bisulfite addition compound of D-2 | — | 2.7 | +0.06 | +0.07 | " | " |
| 23 | " | (0.05 mol/l) + E-2 (0.05 mol/l) bisulfite addition compound of A-3 | — | 2.6 | +0.05 | +0.06 | " | " |
| 24 | " | (0.05 mol/l) + E-36 (0.05 mol/l) bisulfite addition compound of A-1 (A'-3) (0.05 mol/l) | E-2 (0.005 mol/ ) | 2.9 | +0.07 | +0.08 | " | " |

As can be seen from the results in Table 9, as compared with the single use of each of the compounds according to the present invention, the combined use of these compounds results in an improvement in the stability of the fixing bath and the succeeding processing solutions, and no precipitate is formed. This effect is particularly marked in Bleaching Bath (A). This combined use also results in an improvement in desilvering performance and image preservability. These effects can also be produced when the compounds of the present invention are separately used in a fixing bath and washing water.

EXAMPLE 8

The same procedures as in Example 6 were repeated, except that the fixing bath contained a combination of Component (I) and Component (II) as shown in Table 10 below. The amounts of Components (I) and (II) were the same as in Example 6. As a result, similar results to those obtained in Example 6 were obtained.

TABLE 10

| Run No. | Bisulfite Addition Compound (Component I) | Component (II) |
|---|---|---|
| 1 | A-1 | E-17 |
| 2 | A-1 | F-1 |
| 3 | A-2 | E-38 |
| 4 | A-13 | G-13 |
| 5 | A-33 | H-1 |
| 6 | A-38 | E-25 |
| 7 | B-4 | J-3 |
| 8 | C-3 | E-35 |
| 9 | C-10 | F-2 |
| 10 | C-16 | G-7 |
| 11 | D-1 | E-38 |
| 12 | D-2 | G-2 |
| 13 | D-6 | E-2 |

EXAMPLE 9

A sample was prepared in the same manner as in Example 5, except for replacing Cpd-26 and ExM-3 with Cpd-26' and ExM-3' shown below, respectively. The resulting sample was processed in the same manner as in Example 5, except that Components (I) and (II) shown in Table 11 below were used as a preservative in the bleach-fixing bath. The results obtained are shown in Table 11 below.

Cpd-26':

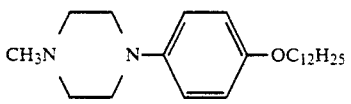

ExM-3':

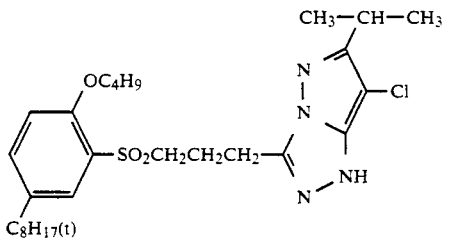

TABLE 11

| Run No. | Preservative of Bleach-Fix Bath: Component (I) | Preservative of Bleach-Fix Bath: Component (II) | Residual Silver ($\mu g/cm^2$) | $\Delta D_R$ | Precipitation in Bleach-Fixing Bath and Washing Water | Remarks |
|---|---|---|---|---|---|---|
| 1 | — | — | 5.9 | +0.23 | observed | Comparison |
| 2 | A-1 (A'-3) (0.2 mol/l) | — | 2.1 | +0.11 | slighlty observed in washing water | Invention |
| 3 | — | E-2 (0.2 mol/l) | 2.5 | +0.13 | slighltly observed in washing water | Comparison |
| 4 | A-1 (A'-3) (0.1 mol/l) | E-2 (0.1 mol/l) | 0.5 | 0 | not observed | Invention |
| 5 | A'-3 (0.1 mol/l) | E-17 (0.05 mol/l) | 0.6 | +0.02 | " | " |
| 6 | A-3 (0.1 mol/l) | F-1 (0.1 mol/l) | 0.7 | +0.01 | " | " |
| 7 | A-6 (0.1 mol/l) | E-2 (0.1 mol/l) | 0.5 | +0.01 | " | " |
| 8 | A-37 (0.05 mol/l) | F-6 (0.1 mol/l) | 0.8 | +0.04 | " | " |
| 9 | B-6 (0.1 mol/l) | E-36 (0.1 mol/l) | 0.9 | +0.05 | " | " |
| 10 | C-3 (0.1 mol/l) | G-6 (0.1 mol/l) | 0.7 | +0.04 | " | " |
| 11 | C-10 (0.1 mol/l) | H-1 (0.1 mol/l) | 0.9 | +0.05 | " | " |
| 12 | D-1 (0.1 mol/l) | E-2 (0.1 mol/l) | 0.6 | +0.03 | " | " |
| 13 | D-2 (0.1 mol/l) | E-1 (0.1 mol/l) | 0.7 | +0.04 | " | " |

As is shown by the results in Table 11, where processing is carried out using an automatic developing machine having a contact area between each processing solution and air as small as 75 $cm^2$, with a bleach-fixing bath containing ammonium sulfite conventionally used as a preservative, satisfactory color restoration cannot be achieved, and the developed cyan dye becomes a leuco dye reducing the .color density. This color restoration insufficiency can be eliminated by using a combination of the compounds according to the present invention as compared with the single use of these compounds. Further, the combined use is effective to markedly prevent formation of a precipitate in the bleach-fixing bath or washing water.

As demonstrated above, the stability of processing solutions can be improved and stain formation can be suppressed by incorporating Component (I) and Component (II) into a processing solution of at least one of the processing steps involved.

While the invention has been described in detail and with reference to specific embodiments thereof, it will be apparent to one skilled in the art that various changes and modifications can be made therein without departing from the spirit and scope thereof.

What is claimed is:

1. A fixing solution having a pH of from 5.0 to 9.0 or a bleach-fixing solution which contains (1) a thiosulfate and at least one of (2) at least one compound selected from the group consisting of a bisulfite and a sulfite, and a compound represented by formula (A'):

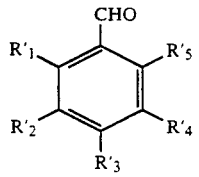

(A')

wherein $R'_1$, $R'_2$, $R'_3$, $R'_4$, and $R'_5$ each represents a hydrogen atom or a substituent other than a hydroxyl group or a group containing a hydroxyl group, provided that at least one of $R'_1$ to $R'_5$ is at least one of a sulfo group and a group containing a sulfo group, and (3) at least one bisulfite addition compound of a compound represented by formula (A').

2. A method for processing a silver halide photographic material which comprises processing an imagewise exposed silver halide photographic material with a fixing solution having a pH of from 5.0 to 9.0 or a bleach-fixing solution containing (1) a thiosulfate, wherein said fixing solution or said bleach-fixing solution further contains at least one of (2) at least one compound selected from the group consisting of a bisulfite and a sulfite, and a compound represented by formula (A'):

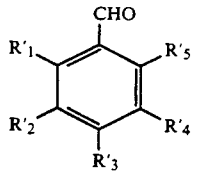

(A')

wherein $R'_1$, $R'_2$, $R'_3$, $R'_4$ and $R'_5$ each represents a hydrogen atom or a substituent other than a hydroxyl group or a group containing a hydroxyl group, provided that at least one of $R'_1$ to $R'_5$ is at least one of a sulfo group and a group containing a sulfo group, and (3) at least one bisulfite addition product of a compound represented by formula (A').

3. A method as claimed in claim 2, wherein $R'_1$, $R'_2$, $R'_3$, $R'_4$ and $R'_5$ each represents a halogen group, a cyano group, a sulfino group, a sulfo group, a phosphono group, a hydrogen atom, a substituted or unsubstituted alkyl group, a substituted or unsubstituted alkenyl group, a substituted or unsubstituted alkynyl group, a substituted or unsubstituted cycloalkyl group, a substituted or unsubstituted aryl group, a substituted or unsubstituted aralkyl group, a substituted or unsubstituted heterocyclic group, a substituted or unsubstituted alkoxy group, a substituted or unsubstituted aryloxy group, a substituted or unsubstituted alkoxycarbonyl group, a substituted or unsubstituted acyloxy group, a substituted or unsubstituted thioether group, a substituted or unsubstituted sulfamoyl group, a substituted or unsubstituted amino group, a substituted or unsubstituted ammonio group, a substituted or unsubstituted acylamino group, a substituted or unsubstituted carbamoyl group or a substituted or unsubstituted sulfamoyl group.

4. A method as claimed in claim 2, wherein said compound represented by formula (A') is a compound where any one or two of $R'_1$, $R'_2$, $R'_3$, $R'_4$ and $R'_5$ each represents a sulfoalkyl group, a sulfoalkyloxy group, a sulfoalkylcarbamoyl group, a hydrogen group, a halogen atom, a sulfino group or a sulfo group; and at least three of $R'_1$, $R'_2$, $R'_3$, $R'_4$ and $R'_5$ are a hydrogen atom.

5. A method as claimed in claim 2, wherein said compound represented by formula (A') is benzaldehyde substituted with only a sulfoalkyloxy group whose ortho-position is substituted with a sulfo group in which at least three of $R'_1$, $R'_2$, $R'_3$, $R'_4$ and $R'_5$ are hydrogen atoms and none of $R'_1$, $R'_2$, $R'_3$, $R'_4$ and $R'_5$ contains a hydroxyl group or a group containing a hydroxyl group.

6. A method as claimed in claim 2, wherein said thiosulfate is contained in the fixing solution or bleach-fixing solution in an amount of from 0.1 to 3 mol/l.

7. A method as claimed in claim 2, wherein said compound represented by formula (A') is contained in the processing solution in an amount of $1\times10^{-5}$ to 10 mol/l.

8. A method as claimed in claim 2, wherein the molar ratio of said compound represented by formula (A') to said bisulfite or sulfite is from 30/1 to 1/30.

9. A method as claimed in claim 2, wherein said bisulfite addition product of the compound represented by formula (A)' is contained in the processing solution in an amount of from $1\times10^{-5}$ to 10 mol/l.

* * * * *